US007239831B2

(12) United States Patent
Hagiwara et al.

(10) Patent No.: US 7,239,831 B2
(45) Date of Patent: Jul. 3, 2007

(54) IMAGE FORMING APPARATUS WHEN A MAXIMUM DEVELOPING BIAS VOLTAGE |V| MAX AND SURFACE POTENTIAL VD OF A CHARGED IMAGE BEARING MEMBER SATISFY: |V| MAX≦|VD|

(75) Inventors: Kazunari Hagiwara, Numazu (JP); Kouichi Okuda, Tokyo (JP); Yasunori Chigono, Susono (JP); Yasushi Shimizu, Shizuoka-ken (JP); Hikaru Osada, Mishima (JP); Shuji Moriya, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 11/011,145

(22) Filed: Dec. 15, 2004

(65) Prior Publication Data

US 2005/0196201 A1 Sep. 8, 2005

(30) Foreign Application Priority Data

Dec. 15, 2003 (JP) ..... 2003-416767

(51) Int. Cl.
*G03G 15/09* (2006.01)

(52) U.S. Cl. ..... 399/270; 399/150

(58) Field of Classification Search ..... 399/149, 399/150, 252, 265, 270, 272
See application file for complete search history.

(56) References Cited

U.S. PATENT DOCUMENTS

| | | | | |
|---|---|---|---|---|
| 4,281,329 | A | 7/1981 | Yano et al. | 346/1.1 |
| 4,292,387 | A | 9/1981 | Kanbe et al. | 430/102 |
| 4,395,476 | A | 7/1983 | Kanbe et al. | 430/102 |
| 4,444,864 | A | 4/1984 | Takahashi | 430/120 |
| 4,473,627 | A | 9/1984 | Kanbe et al. | 430/102 |
| 4,913,088 | A | 4/1990 | Kanbe et al. | 118/651 |
| 5,032,485 | A | 7/1991 | Kanbe et al. | 430/120 |
| 5,044,310 | A | 9/1991 | Kanbe et al. | 118/653 |
| 5,096,798 | A | 3/1992 | Kanbe et al. | 430/120 |
| 5,122,838 | A | 6/1992 | Kohyama | 355/269 |
| 5,194,359 | A | 3/1993 | Kanbe et al. | 430/120 |
| 6,061,539 | A | 5/2000 | Ishiyama et al. | 399/175 |
| 6,128,449 | A * | 10/2000 | Zenba et al. | 399/50 |

(Continued)

FOREIGN PATENT DOCUMENTS

| | | |
|---|---|---|
| JP | 54-43027 | 4/1979 |

(Continued)

*Primary Examiner*—Hoan Tran
(74) *Attorney, Agent, or Firm*—Fitzpatrick, Cella, Harper & Scinto

(57) ABSTRACT

An image forming apparatus includes an image bearing member; a charging device for electrically charging the image bearing member; a rotatable developer carrying member for carrying a developer to develop an electrostatic image formed on the image bearing member with the developer, the developer carrying member being supplied with a developing bias voltage including an AC voltage; non-rotatable magnetic field generating device, disposed inside the developer carrying member, for magnetically attracting the developer on the developer carrying member, wherein the developer carrying member has a surface elastic layer, and the developer carrying member is press-contacted to the image bearing member, and the developer is one component magnetic toner, and a maximum value of an absolute value of the developing bias voltage |V|max and a surface potential of the image bearing member charge by the charging device is Vd(V), satisfy, $$|V|max=|Vd|.$$

11 Claims, 24 Drawing Sheets

U.S. PATENT DOCUMENTS

| | | | | |
|---|---|---|---|---|
| 6,128,456 | A | 10/2000 | Chigono et al. | 399/176 |
| 6,167,212 | A | 12/2000 | Satoh et al. | 399/55 |
| 6,173,144 | B1 | 1/2001 | Hirabayashi et al. | 399/222 |
| 6,272,306 | B1 | 8/2001 | Saito et al. | 399/270 |
| 6,301,455 | B1 | 10/2001 | Ishiyama et al. | 399/102 |
| 6,389,254 | B2 | 5/2002 | Ishiyama et al. | 399/176 |
| 6,463,245 | B1 | 10/2002 | Suwa et al. | 399/274 |
| 6,549,742 | B1 | 4/2003 | Chigono et al. | 399/174 |
| 6,560,426 | B2 * | 5/2003 | Sakaizawa et al. | 399/150 |
| 6,611,669 | B2 * | 8/2003 | Suzuki et al. | 399/149 |
| 6,847,796 | B2 | 1/2005 | Chigono et al. | 399/174 |
| 2003/0175043 | A1 | 9/2003 | Handa et al. | 399/111 |
| 2004/0005160 | A1 | 1/2004 | Kawamura et al. | 399/55 |

FOREIGN PATENT DOCUMENTS

| | | |
|---|---|---|
| JP | 55-18656 | 2/1980 |
| JP | 2598131 | 1/1997 |
| JP | 10-307455 | 11/1998 |
| JP | 2000-122388 | 4/2000 |
| JP | 2001-92201 | 4/2001 |

* cited by examiner (a)

(b)

IMAGE FORMING APPARATUS WHEN A MAXIMUM DEVELOPING BIAS VOLTAGE |V| MAX AND SURFACE POTENTIAL VD OF A CHARGED IMAGE BEARING MEMBER SATISFY: |V| MAX≦|VD|

FIELD OF THE INVENTION AND RELATED ART

The present invention relates to an image forming apparatus which employes an electrophotographic recording method, an electrostatic recording method, or the like.

More specifically, the present invention relates to such an image forming apparatus as a copying machine, a printer, etc., which develops an electrostatic latent image formed on an image bearing member, for example, an electrophotographic photosensitive member, an electrostatically recordable dielectric member, or the like, with the use of a single-component developing method of a contact type.

In the case of an electrophotographic image forming apparatus, an electrostatic latent image formed on an electrophotographic photosensitive member as an image bearing member (object to be developed) is developed with the use of developer. As for the developing method of a single-component type in accordance with the prior art, (1) a magnetic noncontact AC developing method, and (2) a nonmagnetic contact DC developing method have been widely used.

(1) Magnetic Noncontact AC Developing Method

This method (for example, Japanese Laid-open Patent Applications 54-43027 and 55-18656) uses magnetic single-component developer, and a development sleeve (developer bearing member) containing a magnet The development sleeve is positioned so that a predetermined minute gap is maintained between the peripheral surface of the development sleeve and the peripheral surface of the photosensitive member. The developer is borne on the peripheral surface of the development sleeve, and a latent image on the photosensitive member is developed by the developer, as the developer is caused to shuttle across this minute gap between the development roller and photosensitive member. The developer in the developing apparatus (which hereinafter may be referred to as developing device) is conveyed to the development sleeve by a stirring mechanism or gravity, and is supplied to the development sleeve by a certain amount of magnetic force originating from the abovementioned magnet. The toner borne on the peripheral surface of the development sleeve is formed by a regulating means into a developer layer of a predetermined thickness to be used for development. Not only is the force from the magnet used for conveying the developer, but also, it is used in the development station for another, definite purpose of preventing the formation of an image suffering from the so-called fog, that is, an image defect attributable to the phenomenon that the developer moves (adheres) to the white (blank) areas (non-image portions) of an image. More specifically, during development, the developer is subjected to the magnetic force from the magnetic roll in the development sleeve, which acts in the direction to attract the developer toward the magnet roll; in other words, the developer remains subjected to such force that acts to hold the developer to the development sleeve. As the force for causing the developer to shuttle across the aforementioned gap, AC bias is used. More specifically, development bias is applied between the development sleeve and photosensitive member, in order to make the developer shuttle between the portion of the peripheral surface of the development sleeve in the development station, and the portion of the peripheral surface of the photosensitive member, inclusive of the points to which the developer is to be adhered, as well as the points to which the developer is not to be adhered, in the development station. As a result, the points to which the developer is to be adhered are developed by the developer.

(2) Nonmagnetic Contact DC Developing Method

There has been proposed a developing method which uses a combination of a development roller (developer bearing member) having an elastic layer, and nonmagnetic developer (for example, Japanese Laid-open Patent Application 2001-92201). According to this developing method, the nonmagnetic developer is borne in a layer on the development roller, and a latent image on the photosensitive member is developed by placing the developer layer in contact with the peripheral surface of the photosensitive member. The developer in the developing device is conveyed to the adjacencies of an elastic roller formed of a spongy material and disposed in contact with the development roller, and then, is supplied by the elastic roller to the development roller. For the purpose of ensuring that the developer is uniformly borne on the peripheral surface of the development roller, in terms of the thickness of the developer layer, as well as the amount of electrical charge per unit of developer, the spongy roller is given the role of removing from the peripheral surface of the development roller the developer which was not consumed for development. Between the substrate of the photosensitive member and the development roller, DC bias is applied.

(3) Cleaner-less (Toner Recycling) System

From the standpoint of the simplification of apparatus structure, and the prevention of waste production, an electrophotographic process in which toner is recycled in the apparatus in order to eliminate a drum cleaner (cleaning apparatus) as a surface cleaning means dedicated to the cleaning of the peripheral surface of the photosensitive member after the transfer process, has been proposed for an image forming apparatus of a transfer type. For example, there has been proposed an image forming apparatus in which the above described nonmagnetic contact DC developing method is utilized to recover the residual developer, or the developer remaining on the photosensitive member after the image transfer, at the same time and location as the latent image on the photosensitive member is developed (for example, Japanese Patent 2598131).

There has also been proposed an image forming apparatus which utilizes the above described magnetic noncontact AC developing method to recover the transfer residual toner, or the developer remaining on the photosensitive member after the image transfer, at the same time and location as a latent image on the photosensitive member is developed (for example, Japanese Laid-open Patent Application 10-307455).

The above described nonmagnetic contact DC developing method (2) in accordance with the prior art has been problematic in that the surface irregularity of the development roller in terms of texture results in the formation of an image suffering from the defect that the half-tone areas of an image are irregular in density. Theoretically, the formation of an image having irregularity in density can be prevented by producing a development roller uniform in the texture of its peripheral surface. However, it is difficult to produce a development roller uniform in the texture of its peripheral surface. Further, even if such a development roller is produced, as the cumulative number of the images formed by the image forming apparatus employing such a development roller increases, the development roller becomes shaved at the peripheral surface, and/or deteriorates in certain properties. As a result, even a "perfect" development sleeve becomes irregular across its peripheral surface in terms of texture, as well as surface properties. In other words, it is even more difficult to produce a development sleeve which remains stable in performance throughout its service life.

There is also the problem of the deterioration of a development roller in terms of fog prevention. More specifically, as the process of mechanically stripping the toner from the development sleeve by the elastic roller is repeated, the toner deteriorates in certain properties, in particular, the capability of being frictionally charged, resulting sometimes in the formation of an image suffering from the fog of a more serious nature. Incidentally, "fog" means the image defect that a slight amount of toner is adhered to the white (blank) portions, that is, the portions (unexposed portion) to which toner is not to be adhered, of an image, causing thereby the white (blank) portions to appear as if they were soiled. It is possible to reduce the amount of the friction generated by the elastic roller, in order to prevent the toner from deteriorating in certain properties. However, it is difficult to reduce the friction generated by the elastic roller by an amount sufficient to prevent the deterioration of the toner properties while preventing the formation of an image suffering from "ghost". Here, "ghost" means such a ghost that repeats itself across an image, with intervals which match the circumferential dimension of a development roller. It is the phenomenon that the pattern of the portion of a latent image developed during a given rotation of a development roller emerges in the half-tone portions of the image, as the half-tone portions are developed. In other words, that an image has ghosts means that a certain amount of the development residual toner failed to be stripped from the development roller. In other words, it means that the portion of the development residual toner, which failed to be stripped away from the development roller, is continuously subjected to the friction from the elastic roller, being therefore undesirable also from the standpoint of the deterioration of the toner properties. In terms of the adjustment of the frictional force, the fog and ghost contradict each other, and moreover, the problem of the fog itself has its own contradictory factors.

There is an additional problem that as toner deteriorates in certain properties, it is likely to be affected by being circulated in the developing device. To describe in more detail, when toner is circulated, mechanically or by gravity, in the developing device, there are areas in which toner particles remain stationary; the toner particles in certain areas, more specifically, the adjacencies of the development roller, are not replaced, being therefore little affected in properties by the friction. Whereas, the toner particles in the areas in which they are circulated are affected in certain properties by the friction to some degree. In other words, as the toner in the developing device is circulated, toner particles different in properties are created. Thus, as the toner in the developing device reduces in entirety, these toner particles different in properties become mixed with each other, creating problems, in particular, the fog attributable to the toner agglomeration. There is also an image defect attributable to the elastic roller itself. That is, from the standpoint of the toner supplying performance, as well as the toner stripping performance, of the elastic roller, an elastic roller formed of a spongy material is employed as the elastic roller. Thus, developer particles are packed into the cells of the spongy material, becoming thereby agglomerated into developer particles of larger sizes. As these developer particles of larger sizes come out of the spongy material, an image suffering from defects, in particular, an image having defects in its halftone areas, is formed.

Moreover, there is the problem of the scattering of toner. That is, as the developer deteriorates in terms of the faculty of remaining held to the development roller, the toner scatters in the apparatus, causing various problems.

Further, in the case of an image forming apparatus employing the cleaner-less developing method, paper dust enters the elastic roller, resulting in the formation of an image suffering such a defect that repeats itself across the image (recording medium) with intervals which match the circumferential dimensions of the development sleeve.

In comparison, in the case of the above described magnetic noncontact developing method (1), an image having defects along the edges (borderlines) between the white (blank) areas and the areas covered with toner is formed. More specifically, the edges of the highly dense portions of an image are developed excessively densely, in particular, on the downstream side in terms of processing direction, whereas the edges of the portions of an image, immediately next to a highly dense portion of the image, are developed excessively lightly. The cause for this phenomenon is thought to be that a latent image on the photosensitive member is developed in the noncontact manner, that is, by causing the developer to be reciprocally moved between the development roller and photosensitive member by the AC electric field. More specifically, it is thought that in the development station, the toner particles deviate in the direction parallel to the plane of the peripheral surface of the photosensitive member (development roller), accumulating thereby along the aforementioned edges (borderline), in particular, on the downstream side, and also, attracting toner particles from outside the edge portions. As a result, an image suffering from the above described defects is yielded.

Further, in the case of the cleaner-less developing method, a latent image is developed without any direct contact between the development roller and photosensitive drum. Therefore, an image forming apparatus employing the cleaner-less developing method is relatively low in performance in terms of the toner recovery from the photosensitive drum, being therefore problematic in that the transfer residual toner possibly results in the formation of such a defective image that has ghosts across its solid white (blank) areas and/or half-tone areas. It also possibly yields an image having black dots in solid white (blank) areas. An image having the black dots of this type is likely to be yielded as paper dust enters between the development roller and photosensitive drum when temperature and humidity are high. This is thought to occur because as paper dust enters between the development roller and photosensitive member under the high-temperature and high-humidity conditions, bias leak will occur between the development roller and photosensitive drum, and as a result, the potential level of the latent image on the photosensitive drum reduces in absolute value.

SUMMARY OF THE INVENTION

The primary object of the present invention is to provide an image forming apparatus superior to an image forming apparatus in accordance with the prior art, in that it does not suffer from the above described problems.

Another object of the present invention is to prevent developer from deteriorating in certain properties in order to provide an image forming apparatus which does not form an image suffering from the fog attributable to the developer deterioration.

Another object of the present invention is to provide an image forming apparatus which does not form an image having defects in its half-tone areas.

Another object of the present invention is to provide an image forming apparatus which does not form an image having ghosts.

Another object of the present invention is to provide an image forming apparatus which does not form an image having defects in its solid white (blank) areas.

Another object of the present invention is to provide an image forming apparatus suitable for recovering the developer remaining on an image bearing member, with the use of a developing apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
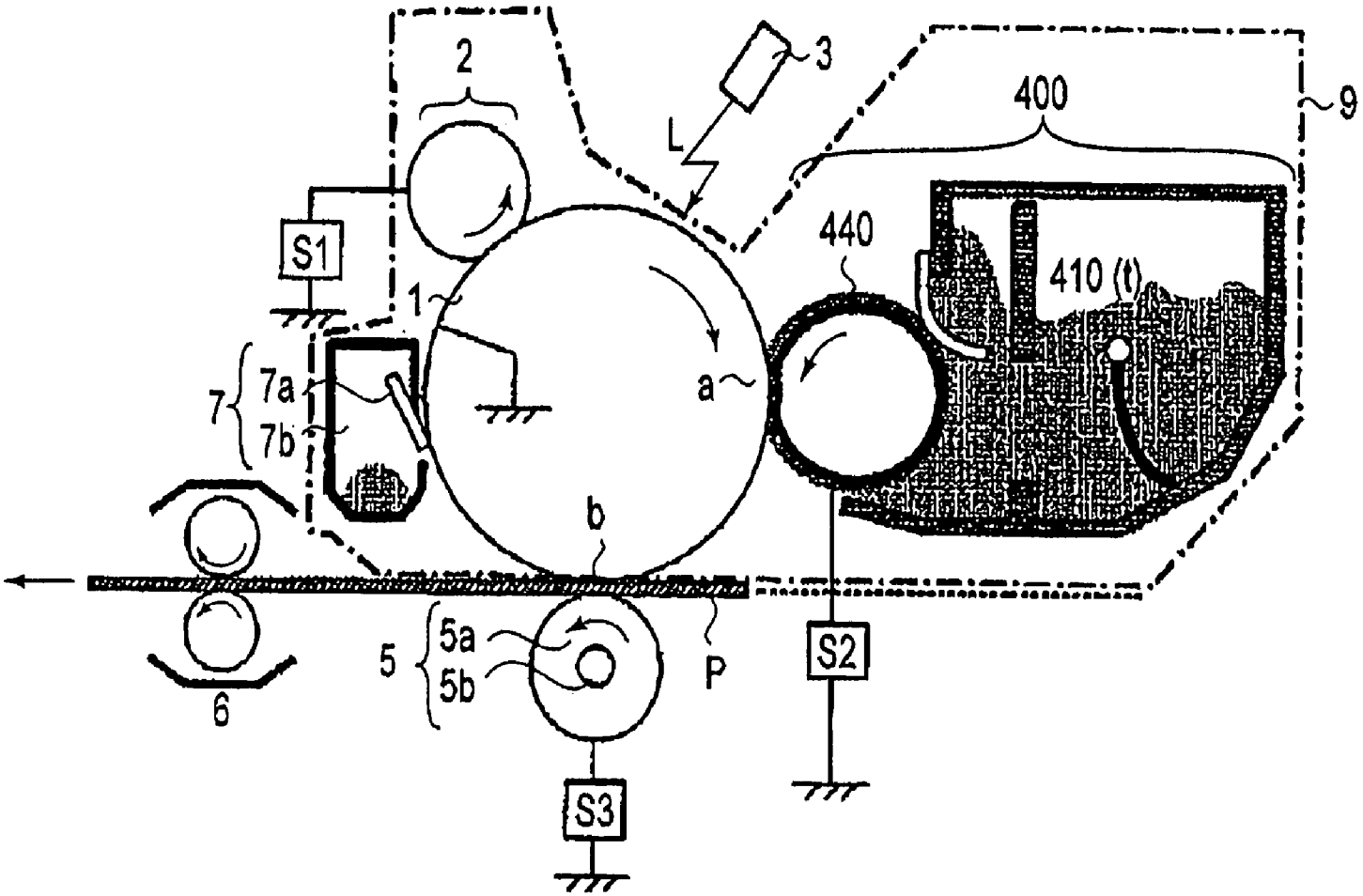
FIG. 1 is a schematic drawing of the image forming apparatus in the first embodiment, showing the general structure thereof.

Hereinafter, the preferred embodiments of the image forming apparatus in accordance with the present invention will be described with reference to the appended drawings.

(1) Charging Means

As a charging means for charging an image bearing member, the noncontact or contact charging method can be employed. As the noncontact charging method, a charging device of a corona type, which uses a piece of wire, can be employed.

As for the contact charging method, in order to charge the surface of an object such as an image bearing member to predetermined polarity and potential level, a predetermined charge bias may be applied to a charging member in the form of a roller, a brush, a magnetic brush, a blade, or the like, placed in contact with the object.

From the standpoint concerning the effect of ozone, the usage of the contact charging method is preferable. However, the charging method does not need to be limited to the contact charging method.

(2) Latent Image Forming Means

When an image bearing member is an electrophotographic photosensitive member, a laser beam scanner (exposing device) comprising laser diodes, polygon mirrors, etc., may be employed. The function of the laser beam scanner is to scan (expose) the uniformly charged peripheral surface of a photosensitive drum, by outputting a beam of laser light modulated with sequential electrical digital pixel signals in accordance with the image formation data of an intended image. As the peripheral surface of the photosensitive member is scanned (exposed) by the laser beam scanner, an electrostatic latent image in accordance with the image formation data of the intended image is formed on the peripheral surface of the photosensitive member. As an exposing device, a set of multiple styluses, an ion head, an LED array, or the like may be employed in place of the above described laser beam scanner. The exposing means does not need to be limited to digital exposing devices. It may be an analog image exposing means employing a light projecting system. For example, it may be a combination of a fluorescent light and liquid crystal shutters, or the like. In other words, it may be any exposing means, as long as it is capable of forming an electrostatic latent image in accordance with the image formation data.

When an electrostatically recordable dielectric member is used as the image bearing member, the surface of the electrostatically recordable dielectric member is uniformly charged to predetermined polarity and potential level, and electrical charge is removed from selected points among the numerous points of the charged surface, with the use of a charge removing means such as an array of charge removal needles, an electron gun, or the like, in order to write an electrostatic latent image on the surface of the dielectric member.

(3) Transferring Means

As a transferring means, it is possible to employ a transfer roller formed of foamed material, the electrical resistance of which is the mid range, a corona type charging device, or the like. However, it does not need to be limited to these.

As the material for the transferring means, the electrical resistance of which is in the mid range, it is possible to use a material that is formed by dispersing electrically conductive resin such carbon black in urethane resin, or the like material. However, it does not need to be limited to these materials. The electrical resistance of the transferring means is desired to be in the range of $10^8$–$10^9$ Ω. It is desired that voltage, the potential level of which is in the range of 0.5 kV –5.0 kV, and the polarity of which is opposite to that of the voltage applied for charging the photosensitive member, is applied to the peripheral surface of the transfer roller, or the like.

(4) Developing Means

As the developing method, the contact developing method, in which an image bearing member and a developer bearing member are kept in contact with each other with the application of a predetermined amount of pressure, may be employed.

(4-1) Contact Conditions between Image Carrying Member and Developer Bearing Member The pressure between the image bearing member and the developer carrying member is preferably 50–3000 N/m (drawing pressure).

In this embodiment, the drawing pressure is a pressure value corresponding to a line pressure and is a force per 1 m required to draw a SUS (stainless steel) plate of 30 μm thick sandwiched between two SUS plates each having a thickness of 30 μm, the SUS plate being sandwiched between the objects which are contacted to each other (between the image bearing member and the developer carrying member, here).

If the drawing pressure is not less than 3000 N/m, remarkable scraping of the surface of the image bearing member and/or deterioration of the developer, and therefore, image defects result. If it is not more than 50 N/m, the size of the developing zone is not sufficient, with the result that transition of the developer from the developer carrying member onto the image bearing member is not sufficient, and therefore, image defects result.

(4-2) Peripheral Velocities of Image Carrying Member and Developer Bearing Member The ratio of the peripheral velocity of the image bearing member to that of the developer bearing member is desired to be in the range of 1:0.5–3.0. If the ratio of the peripheral velocity of the image bearing member to that of the developer bearing member is no more than 0.5, the absolute amount by which the developer transfers from the developer bearing member to the image bearing member will be too small, resulting in the formation of an image, the solid black areas of which are lower in density than expected. On the other hand, if it is no less than 3.0, the developer will be drastically deteriorated.

(4-3) Contact Developing Method

As the contact developing method, the magnetic contact developing method which uses magnetic toner as developer, and the nonmagnetic contact developing method which uses nonmagnetic toner as developer, may be employed. However, the magnetic contact developing method is preferable.

Unlike the nonmagnetic single-component developing method, the magnetic contact developing method makes it possible for developer to be conveyed with the use of magnetic force. Therefore, not only can the scattering of developer be prevented through the physical contact between toner and a controlling means, but also, it can be prevented by using magnetic force. Thus, the employment of the magnetic contact developing method is preferable in that the scattering of toner can be more easily controlled.

Further, magnetic developer contains magnetic substance, being therefore lower in electrical resistance than nonmagnetic developer. In other words, magnetic developer is lower in electrical capacity than the nonmagnetic developer. Therefore, it is less likely to become nonuniform in terms of electrical capacity; it is less likely to occur that a given portion of the body of developer in the developing device becomes substantially greater in electrical capacity than the body of developer in another area. Thus, magnetic developer is preferable in terms of leak prevention.

(4-3-1) Magnetic Contact Developing Method

Next, the magnetic contact developing method will be described.

a: Developer for Magnetic Contact Developing Method

The primary ingredient of the developer for the magnetic contact developing method is dielectric toner. The developer is desired to externally contain a small amount of particulate silica. The particulate silica is externally added to control the toner in the amount of triboelectic charge, in order to increase image density, and also, to produce an image minimized in roughness. It has been known to add particulate silica produced by vapor phase processing (dry silica) and/or particulate silica produced by wet processing (wet silica). As the external additive, microscopic particles of an electrically conductive oxide, a metal, resin, or the like, can be used in place of particulate silica. However, the external additive does not need to be limited to these.

As the primary ingredient of the developer, styrene-acrylic resin, polyester resin, or compound resin formed of these two resins may be used. However, it does not need to be limited to these substances.

b: Magnetic Single-component Developer

The toner is desired to the mixture of 100 parts in weight of resin, as the primary ingredient of the toner, and 30–150 parts in weight of magnetic particles. As the material for magnetic particles, oxide of a magnetic metal (magnetite, wustite, etc.) can be used. In consideration of the magnetic force necessary for developer conveyance, magnetite, the electrical resistance of which is high enough to provide toner particles with a sufficient amount of electrical charge, is preferable. However, it does not need to be limited to magnetite.

The reason the amount by which magnetic particles are added to 100 parts in weight of resin is set to 30–150 parts is as follows: If the amount is no more than 30 parts in weight, the developer fails to be adhered to a developer bearing member by a sufficient amount; a developer bearing member will not be supplied with a sufficient amount of the developer. On the other hand, if the amount is no less than 150 parts in weight, the developer will be too high in electrical conductivity, making it impossible to sufficiently charge the developer. Further, if the magnetic poles of the magnetic force generating means in the developer bearing member are within the range in which development occurs, the force which acts in the direction to keep the developer adhered to the developer bearing member will be too strong to allow the developer to transfer from the developer bearing member to the image bearing member.

c: Regulating Member

The amount by which the developer is allowed to remain on the peripheral surface of the developer bearing member after being borne thereon is regulated by a regulating member, which is an elastic member. As the material for the elastic regulating member, a metallic substance such as SUS or phosphor bronze, a resin such as urethane, or the like, is used. However, it does not need to be limited to these substances. On the other hand, SUS, phosphor bronze, or the like metallic substances, are superior to resinous material, in terms of temperature resistance and humidity resistance, and also, are smaller than resinous substances, in terms of the volumetric changes. Therefore, for the purpose of better charging the developer, and also, for reliably charging the developer, a metallic regulating member is preferable to a resinous regulating member.

As for the shape of the regulating member formed of a piece of elastic metal plate, a piece of elastic rubber plate, or the like, the regulating member may be straight, or bent at the free edge. Further, the functional surface of the regulating member may be given a special texture, or may be coated with resin. However, the regulating member does not need to be limited to those described above.

The substrate portion of the regulating member may be rendered the same in potential level as the substrate portion of the developer bearing member, or may be different by a predetermined amount therefrom. This is for allowing electrical charge to be smoothly (efficiently) transferred to the developer, and also, for ensuring that the developer bearing member will be coated with a developer layer which is uniform in thickness and electrical charge.

The pressure between the image bearing member and the developer carrying member is preferably 50–3000 N/m (drawing pressure).

In this embodiment, the drawing pressure is a pressure value corresponding to a line pressure and is a force per 1 m required to draw a SUS (stainless steel) plate of 30 μm thick sandwiched between two SUS plates each having a thickness of 30 μm, the SUS plate being sandwiched between the objects which are contacted to each other (between the image bearing member and the developer carrying member, here).

If the drawing pressure is not less than 3000 N/m, remarkable scraping of the surface of the image bearing member and/or deterioration of the developer, and therefore, image defects result. If it is not more than 50 N/m, the size of the developing zone is not sufficient, with the result that transition of the developer from the developer carrying member onto the image bearing member is not sufficient, and therefore, image defects result.

(4-2) Peripheral Speeds of the Image Bearing Member: and the Developer Carrying Member The circumference speed ratio provided by the rotation between the image bearing member and the developer carrying member is preferably 1:0.5–3.0. If the circumference speed ratio of the developer carrying member to the image bearing member is not more than 0.5, the absolute amount of the developer transferred onto the image bearing member from the developer carrying member is not enough with the result of insufficient density of a solid black image. If it is not less than 3.0, the deterioration of the developer is remarkable.

(4-3) Contact Type Developing System:

In the contact type developing system, there are a magnetic contact type developing system using magnetic toner as the developer, and a non-magnetic contact type developing system using non-magnetic toner as the developer. The magnetic contact type developing system is preferable.

This is because the developer can be fed by a magnetic force as contrasted to the non-magnetic one component developer, and therefore, the possible developer scattering can be prevented by using a magnetic force in addition to a physical suppression.

The magnetic developer contains magnetic material, and the resistance is lower than the non-magnetic developer, and therefore, the retaining power of the electric charge. For this reason, there is less possibility of occurrences of local non-uniformity in the quantities of electricity.

(4-3-1) Magnetic Contact Type Developing System:

The magnetic contact type developing system will be described.

a: Developer for magnetic contact development:

The developer for the magnetic contact development comprises as a major component insulative toner, and preferably, it is externally added with silica fine particles. The silica fine particles are effected to raise the image density, and the produced image has less roughness, by controlling the triboelectric charge of the toner. For example, is it known that toner is added with vapor phase silica (dry type silica) and/or wet type silica. The externally added material may be fine particles of electroconductive oxide, metal, resin material or the like, although the material is not limited to these examples.

The base material of the developer may be styrene-acrylic, polyester or combination resin material of these resin materials.

b: Magnetic One Component Developer:

It is preferable that 30–150 parts-by-weight of the magnetic particle on the basis of 100 parts-by-weight of the resume material. The magnetic particle may be magnetic metal oxide (magnetite, wustite or the like). From the standpoint of sufficient magnetic force for the feeding over the toner and sufficiently high resistance for charging, the magnetite which has a high resistance is preferable, but the material is not limited to that.

If the content of the magnetic particle is not more than 30 parts-by-weight, the toner is not sufficiently deposited on the developer carrying member, and if it is not less than 150 parts-by-weight, the electroconductivity of the developer is so high that charging of the toner is not enough, or when a magnetic generating means in the developer carrying member, the depositing force to the developer carrying member is so strong that toner is unable to be transferred onto the image bearing member.

c: Regulating Member:

The elastic material of the regulating member functioning to regulate an amount of the developer applied on the developer carrying member may be SUS, phosphor bronze or another metal, or urethane or the like resin material, but the material is not limited to such examples. When the use is made with the metal such as SUS, phosphor bronze or the like as the regulating member, the charging property to the developer is high, and the change in the electric resistance or volume expansion relatively to the temperature and/or humidity change are smaller than the resin material, and therefore, the charging property is stable. For these reasons, a regulating member of metal is preferable.

The configuration of the regulating member may be a plate of elastic metal or elastic rubber, and the free end of the plate may be curved or bent, and the surface thereof may be coated with resin material, or the surface thereof may have a particular configuration. However, these examples are not limiting, and other configurations are usable.

The potential of the regulating member and the potential of the base layer portion of the developer carrying member may be electrically the same or different by a predetermined degree. By doing so, the application of the electronic charge to the developer is smooth and efficient, so that developer applied on the developer carrying member may have more uniform thickness and charge.

The drawing pressure between the developer carrying member and the regulating member is preferably 50–150 N/m.

If it is not more than 50 N/m, the regulation and the charging are not enough, and if it is not less than 150 N/m, the scraping of the image bearing member is remarkable, and also resulting in remarkable deterioration of the developer.

The drawing pressure between the developer carrying member and the regulating member is defined in the same manner as between the image bearing member and the developer carrying member.

d: Developer Supplying Means:

The means for supplying the developer to the surface of the developer carrying member, the gravity, a physical force, an electric force, a magnetic force or at least two of them are usable.

Examples of the physical force include using paddle means, stirring means or the like.

The magnetic supplying means includes a developer carrying member and magnetic field generating means disposed therein to provide a feeding for the magnetic developer.

The use of the magnetic supplying means is preferable since then the physical rubbing and the deterioration of the developer can be suppressed.

In order to stabilize, the use of fixed (not rotating) magnetic field generating means since then the magnetic force is constant.

e: Fixed Magnetic Field Generating Means:

The non-rotatable fixed magnetic field generating means provided inside the developer carrying member may be a permanent magnet, an electromagnet using electromagnetic induction or the like is preferable, although doing so is not limiting. The maximum value of the intensity of the magnetic flux density in the direction perpendicular to the surface of the developer carrying member is preferably approximately 200–1500 G, and further preferably 500–900 G.

The magnetic flux density has been measured, in this embodiment, using Gauss meter, series 9900 with probe A-99–153, available from Bell. The Gauss meter has an axial probe in the form of a rod connected to the main assembly of the Gauss meter.

Figure 3:
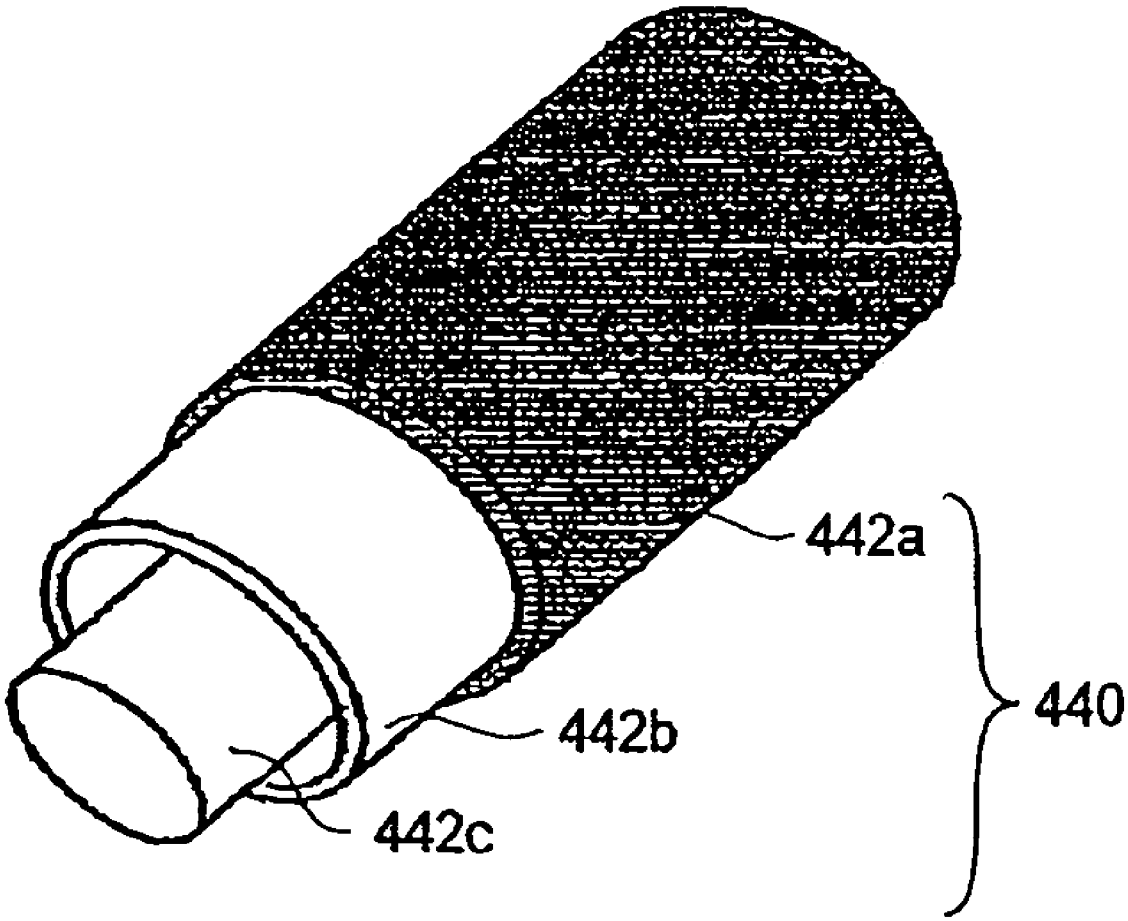
FIG. 3 is a drawing of the elastic development sleeve in the first version of the image forming apparatus in the first embodiment, showing the general structure thereof.

The description will be made as to a measuring method of the magnetic flux density of the elastic developing sleeve 440 (442*b*+442*a*) (developer carrying member) shown in FIG. 3, according to this embodiment. The developing sleeve 440 is fixed in a horizontal position, and the magnet roller 442*c* is set rotatable. To the developing sleeve 440 the probe taking a horizontal attitude is perpendicularly disposed with a small gap, and the center of the developing sleeve 440 and the center of the probe are placed in the same horizontal plane. They are placed at such fixed positions, and the magnetic flux density is measured. The magnet roller 442*c* and the developing sleeve 440 are substantially concentric, and therefore, it is considered that clearance between the developing sleeve 440 and the magnet roller 442*c* are constant irrespective of the peripheral positions on the magnet roller 442*c*. In view of this, by measuring the magnetic flux density on the surface and in the normal line direction on the surface of the developing sleeve 440, while rotating the magnet roller 442*c*, the measurement covers all the positions in the circumferential direction of the developing sleeve 440. From the obtained magnetic flux density data in the peripheral directions, the peak strengths at each of the positions has been determined.

If it is not more than 200 G, the printing of the image is not sufficient during high print ratio printing operation, resulting in density variation or white void, and in addition, in the case of a cleanerless development system, the paper dust is fed and supplied together with toner, resulting in image defect. If it is not less than 1500 G, the magnetic force is so strong at the developing zone where the developer on the developer carrying member is pressed by the image bearing member that developer is unable to be transferred onto the image bearing member.

f: Developer Carrying Member:

The developer carrying member may comprise a base layer of rigid material enclosing a magnetic field generating means, and an elastic layer thereon (elastic developing sleeve, or the like).

g: Elastic Developing Sleeve Base Layer:

The base layer as the electroconductive developing sleeve may preferably be made of non-magnetic material such as aluminum, SUS or the like or another metal, metal oxide or the like. However, these examples of material are not limiting, and other materials are usable.

h: Elastic Layer:

The elastic layer provided on the surface of the developer carrying member comprises an insulative elastic layer and an electroconductive member formed thereon, or an electroconductive elastic layer is formed, or two or more elastic electroconductive layers of different resistances, or the like.

i: Elastic Layer Hardness:

A microhardness of the elastic layer provided on the surface of the developer carrying member is preferably 40–98°.

In this embodiment, the surface hardness has been measured using a microhardness meter Asker MD-1F360A, available from Kobunshi Kabushiki Kaisha, Japan.

If the microhardness is not more than 40, the scraping and damage of the surface of the elastic layer is extremely remarkable due to the sliding contact with the regulating member, the image bearing member and the like, and therefore, image defects result. For this reason, it is preferably not less than 40. If, however, it exceeds 98, the scraping and/or damage of the image bearing member occurs due to the sliding contact with the image bearing member resulting in image defects. Therefore, it is preferably not more than 98.

j: Electroconductive Elastic Layer Material:

The material of the electroconductive elastic layer provided on the surface of the developer carrying member may be a rubber material such as EPDM, urethane, NBR, silicone rubber, hydrin rubber, IR or the like, in which an electroconductive material such as carbon black, metal oxide or the like is dispersed for resistance adjustment k: Resistance of Electroconductive Elastic Layer:

The resistance value of the electroconductive elastic layer provided on the surface of the developer carrying member is preferably $10^2$–$10^8$ Ωcm. If it is not more than $10^2$ Ωcm, electrical leakage occurs, or the surface potential lowers more than expected with the result of image defect (fog) by which the toner is transferred onto the non-printing portion. If it is not less than $10^8$ Ωcm, an effective bias level of the developing bias is so low that the density decrease or the fog occurs.

In the employed measuring method, an electroconductive elastic layer is formed on the sleeve base layer, and in this state, a weight of 300 g is imparted at the opposite ends of the sleeve base layer. A bare tube of aluminum having a diameter which is the same as that of the image bearing member is contacted thereto, and then, the aluminum bare tube is rotated, by which the elastic sleeve is driven by the aluminum bare tube. A voltage of −400 V is applied between the core metal and the aluminum bare tube, and the current flowing through the aluminum bare tube is measured as a current flowing through the electroconductive elastic layer.

The resistance value of the electroconductive elastic layer is determined from the voltage applied to the sleeve base layer and the current through the aluminum bare tube.

l: Electroconductive Elastic Layer of the Elastic Developing Sleeve:

The thickness of the electroconductive elastic layer as the electroconductive developing sleeve is preferably not more than 50–2000 μm. If it is not more than 50 μm, the surface of the image bearing member is scraped and/or damaged with the result of image defect, and therefore, it is preferably not less than 50 μm. If it is not less than 2000 μm, the magnetic force applied to the surface of the image bearing member from the fixed magnetic field generating device disposed therein is so small that the amount of the developer supplied is not enough to provide satisfactory images. Therefore, it is preferably not more than 2000 μm.

(4-3-2) Non-magnetic Contact Type Developing System:

The non-magnetic contact type developing system will be described.

a: Developer for Non-magnetic Development:

The developer comprises as a major component insulative toner, and is preferably added by a small amount of silica fine particles. The silica fine particles are effected to raise the image density, and the produced image has less roughness, by controlling the triboelectric charge of the toner. For example, it is known that toner is added with vapor phase silica (dry type silica) and/or wet type silica. The externally added material may be fine particles of electroconductive oxide, metal, resin material or the like, although the material is not limited to these examples.

The base material of the developer may be styrene-acrylic, polyester or combination resin material of these resin materials.

b: Regulating Member:

The regulating member may be made of elastic material. The elastic member may be made of SUS, phosphor bronze or other metals, or resin material such as urethane or the like, but these examples are not limiting, and other materials are usable. When the use is made with the metal such as SUS, phosphor bronze or the like as the regulating member, the charging property to the developer is high, and the change in the electric resistance or volume expansion relatively to the temperature and/or humidity change are smaller than the resin material, and therefore, the charging property is stable. For these reasons, regulating member of metal is preferable.

The configuration of the regulating member may be a plate of elastic metal or elastic rubber, and the free end of the plate may be curved or bent, and the surface thereof may be coated with resin material, or the surface thereof may have a particular configuration. However, these examples are not limiting, and other configurations are usable.

The potential of the regulating member and the potential of the base layer portion of the developer carrying-member may be electrically the same or different by a predetermined degree. By doing so, the application of the electronic charge to the developer is smooth and efficient, so that developer applied on the developer carrying member may have more uniform thickness and charge.

The line pressure by this developer carrying member and the regulating member is preferably 50–150 N/m. If it is not more than 50 N/m, the regulation and the charging are not enough, and if it is not less than 150 N/m, the scraping of the image bearing member is remarkable, and also resulting in remarkable deterioration of the developer.

c: Developer Supplying Means:

The means for supplying the developer to the surface of the developer carrying member, the gravity, a physical force, an electric force, a magnetic force or at least two of them are usable.

Examples of the physical force include using paddle means, stirring means or the like.

In order to provide a sponge, a sponge roller is set to rotate in the counter directional peripheral movements between the surface of the developing roller, so that rubbing therebetween generates electric charge on the developer, by which the developer is supplied to the developing roller.

d: Developer Carrying Member:

The developer carrying member may be a rotatable developing roller including a core metal and an elastic layer thereon, but such a structure is not limiting.

e: Elastic Layer:

The elastic layer an insulative elastic layer and an electroconductive member formed thereon, or an electroconductive elastic layer is formed, or two or more elastic electroconductive layers of different resistances, or the like. The thickness of the elastic layer is preferably 1.0–5.0 mm.

f: Elastic Layer Hardness:

The hardness of the elastic layer is preferably 30–98° in ASKER C (500 g). If it is not more than 30, the scraping and/or denting of the surface thereof is remarkable due to the sliding contact with the regulating member, the image bearing member or the like, which may result in image defects. If it is not less than 98, the scraping and/or damage of the surface of the image bearing member is produced by the sliding contact with the image bearing member, resulting in image defects g: Electroconductive Elastic Layer Material:

The material of the electroconductive elastic layer may be a rubber material such as EPDM, urethane, NBR, silicone rubber, hydrin rubber, IR or the like, in which an electroconductive material such as carbon black, metal oxide or the like is dispersed for resistance adjustment.

h: Resistance of Electroconductive Elastic Layer:

The resistance value of the electroconductive elastic layer is preferably $10^2$–$10^8$ Ωcm. If it is not more than $10^2$ Ωcm, electrical leakage occurs, or the surface potential lowers more than expected with the result of image defect (fog) by which the toner is transferred onto the non-printing portion. If it is not less than $10^8$ Ωcm, an effective bias level of the developing bias is so low that the density decrease or the fog occurs.

In the employed measuring method, an electroconductive elastic layer is formed on the core metal, and in this state, a weight of 300 g is imparted at the opposite ends of the core metal. A bare tube of aluminum having a diameter which is the same as that of the image bearing member is contacted thereto, and then, the aluminum bare tube is rotated, by which the elastic roller is driven by the aluminum bare tube. A voltage of −400 V is applied between the core metal and the aluminum bare tube, and the current flowing through the aluminum bare tube is measured as a current flowing through the electroconductive elastic layer.

The resistance value of the electroconductive elastic layer is determined from the voltage applied to the core metal and the current through the aluminum bare tube.

(5) Scheme 1 of Image Forming Apparatus (Using a Drum Cleaner):

FIG. 1 is a schematic illustration of an image forming apparatus according to an embodiment of the present invention, which uses means (drum cleaner) for cleaning the drum by removing the toner remaining on the surface of the image carrying drum. The image forming apparatus is a laser beam printer using a contact image transfer type electrophotographic process.

Designated by 1 is an image bearing member, and in this embodiment, is a rotatable photosensitive member (negatively chargeable photosensitive member) including a negative OPC photosensitive layer. The photosensitive drum 1 is rotational driven at a constant speed in the clockwise direction indicated by an arrow at a peripheral speed of 85 mm/sec (=process speed PS or printing speed).

Designated by 2 is a charging roller functioning as charging means. The charging roller 2 is an electroconductive elastic roller and is press-contacted to the photosensitive drum 1 with a predetermined urging force. In this embodiment, the charging roller 2 is rotationally driven by the rotation of the photosensitive drum 1.

Designated by S1 is a charging voltage source for applying a charging bias to the charging roller 2.

In this embodiment, a DC voltage higher than a discharge starting voltage at the contact portion therebetween is applied to the charging roller 2, from the charging roller 2. The charging bias is a DC voltage of −1300V, and functions to electrically charge (contact charging) the surface of the photosensitive drum 1 to a uniform potential (dark portion potential).

Designated by 3 is a laser beam scanner (exposure device) including a laser diode, a polygonal mirror and the like. The laser beam scanner 3 produces a laser beam modulated in intensity corresponding to time series electrical digital pixel signals indicative of the intended image information, and the laser beam line scans the surface of the rotatable photosensitive drum 1 having been uniformly charged. The laser power is adjusted such that when the laser beam is applied to the whole surface of the uniformly charged surface of the photosensitive drum 1, the potential of the surface of the photosensitive drum is −150V.

By the scanning exposure, an electrostatic latent image is formed corresponding to the intended image information is formed on the surface of the rotatable photosensitive drum 1.

Designated by 400 is a developing device (developing device). The toner 410 (t) is triboelectrically charged to a predetermined level, and is applied on the surface of the developer carrying member (developer carrying member) 440. The developer carrying member 440 is contacted to the photosensitive drum 1 with a predetermined pressure. A developing bias is applied between the photosensitive drum 1 and the developer carrying member 440 from the developing bias applying voltage source S2, by which the electrostatic latent image on the photosensitive drum 1 is visually imaged (reverse development) in the developing zone a.

Designated by 5 is an intermediate resistance transfer roller (contact transfer means), which is press-contacted to the photosensitive drum 1 with a predetermined pressure to form a transfer nip b. A transfer material P (recording material) is supplied at a predetermined into the transfer nip b from an unshown sheet feeder, while the transfer roller 5 is supplied with a predetermined image transfer bias voltage from the transfer bias application voltage source S3, by which the toner image is sequentially transferred from the photosensitive drum 1 onto a surface of the transfer material P supplied into the transfer nip b.

The transfer roller 5 used in this embodiment comprises a core metal 5*b* and an intermediate resistance foam layer 5*a*, wherein a roller resistance value is $5\times10^8$ Ω. The transfer roller 5 is supplied with a voltage of +2.0 kV at the core metal 5*b* during the transfer operation. The transfer material P introduced into the transfer nip b is fed through the transfer nip b, during which the toner image is sequentially transferred from the surface of the rotatable photosensitive drum 1 onto the surface of the side by an electrostatic force and an urging force.

Designated by 6 is a fixing device of a heat fixing type or the like. The transfer material P now having the toner image transferred from the photosensitive drum 1 at the transfer nip b, is separated from the surface of the rotatable photosensitive drum 1 and is then introduced into the fixing device 6, where it is subjected to fixing operation and then discharged to an outside of the apparatus as a print or copy.

Designated by 7 is a photosensitive drum cleaning device (drum cleaner) for removing the toner not transferred and remaining on the photosensitive drum 1. The photosensitive drum cleaning device includes a cleaning blade 7*a* for scraping the toner off the drum and for feeding it into a residual toner container 7*b*.

The photosensitive drum 1 is electrically charged by the charging device 2, again, and is repeatedly used for the image formation.

Designated by 9 is a process cartridge containing as a unit the photosensitive drum 1, the charging roller 2, the developing device 400 and the drum cleaner 7, and is detachably mountable to a main assembly of the image forming apparatus.

Embodiment 1:

(Contact Development+Weak AC+Magnetic Toner+Elastic Developing Sleeve).

Figure 2:
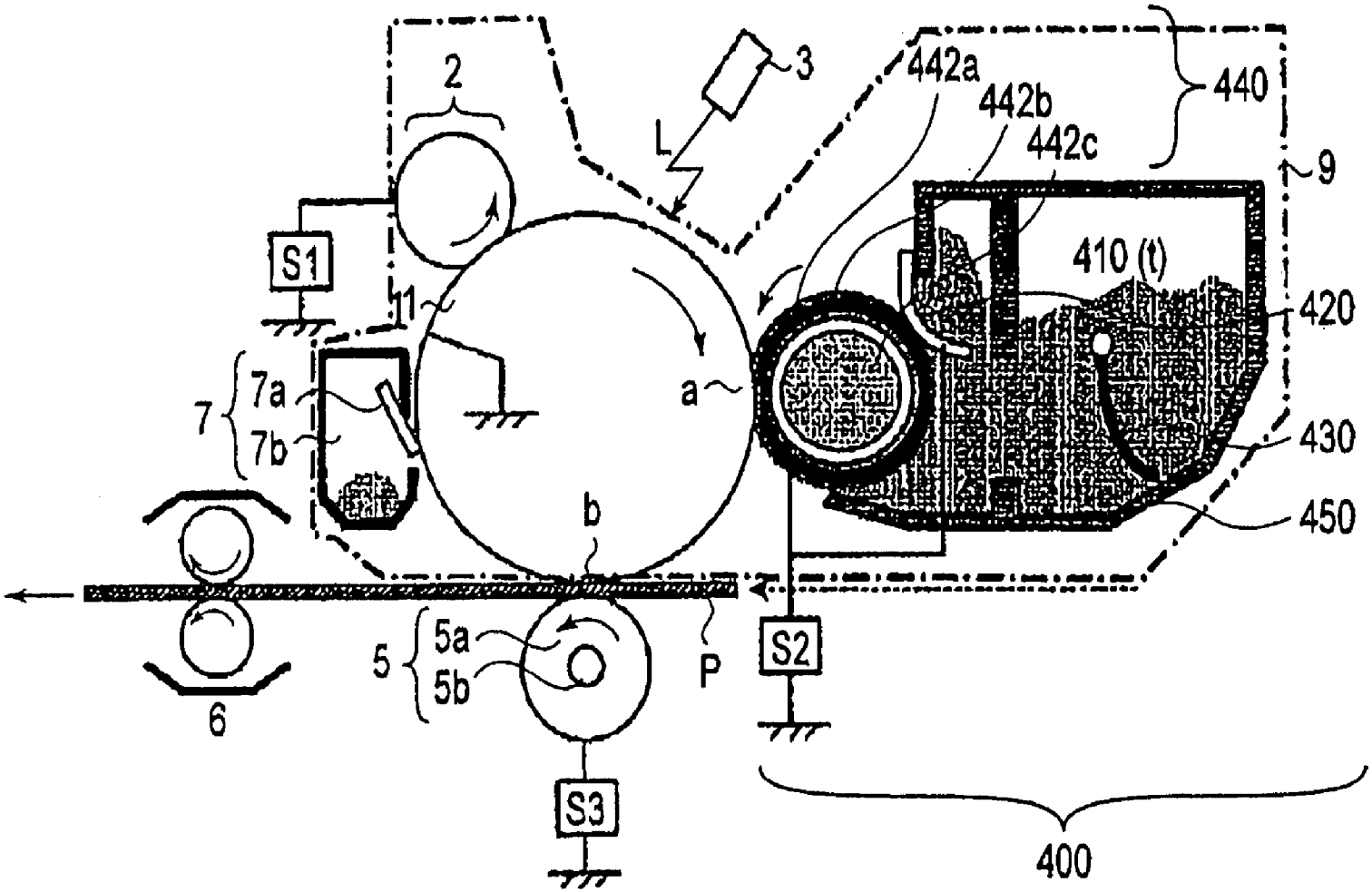
FIG. 2 is schematic drawing of the first version of the image forming apparatus in the first embodiment, showing the general structure thereof.

FIG. 2 shows an image forming apparatus employing a developing device of a contact type developing system using a magnetic one component developer, in scheme 1 (having a drum cleaner 7).

The developing device 400 of this embodiment will be described. In the developing device 400, designated by 440 is a rotation elastic developing sleeve (developer carrying member). In the developing sleeve 440, a magnet roller 442*c* (fixed magnetic field generating means) is disposed. As shown in FIG. 2 and FIG. 3, the developing sleeve 440 comprises a base layer (aluminum cylinder (rigid member sleeve)) 442*b*, and a non-magnetic elastic layer 442*a* on the outer surface of the aluminum cylinder. It is contacted to the photosensitive drum 1 at a predetermined pressure (drawing pressure 200 N/m). An elastic layer material is kneaded and is extruded into an elastic layer, which is bonded on the aluminum cylinder into 500 μm thick, and then the elastic layer is abraded. The resistance of the elastic layer 442*a* provided on the aluminum cylinder 442*b* is 2.0×1050.

The surface roughness has been measured using a surfcorder SE3400, available from KOSAKA KENKYUSHO Kabushiki Kaisha, Japan, with contact detecting unit PU-DJ2S under the condition of the measurement length of 2.5 mm, the perpendicular direction magnification of 2000, the horizontal direction magnification of 100, the cut-off level of 0.8 mm and the filter setting of 2CR, and the leveling setting of front data.

The used toner t is one component magnetic toner the and is produced by mixing and kneading binder resin, magnetic particle and charge control material through a pulverization and classification. It contains externally added material for fluidization (pulverization method). The developer contains the same weights of the magnetic particles and the binder resin to provide magnetic particles which can be conveyed by sufficiently strong magnetic force.

In this embodiment, the amount of magnetization σ of the magnetic toner t is 30 $Am^2/kg$. The amount of magnetization of the magnetic toner is measured under 1K oersted magnetic field, using vibration type magnetometer VSM-3S-15, available from Toei Kogyo. The average particle size (D4) of the toner is 8 μm.

In the process of being carried on the rotation in elastic developing sleeve 440 having the elastic layer 442*a* under the influence of the magnetic force from the magnet roller 442*c*, the toner t is subjected to a layer thickness regulation of the regulating blade 420 (developer amount regulating member) for regulating the amount of the developer on the developing sleeve, and is also subjected to triboelectric charging. Designated by 430 is a stirring member for circulating the toner in the developing container 450 and feeding the toner sequentially into magnetic force reaching ranges around the surface of the sleeve.

The blade 420 functioning as the regulating member is made of phosphor bronze, and the pressure between the elastic developing sleeve 440 and the blade 420 is 55 N/m (drawing pressure), and the length of the free part of the blade is 0.5 mm.

The length of the free part on the blade is a length from the contact portion of the regulating blade to the free end thereof.

A fixed magnet roller 442*c* is a fixed magnet functioning as magnetic field generating means for generating magnetic forces at the predetermined positions on the developing sleeve 440. It generates a magnetic flux density having a peak density of 700 G (absolute value) at each of the positions of a developing zone a, a feeding portion, a supply portion and a collecting portion. More particularly, the peak densities of the magnetic poles are generated at the positions of the developing zone, the collecting portion, the supply portion, the feeding portion and the developing zone in the order named. The toner carried to the developing zone is used for development at the developing zone, and the toner not consumed in the developing zone is collected back into the developing container by a collecting portion disposed downstream of the developing zone. In the collecting portion, means is provided to prevent blowing of the toner from the inside of the developing device.

In this manner, the toner reaching the collecting portion is fed to the supply portion disposed downstream of the collecting portion in the developing container with respect to the developer carrying direction. In the supply portion, the toner having reached the collecting portion is mixed with the supplied toner, and is carried to a feeding portion disposed downstream of the supply portion, and is again fed to the developing zone, thus accomplishing continuous toner supply to the developing zone.

The toner t applied on the elastic developing sleeve 440 having the elastic layer 442*a* is fed by rotation of the developing sleeve 440 into a developing zone (developing zone portion) a where the developing sleeve 440 is opposed to the photosensitive drum 1 (opposing portion). The aluminum cylinder 442*b* (base layer, (rigid member sleeve)) of the developing sleeve 440 is supplied with a developing bias voltage from the developing bias applying voltage source S2. The developing sleeve 440 and the regulating blade 420 are electrically connected. The elastic developing sleeve 440 is driven at a peripheral speed which is 1.2 times the peripheral speed of the photosensitive drum 1.

In this embodiment, the developing bias voltage comprises a DC voltage of −400V, and an AC voltage (rectangular wave) having a peak-to-peak voltage (Vpp) of 300V and a frequency of 1.2 kHz, so that electrostatic latent image on the photosensitive drum 1 is developed (reverse development) with toner t. Here, the maximum value of the absolute value of the developing bias voltage is 550V, which is DC voltage of −400V plus one half (150V) of peak-to-peak voltage, and the absolute value of the dark potential of the photosensitive drum is set not more than 700V.

a: Relation Between Fog Amount and Developing Bias Voltage:

The investigations have been made as to the relation between the developing bias voltage and the fog amount.

Evaluation of fog prevention: The fog means an image defect of background contamination caused by a small amount of toner deposited on a white portion (un-exposed portion) where the toner is not supposed to deposit by development.

An image forming operation is stopped in the process of printing a solid white image. The fog amount can be detected by measuring reflectance of the photosensitive drum after the development.

The amount of fog is measured in this manner. The optical reflectance of the white portion is measured by an optical reflectance measuring machine TC-6DS available from Tokyo Denshoku using a green filter, and the difference of the measurement from the reflectance obtained when a plain paper is measured, is used as the reflectance of the fog.

The toner on the drum is transferred on a transparent tape, which in turn is stuck on a plain paper, and the reflectance of the toner is measured in the same manner as with the fog measurement, and the measurement is deducted by a measurement of the reflectance from a fresh transparent tape without the toner, and is taken as the fog amount on the toner.

The investigation has been made as to a relation between the setting of the developing bias voltage and the fog amount on the drum.

i) the DC value of the developing bias is fixed at −400V, and the peak-to-peak of the AC voltage is changed, and the fog amount is measured.

ii) the DC value of the developing bias is fixed at −500V, and the peak-to-peak of the AC voltage is changed, and the fog amount is measured.

iii) the peak-to-peak of the AC voltage is fixed at 300V, and the DC voltage of the developing bias is changed, and the fog amount is measured.

Figure 4:
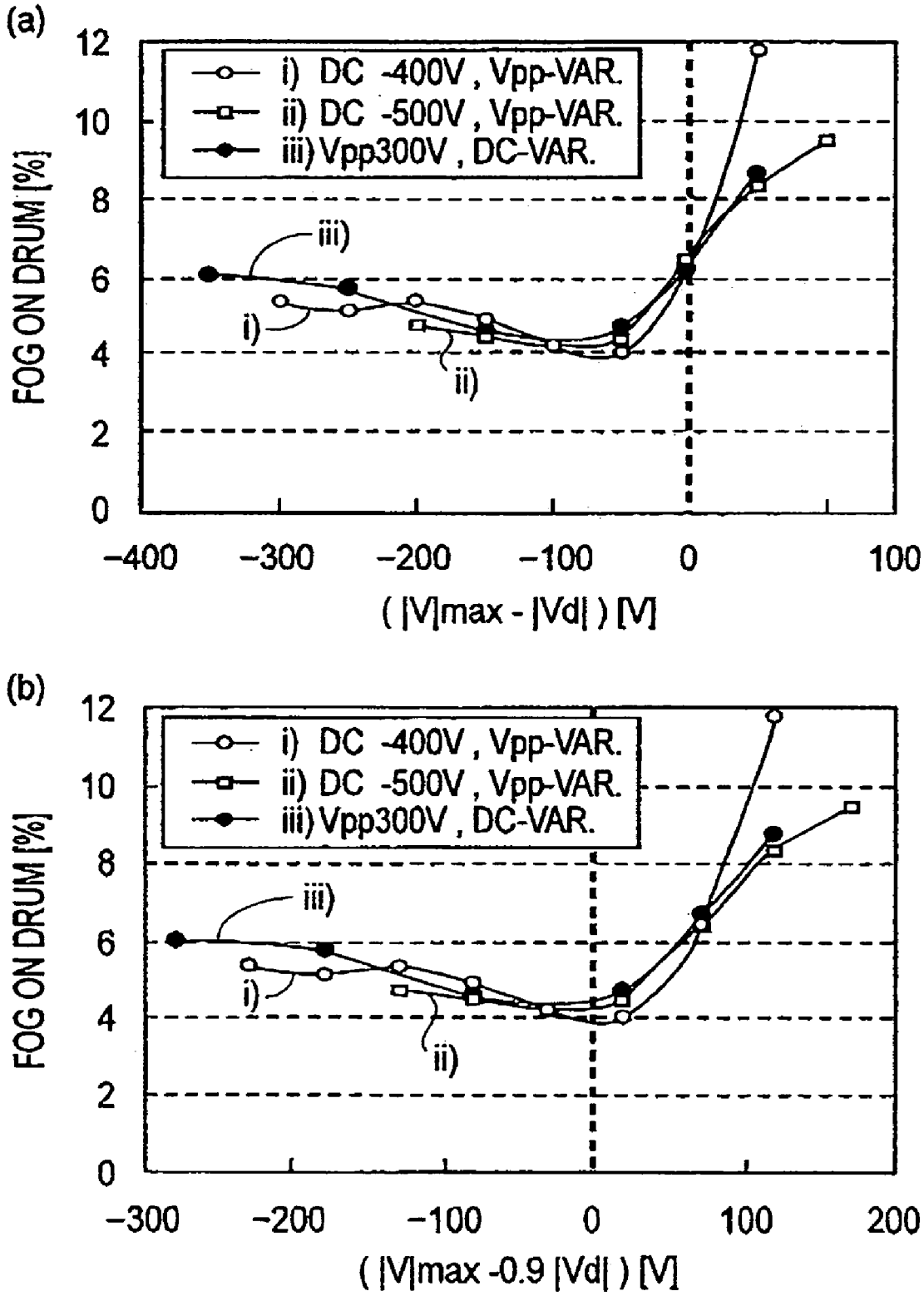
FIG. 4 is a graph showing the relationship between the amount of the fog and the development bias in the first version of the image forming apparatus in the first embodiment.

FIG. 4 shows the results.

The abscissa of (a) of FIG. 4 represents a difference of the maximum value of the absolute value of the developing bias from the absolute value of the dark potential (|V|max−|Vd|) (V), and the ordinate represents a fog amount on the drum. In FIG. 4, the positive value of the abscissa means that |V|max exceeds |Vd|(|V|max>|Vd|), and the negative value of the abscissa means that |V|max is smaller than |Vd| (|V|max<|Vd|), and zero of the abscissa means that |V|max and |Vd| are equal to each other (|V|max=|Vd|) The dark potential is potential of the portion not exposed, and the potential of a high potential portion of the electrostatic latent image having the high potential portion and a low potential portion.

As will be understood from (a) of FIG. 4, if |V|max exceeds |Vd|, the fog amount remarkably increases.

The causes thereof are now considered. In the image forming apparatus of this embodiment, the polarity of the toner is negative, and therefore, the electrical force received by the toner is always directed toward the positive side, and therefore, the toner tends to move in this direction. Therefore, in the printing area, the photosensitive drum surface potential is set such that it exceeds the DC value of the developing bias, and in the non-printing area, it is set to be lower than the DC value of the developing bias. This applies to the present invention, too, and therefore, the potential Vd of the non-image region is −700V, and the DC value Vdc of the developing bias is −400V.

Figure 5:
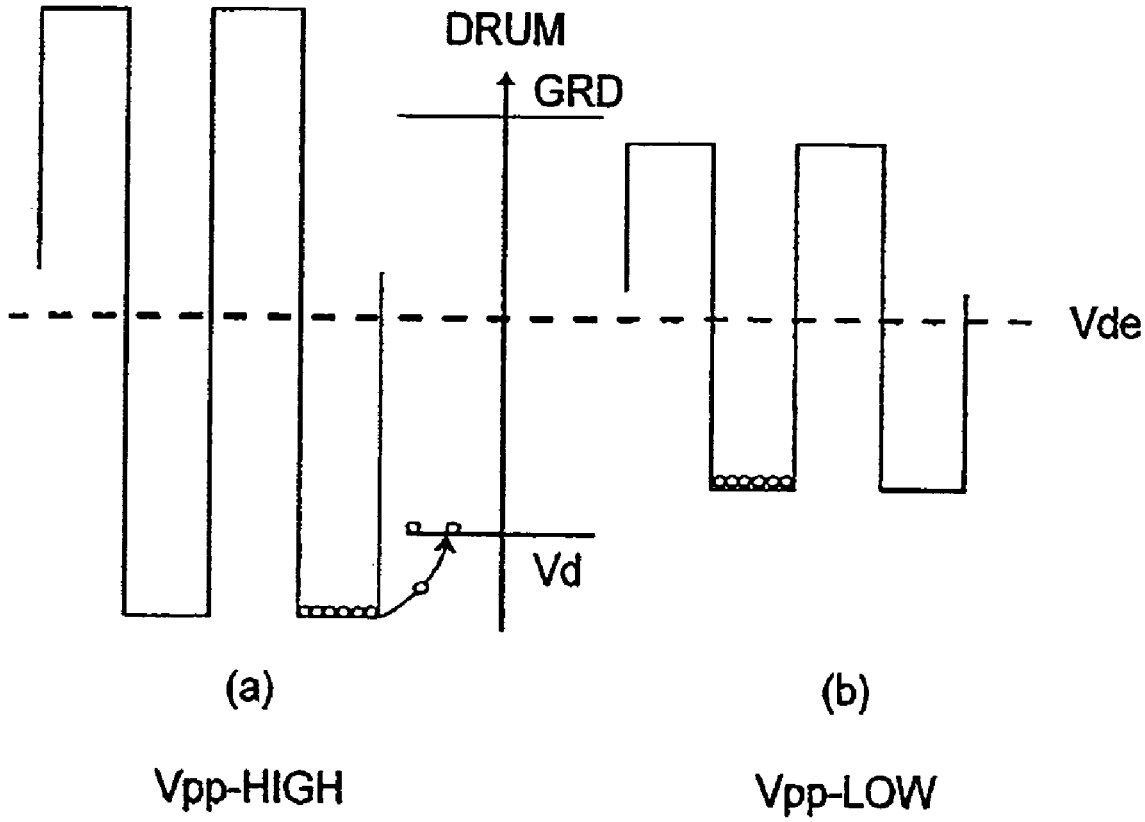
FIG. 5 is a drawing for describing the mechanism of the fog formation.

FIG. 5 shows the drum surface potential Vd in the non-printing area and the grounding (GRAND) level, and it also shows situations (a) where the peak-to-peak of the AC value of the developing bias is so high that |V|max exceeds |Vd|, and (b) where the peak-to-peak of the AC voltage is so low that |V|max does not exceed |Vd|.

In the case of (a), in FIG. 5, where the |V|max exceeds |Vd|, the developing bias may temporarily be lower than Vd, in which case the toner transfers to the non-printing area.

On the other hand, when |V|max does not exceed |Vd|, that is, in the case of (b) in FIG. 5, the developing bias is always higher than Vd, and therefore, the toner does not transfer to the non-printing area. This would be the reason when the fog amount is remarkably high in the region of |V|max>|Vd|, as in (a) of FIG. 4.

From the foregoing, it is remarkably effective to limit the absolute value |V|max of the developing bias so as not to exceed |Vd| in terms of suppression of the fog amount. Thus, the structure of this embodiment is remarkably effective to suppression of the fog amount.

From the foregoing, it is remarkably effective to limit the absolute value |V|max of the developing bias so as not to exceed |Vd| in terms of suppression of the fog amount. Thus, the structure of this embodiment is remarkably effect to suppression of the fog amount.

In FIG. 4, (b) shows the fog amount vs. a difference of 90% of the absolute value of the dark potential from the maximum value of the absolute value of the developing bias (|V|max−0.9×|Vd|)(V). As will be understood, the fog amount is remarkably small in the neighborhood of 0V (abscissa) Thus, by selecting the bias satisfying |V|max≦0.9×|Vd|, the fog amount can be remarkably reduced. With such range, even when the charging property is deteriorated by variations in the ambience, the deterioration of the charging roller and/or the deterioration of the photosensitive drum, the fog amount can be remarkably reduced.

From the foregoing, in this embodiment, by satisfying the |V|max≦0.9×|Vd|, the fog amount can be stably reduced irrespective of variations in the charging property.

b: Relation between the Photosensitive Drum 1 and the Elastic Developing Sleeve 440:

In order to investigate contact condition between the photosensitive drum 1 and the elastic developing sleeve 440, the apparatus is set such that only the toner layer is lightly contacted to the photosensitive drum 1, and a comparison is made with this embodiment. More particularly, the elastic developing sleeve 440 is faced to the photosensitive drum 1 with a space of 80 μm therebetween, and the toner on the elastic developing sleeve 440 is regulated by the regulating member 420 to provide a layer thickness of 80 μm.

c: Uniformity of Thin Lateral and Longitudinal Lines:

The image evaluation has been made on the basis of continuity of one dot lateral and horizontal lines. The scanner machine used in the tests is a 600 dpi laser scanner. One dot line extending parallel to the process advancing direction and 1 dot line extending parallel to the main scan direction of the laser scanning system, and the variations are carried out for both of them. Such hair line image having a length of 2 cm is printed in each of the examples, and 100 lines are selected at random. An area of 200 μm square with one line at the center thereof, for each of the 100 points, is observed by an optical microscope. For each of the lines, a half-peak width of the density of the line is determined as the line width of the line. A standard deviation of the line widths is calculated for each direction. A line standard deviation ratio σv/σh is obtained from the calculated line standard deviation σv for the process direction, and the calculated laser scanning direction standard deviation σh. Using the value thus obtained, the following evaluation is carried out:

It is 1.05 when the developing sleeve is press-contacted to the photosensitive drum, and is 1.34 when only the toner layer is lightly contacted to the photosensitive drum. In the latter case, the uniformity of the fine lateral and longitudinal lines lowers.

This will further be considered. When only the toner layer is contacted, chains of the toner erect in the developing zone. The toner is transferred onto the drum under the existence of the erected toner chains, tailing occurs, and therefore, the uniformity of the width of the lateral and longitudinal lines worsens.

From the foregoing, this embodiment wherein the elastic developing sleeve 440 is press-contacted to the photosensitive drum 1, is effective to uniformize the widths of the longitudinal and lateral lines.

d: Variation of Contact during Operation for a Large Number of Prints:

An image of a lateral line with print ratio of 5% is continuously printed on 3000 sheets, and thereafter, an evaluation has been made as to the density difference in a halftone image. The scanner machine used in the tests is a 600 dpi laser scanner.

In the tests, the halftone image is represented by an image comprising 1 line extending in the main scan direction and subsequent non-printed 2 lines. The image thus provided, as a total, represents a half-tone image.

The density of the half-tone is measured at 50 points using a reflection density meter (Macbeth SERIES 1200 Color Checker), and a difference of the maximum density and the minimum density is obtained.

When the developing sleeve is press-contacted to the photosensitive drum, the difference is 0.11, and the halftone image is uniform. When only the toner layer is lightly contacted to the photosensitive drum, it is 0.42, which means that density difference is large, and the image defect of density non-uniformity results. The density non-uniformity worsens under a high temperature and high humidity ambience or under a low temperature and low humidity ambience.

This will further be considered. The clearance between the photosensitive drum and the elastic sleeve is as small as 80 μm, and it is difficult to stably retain the gap throughout the large number of printing operations. The change in the gap would be the cause of the production of the density non-uniformity. In addition, it is also difficult to stably retain the 80 μm thickness of the toner layer, and the variation in the toner layer would be an additional cause. Under the high temperature and high humidity ambience and low temperature and low humidity ambience, the variations in the size of the gap and the toner layer thickness are larger, so that situation further worsens.

The use of DC voltage superimposed with the AC voltage is advantageous in the improvement in the image quality. However, when only the toner layer is lightly contacted to the drum, the distance between the developing sleeve and the photosensitive drum is larger, and therefore, the improvement in the image quality is not as expected. This would further increase the density non-uniformity.

From the foregoing, in this embodiment, by the press-contact between the photosensitive drum 1 and the elastic developing sleeve 440, the contact condition is stabilized (no gap variation due to numerousness of large number printing or due to the variation in the ambient conditions), and the image quality is satisfactory even if the toner layer varies. The image quality is improved by the AC voltage component in the developing bias.

Modification of Embodiment 1:

(Contact Development+Weak AC+Non-magnetic Toner+Elastic Developing Roller).

This is a modification of Embodiment 1 (FIG. 6), and uses a non-magnetic one component contact type developing system with use of a drum cleaner 7.

Figure 6:
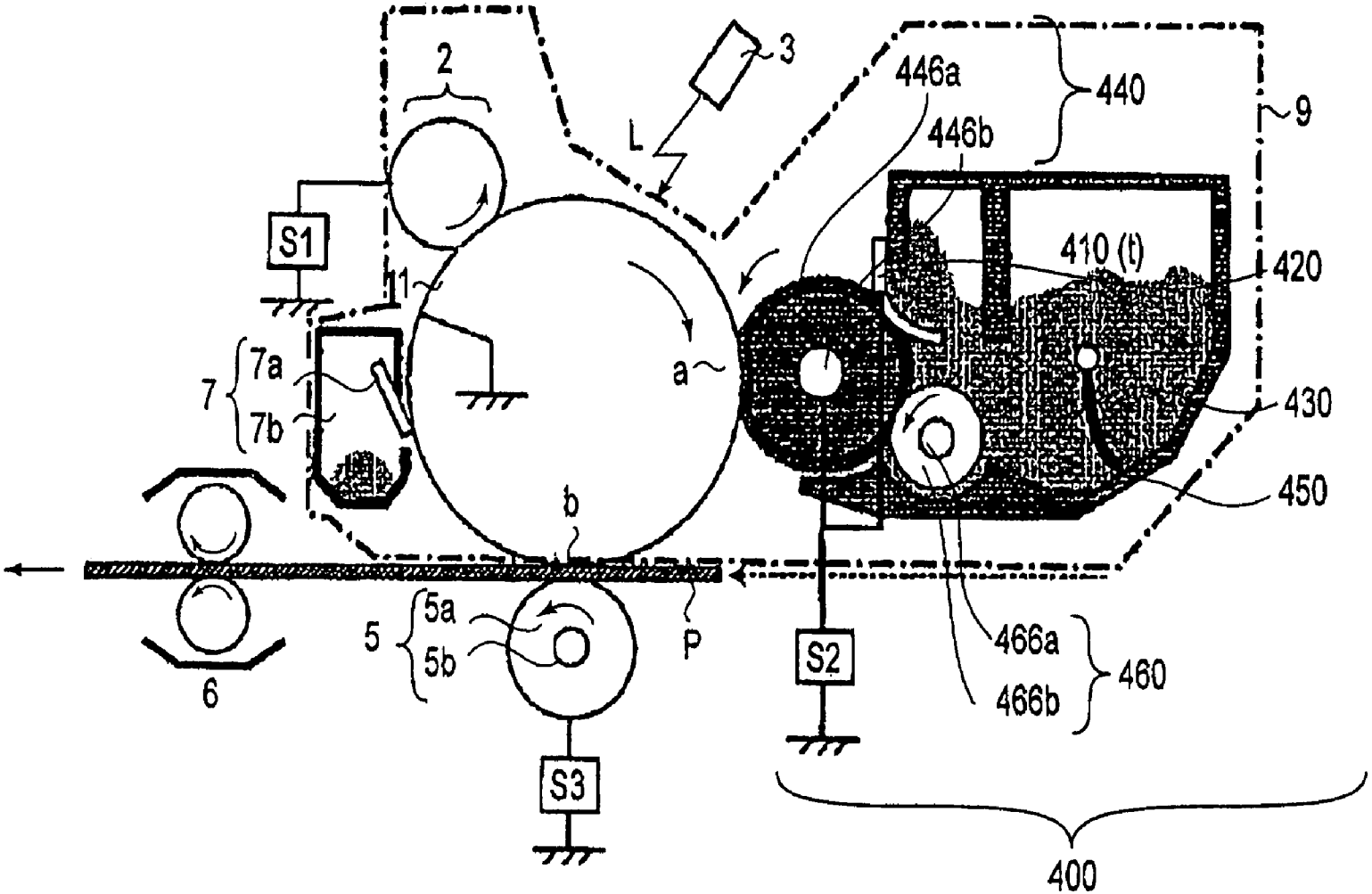
FIG. 6 is a schematic drawing of the image forming apparatus in the modified version of the first version of the image forming apparatus in the first embodiment, showing the general structure thereof.

The developing device 400 of this embodiment will be described. FIG. 6 shows a developing device according to the modified example of Embodiment 1. Designated by 440 is a rotatable elastic roller (developing roller) as the developer carrying member.

The developing roller 440 comprises an upper and an electroconductive elastic layer 446*a*, and is contacted to the photosensitive drum 1 with a predetermined pressure (80 N/rn in drawing pressure). In the manufacturing of the developing roller 440, a material of the electroconductive elastic layer 446*a* is kneaded and extruded, and is applied on the core metal 446*b*. The rubber hardness of the elastic roller 440 is 50° in ASKER C. (500 g), and the microhardness thereof is 40°. The resistance thereof is $2.0\times10^5$ Ωcm.

A developer supplying roller 460 comprises a core metal 466*a* and a sponge layer 466*b* thereon. It is effective for agglomeration prevention of the toner t in the developing container 450 and for feeding supply. The developer feeding roller 460 is contacted to the developing roller 440 at a predetermined pressure, and they are rotated to provide a counterdirectional peripheral movement.

Toner t: the one component non-magnetic toner t (developer) is produced through mixture and kneading of binder resin and charge control material, pulverization and classification. Externally added material for fluidization or the like is used. The average particle size (D4) of the toner is 8 μm.

The toner t is deposited on a developer supplying roller 460 of sponge and is fed, it is supplied to the developing roller 440 by sliding contact to the developing roller 440 in a contact region. In the process of feeding to the developing roller 440, the toner is subjected to the layer thickness regulation and charging by the regulating blade 420. Designated by 430 is a stirring member for circulating the toner in the developing container 450 and for sequentially feeding the toner to the area around the developer supplying roller.

The blade 420 (regulating member) is made of phosphor bronze, and the pressure between the blade 420 and the developing roller 440 is 80 N/m in drawing pressure, and the length of the free part of the blade is 2.0 mm.

The toner t applied on the rotating developing roller 440 is fed by the rotation of the developing roller to the developing zone (developing zone portion) a where the developing roller 440 is opposed to the photosensitive drum 1. The core metal 446*b* of the developing roller 440 is supplied with a developing bias voltage from the developing bias applying voltage source S2.

The developing roller 440 and the regulating blade 420 are electrically connected with each other. The elastic developing roller 440 is rotated at a speed proving a peripheral speed which is 1.4 times the peripheral speed of the photosensitive drum 1.

In this example, the developing bias voltage comprises a DC voltage of −400V and an AC voltage in the form of a rectangular wave and having a peak-to-peak voltage of 300V and a frequency of 1.2 kHz, by which the electrostatic latent image is developed (reverse development) on the photosensitive drum 1 with the toner t Here, the maximum value of the absolute value of the developing bias voltage is 550V, which is DC voltage of −400V plus one half (150V)

of peak-to-peak voltage, and the absolute value of the dark potential of the photosensitive drum is set not more than 700V.

a: Relation Between Fog Amount and Developing Bias Voltage:

Similarly to Embodiment 1, the relation between the maximum value of the absolute value of the developing bias and the fog amount has been investigated. Similarly to Embodiment 1, if the maximum value of the absolute value of the developing bias exceeds dark potential, the fog amount on the photosensitive drum remarkably increases. It is therefore understood that setting the maximum value of the absolute value of the developing bias smaller than the absolute value of the dark potential, is effective to remarkably suppress the fog amount.

In the following comparison examples, the magnetic toner is the same as in Embodiment 1, and the non-magnetic toner is the same as in the modified example.

b: Relation of Contact Condition Between Photosensitive Drum and the Developing Roller:

In order to investigate contact condition between the photosensitive drum 1 and the developing roller 440, the apparatus is set such that only the toner layer is lightly contacted to the photosensitive drum 1, and a comparison is made with the modified example More particularly, the elastic developing roller 440 is faced to the photosensitive drum 1 with a space of 80 μm therebetween, and the toner on the elastic developing roller 440 is regulated by the regulating member 420 to provide a layer thickness of 80 μm.

c: Variation of Contact during Operation for a Large Number of Prints:

An image of a lateral line with print ratio of 5% is continuously printed on 3000 sheets, similarly to Embodiment 1, and an evaluation has been made as to the density difference in a halftone image. As a result, in the case of the press-contact, the halftone image is uniform and satisfactory, but in the case of light contact of the toner layer alone, an image defect of density non-uniformity is recognized. The density non-uniformity worsens under a high temperature and high humidity ambience or under a low temperature and low humidity ambience.

From the foregoing, in this embodiment, by the press-contact between the photosensitive drum 1 and the elastic developing roller 440, the contact condition is stabilized (no gap variation due to numerousness of large number printing or due to the variation in the ambient conditions), and the image quality is satisfactory even if the toner layer varies. The image quality is improved by the AC voltage component in the developing bias.

COMPARISON EXAMPLE 1

(AC Application+High Peak-to-peak Voltage+Magnetic Toner).

The comparison example is the same as Embodiment 1 (FIG. 2) except for that peak-to-peak voltage of the AC voltage component of the developing bias voltage is 800V.

The maximum value of the absolute value of the developing bias is 800V which is higher than the absolute value 700V of the dark potential of the photosensitive drum.

COMPARISON EXAMPLE 2

(AC Application+High Peak-to-peak Voltage+Non-magnetic Toner).

This comparison example is the same as the. foregoing modified example (FIG. 6) except that peak-to-peak voltage of the AC voltage component of the developing bias voltage is 800V.

The maximum value of the absolute value of the developing bias is 800V which is higher than the absolute value 700V of the dark potential of the photosensitive drum.

COMPARISON EXAMPLE 3

(Non-magnetic Toner+Contact Development+DC Voltage Application).

This comparison example is the same as modified example (FIG. 6) except for that DC component of the developing bias voltage is DC voltage −400V.

Figure 7:
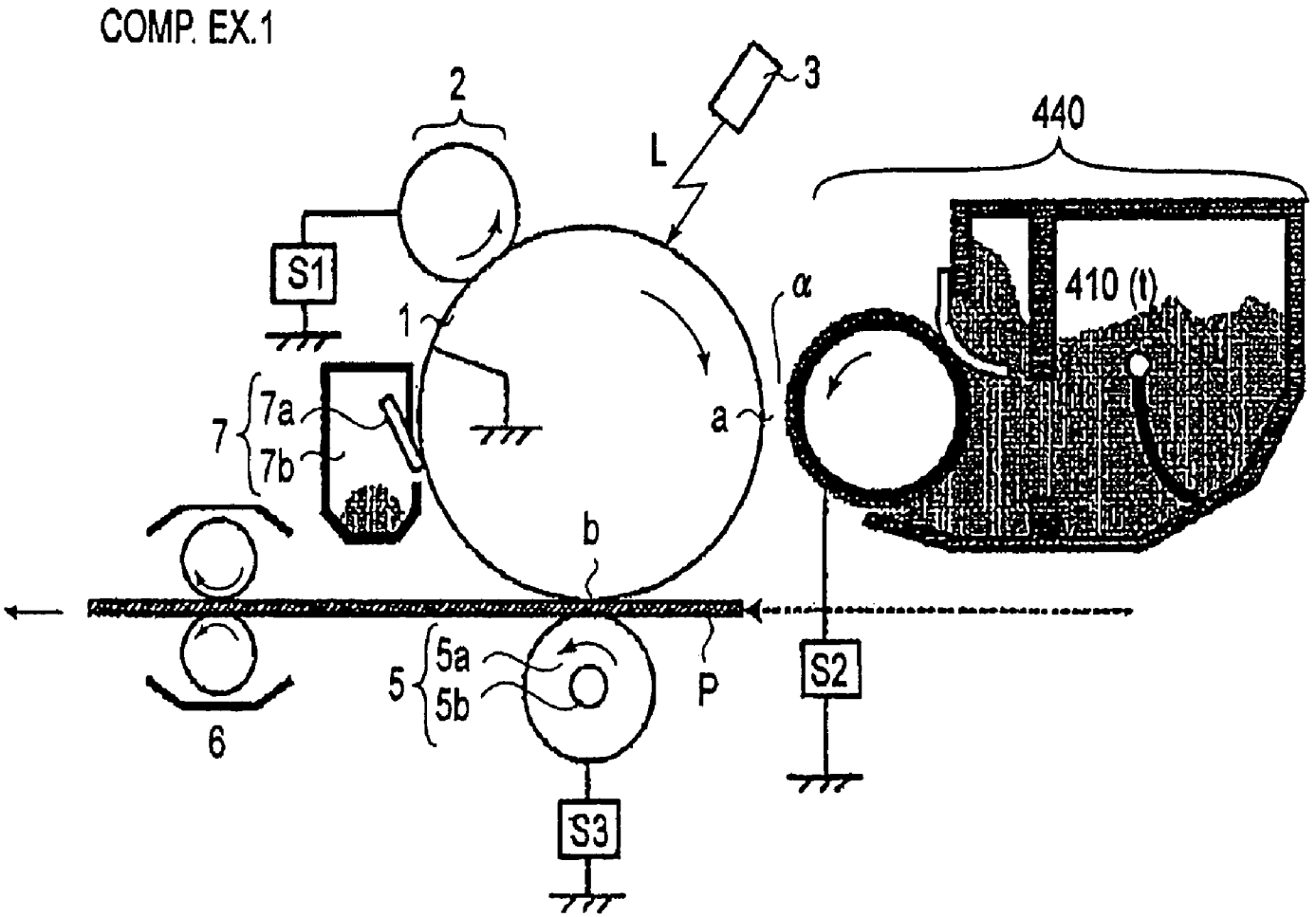
FIG. 7 is a schematic drawing of the image forming apparatus in the first comparative embodiment.

(6) Comparison Scheme 1:

FIG. 7 is a schematic illustration of an image forming apparatus in comparison examples 4–7, which includes means for cleaning the surface of the photosensitive drum to remove the residual toner (drum cleaner). The image forming apparatus is a laser beam printer using an image transfer type electrophotographic process. The same reference numerals as in scheme 1 (FIG. 1) are assigned to the elements having the corresponding functions in this embodiment, and the detailed description thereof is omitted for simplicity. The comparison scheme 1 is different in that developer carrying member 440 of the developing device 400 is spaced from the photosensitive drum 1 by a predetermined clearance α(non-contact development system). There is no other difference.

COMPARISON EXAMPLE 4

(Jumping Development).

Figure 8:
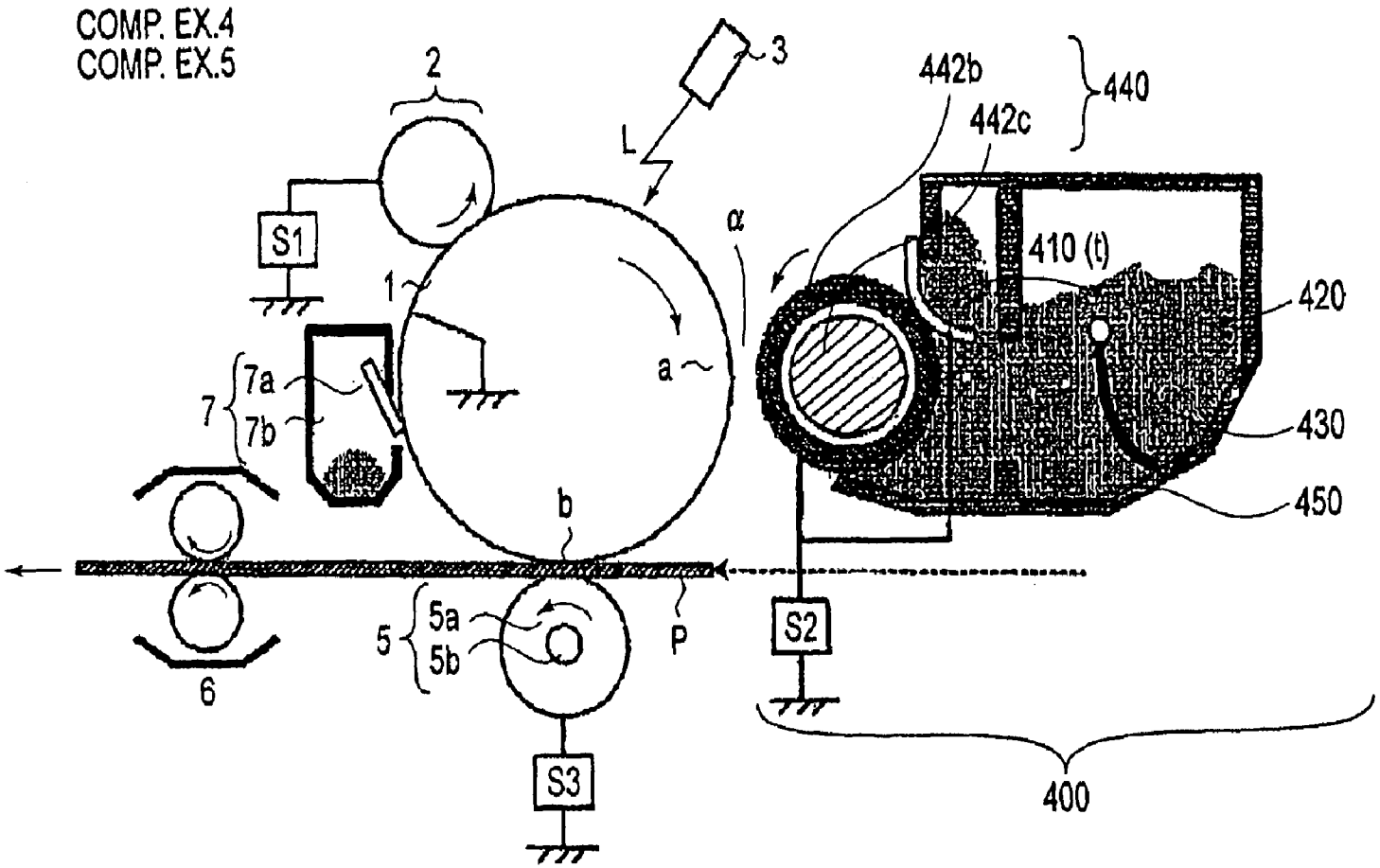
FIG. 8 is a schematic drawing of the fourth version of the image forming apparatus in the first comparative embodiment, showing the general structure thereof.

The image forming apparatus of comparison example 4 (FIG. 8) uses a comparison scheme 1 (using a drum cleaner 7). The developing device 400 is a non-contact-type developing device (jumping developing device) operable with a magnetic one component developer. Designated by 440 is a rotatable developing sleeve as the developer carrying member. The developing sleeve comprises an aluminum cylinder 442*b* which is roughened by sandblasting or the like, and is opposed to the photosensitive drum 1 with a clearance α of 200 μm therebetween. Designated by 442*b* is a magnet roller as the fixed magnetic field generating means enclosed in the developing sleeve and is the same as with Embodiment 1.

While the toner t is fed on the rotatable developing sleeve 440 under the influence of the magnetic force provided by the magnet roller 442*c*, it is subjected to the layer thickness regulation and charging by the regulating blade 420. Designated by 430 is a stirring member for circulating the toner in the developing container 450 and feeding the toner sequentially into magnetic force reaching ranges around the surface of the sleeve.

The toner t applied on the rotatable developing sleeve 440 is fed by rotation of the sleeve 440 to the developing zone (developing zone portion) a where the sleeve 440 is opposed to the photosensitive drum 1. The sleeve 440 is supported with a developing bias voltage from the developing bias applying voltage source S2.

In these examples, the developing bias voltage comprises a DC voltage component of −400V, and an AC voltage component in the form of a rectangular wave and having a peak-to-peak voltage of 2.0 kV and a frequency of 2.0 kHz, by which the electrostatic latent image is developed (reverse development) on the photosensitive drum 1. The maximum value of the absolute value of the developing bias is 1.4 kV which is higher than the absolute value 700V of the dark potential of the photosensitive drum.

The toner t is the one component magnetic toner which is the same as the toner used in Embodiment 1.

COMPARISON EXAMPLE 5

(Jumping Development+Weak AC).

The comparison example 5 is the same as comparison example 4 (FIG. 8) except that developing bias voltage comprises a DC voltage component of −400V, and an AC voltage component in the form of a rectangular wave and having a peak-to-peak voltage of 300V and a frequency of 1–2 kHz. The maximum value of the absolute value of the developing bias is 550V which is lower than the absolute value 700V of the dark potential of the photosensitive drum.

COMPARISON EXAMPLE 6

(Non-magnetic Toner+Non-contact Development+AC Application).

Figure 9:
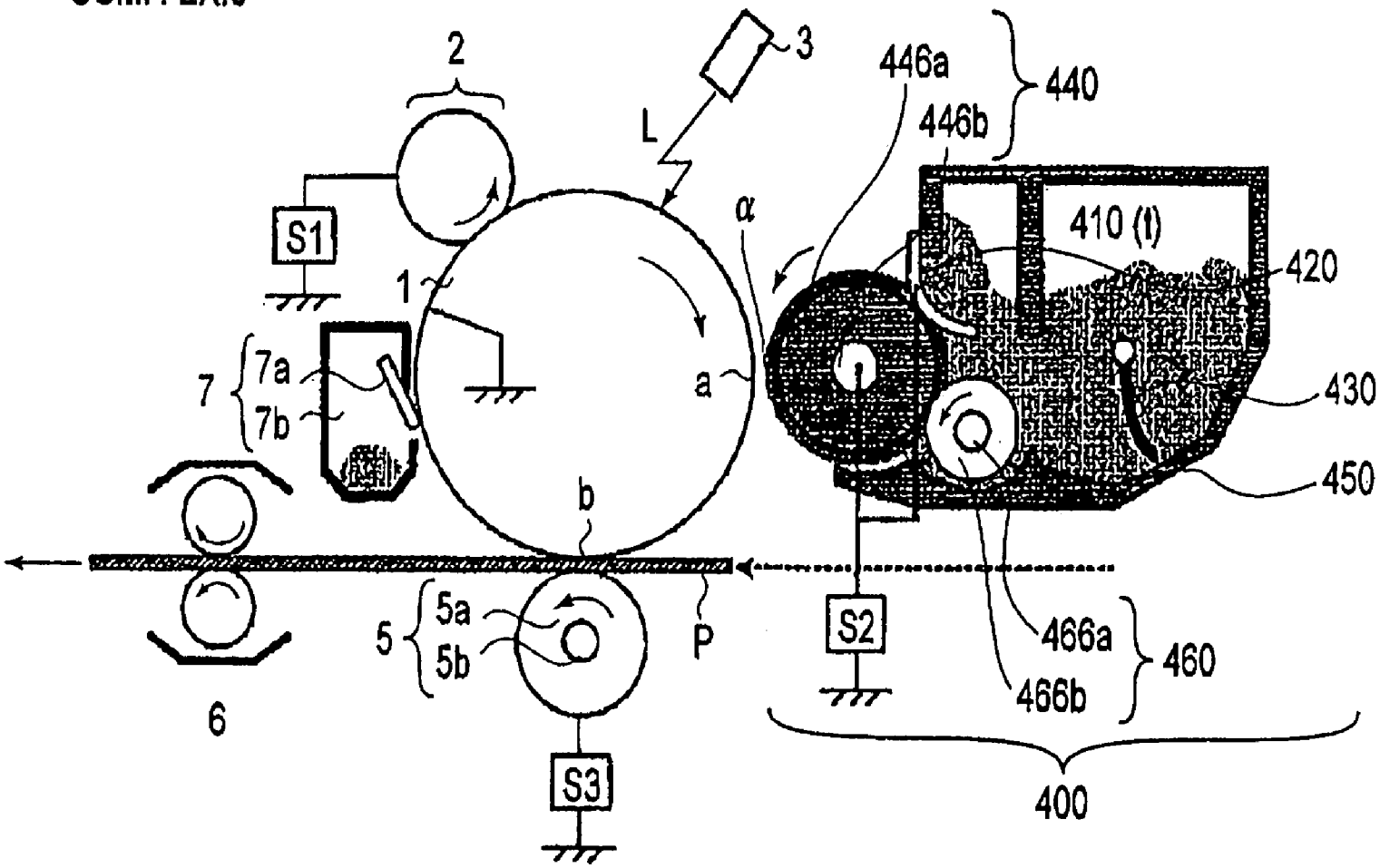
FIG. 9 is a schematic drawing of the sixth version of the image forming apparatus in the first comparative embodiment, showing the general structure thereof.

The image forming apparatus of this comparison example (FIG. 9) uses a comparison scheme 1 (using a drum cleaner 7). The developing device 400 is a non-contact-type developing device using a non-magnetic one component developer. Designated by 440 is a developing roller (rotatable elastic roller) as the developer carrying member. The developing roller 440 comprises a core metal 449*b* and an electroconductive elastic layer 449*a* thereon. The photosensitive drum 1 and the developing roller 440 are opposed to each other with a clearance α of 200 therebetween. The developing roller 440 is produced by kneading, extruding and forming the material of the electroconductive elastic layer 449*a* on the core metal 449*b*. The resistance of the developing roller is adjusted to be $2.0\times10^5$ Ωcm.

A developer supplying roller 460 comprises a core metal 466*a* and a sponge layer 466*b* thereon. It is effective for agglomeration prevention of the toner tin the developing container 450 and for feeding supply. The developer supplying roller 460 is contacted to the developing roller 440 at a predetermined pressure, and they are rotated to provide counterdirectional peripheral movements.

The toner t is deposited on a developer feeding roller 460 of sponge and is fed, it is supplied to the developing roller 440 by sliding contact to the developing roller 440 in a contact region. In the process of feeding to the developing roller 440, the toner is subjected to the layer thickness regulation and electric charging by the regulating blade 420. Designated by 430 is a stirring member for circulating the toner in the developing container 450 and for sequentially feeding the toner to the area around the developer supplying roller.

The toner t applied on the rotating developing roller 440 is fed by the rotation of the developing roller to the developing zone (developing zone portion) a where the developing roller 440 is opposed to the photosensitive drum 1. The electroconductive elastic layer 449*a* of the developing roller is supplied with a developing bias voltage from the developing bias applying voltage source S2 through the core metal 449*b*.

In this example, the developing bias voltage comprises a DC voltage component of −400V, and an AC voltage component in the form of a rectangular wave and having a peak-to-peak voltage of 2.0 kV and a frequency of 2.0 kHz, by which the electrostatic latent image is developed (reverse development) on the photosensitive drum 1. Here, the maximum value of the absolute value of the developing bias voltage is 1400V, which is the absolute value of the DC voltage 400V plus one half (1000V) of peak-to-peak voltage, and the absolute value of the dark potential of the photosensitive drum is set not less than 700V.

The toner used here is a one component non-magnetic toner which is the same as in modified example (FIG. 6).

Figure 10:
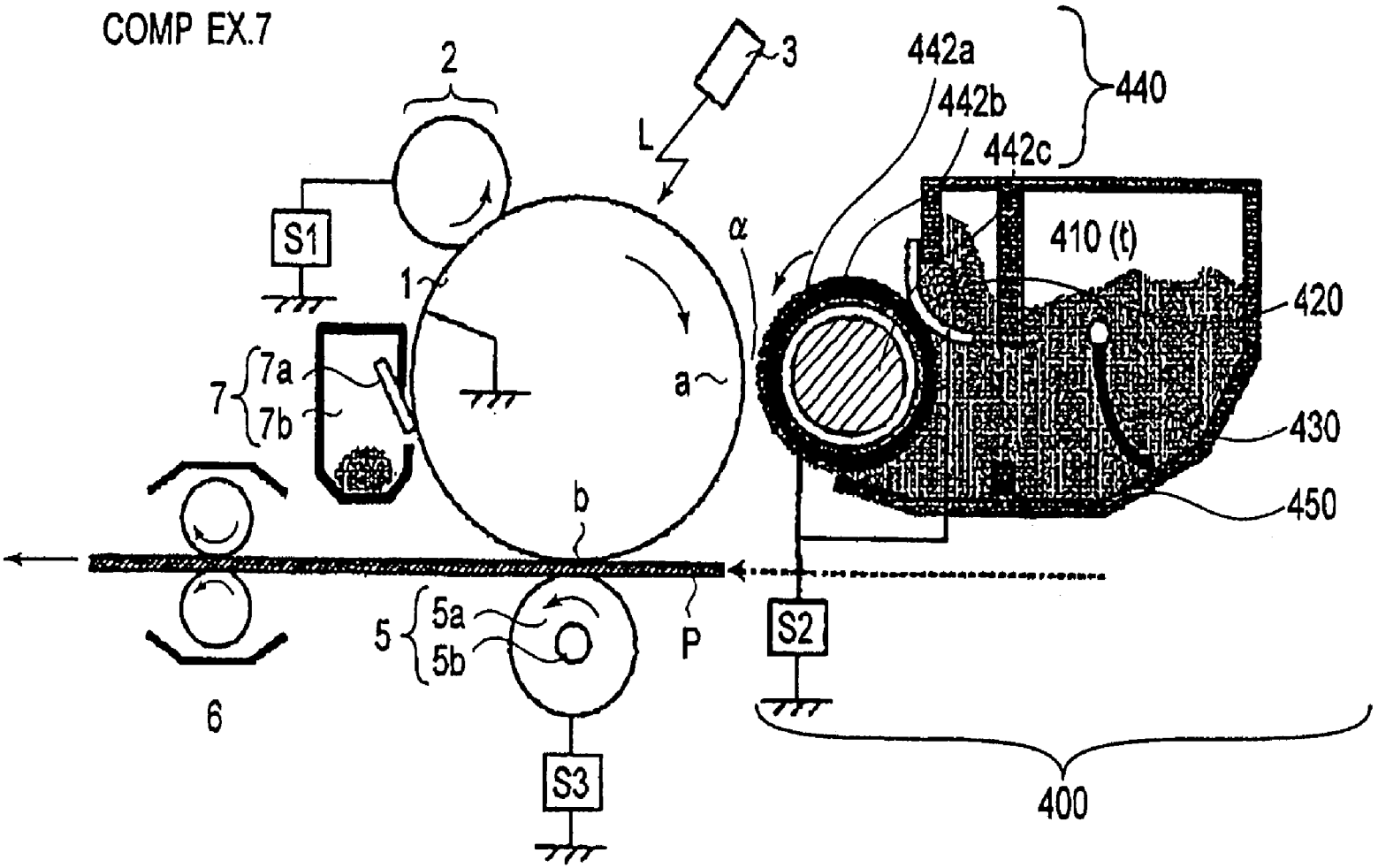
FIG. 10 is a schematic drawing of the seventh version of the image forming apparatus in the first comparative embodiment, showing the general structure thereof.

The image forming apparatus of this comparison example (FIG. 10) uses a comparison scheme 1 (using a drum cleaner 7). The structure similar to this comparison example is disposed in Japanese Laid-open Patent Application Hei 7-28335.

The developing device 400 is a non-contact-type developing device using a magnetic one component developer. Designated by 440 is a rotation elastic developing sleeve as the developer carrying member. In the developing sleeve 440, there is disposed a fixed magnet roller 442*c* as the fixed magnetic field generating means. The developing sleeve 440 comprises an aluminum cylinder 442*b* as the rigid member sleeve and a non-magnetic elastic layer 442*a* formed on the outer surface of the aluminum cylinder. The photosensitive drum 1 and the developing sleeve 440 are opposed to each other with a clearance α of 100 μm. An elastic layer material is kneaded and is extruded into an elastic layer, which is bonded on the aluminum cylinder into 500 μm thick, and then the elastic layer is abraded.

In the process of being carried on the rotation in elastic developing sleeve 440 having the elastic layer 442*a* under the influence of the magnetic force from the magnet roller 442*c*, the toner t is subjected to a layer thickness regulation of the regulating blade 420 (developer amount regulating member) for regulating the amount of the developer on the developing sleeve, and is also subjected to triboelectric charging. Designated by 430 is a stirring member for circulating the toner in the developing container 450 and feeding the toner sequentially into magnetic force reaching ranges around the surface of the sleeve. The magnet roller 442*c* in this example is the same as in Embodiment 1 (FIG. 2).

The toner t applied on the elastic developing sleeve 440 provided with the elastic layer 442*a* is fed by the rotation of the sleeve 440 to the developing zone (developing zone portion) a where the developing sleeve 440 is opposed to the photosensitive drum 1. The developing sleeve 440 is supplied with a developing bias voltage from the developing bias applying voltage source S2. The developing sleeve 440 and the regulating blade 420 are electrically connected.

In these examples, the developing bias voltage comprises a DC voltage component of −400V, and an AC voltage component in the form of a rectangular wave and having a peak-to-peak voltage of 1.0 kV and a frequency of 1.2 kHz, by which the electrostatic latent image is developed (reverse development) on the photosensitive drum 1. Here, the maximum value of the absolute value of the developing bias voltage is 900V, which is the absolute value of the DC voltage 400V plus one half (500V) of peak-to-peak voltage, and the absolute value of the dark potential of the photosensitive drum is set not less than 700V.

The toner t used here is one component magnetic toner which is the same as in Embodiment 1.

(7) Evaluations of the Embodiments and Comparison Examples:

The evaluation method of the images produced by the apparatuses according to Embodiment 1, the modified example and comparison examples 1–7, in each of which the cleaning means is used.

Evaluation Method a).

a-1) Image Defect Attributable to the Configuration of the Surface of the Elastic Layer of the Developer Carrying Member.

For the image evaluation, halftone images are produced, and the evaluation is made on the basis of the number of defects. The scanner machine used in the tests is a 600 dpi laser scanner.

In the tests, the halftone image is represented by an image comprising 1 line extending in the main scan direction and subsequent non-printed 2 lines. The image thus provided, as a total, represents a half-tone image.

The density of the half-tone is measured at 50 points using a reflection density meter (Macbeth SERIES 1200 Color Checker), and a difference of the maximum density and the minimum density is obtained. The number of spots of the density non-uniformity having a diameter of not less than 0.5 mm is counted, and the counts are ranked as follows:

N: the density difference is not less than 0.4, or the number of spots of the density non-uniformity having the diameter of not less than 0.5 mm is not less than 30.

Figure 11:
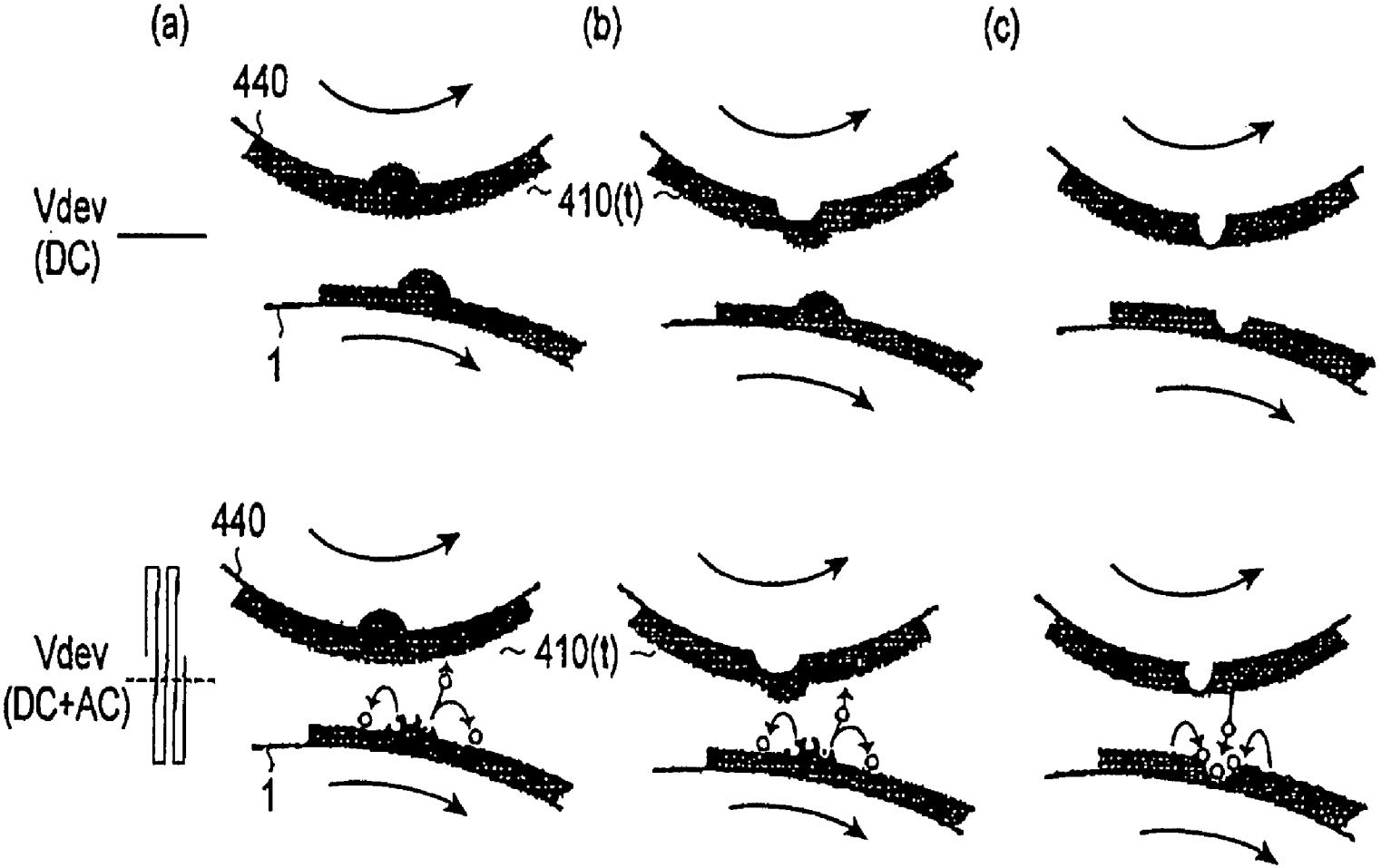
FIG. 11 is a drawing for describing the mechanism of the formation of an image suffering from the defect attributable to the texture of the surface of the elastic layer of the developer bearing member.

G: the density difference is less than 0.4, or the number of spots of the density non-uniformity having the diameter of not less than 0.5 mm is less than 30.

a-2) Referring to FIG. 11, the description will be made as to the image defect attributable to the configuration of the surface of the elastic layer of the developer carrying member. The upper part of FIG. 11 is a schematic view in the case of the developing bias voltage being a DC voltage application, and the lower part is a schematic view in the case of the developing bias voltage being a DC voltage biased with an AC voltage. In FIG. 11, (a) is a schematic is view of toner transfer onto the surface of the photosensitive drum 1 in the case that surface of the developer carrying member 440 is pitted, (b) and (c) are schematic views of toner transfer onto the photosensitive drum in the case that surface of the developer carrying member is projected. As will be understood from the upper part of (a) of FIG. 11, when the surface of the developer carrying member is pitted, the density of the corresponding portion is higher than the other portion. As will be understood from the upper parts of (b) and (c) of FIG. 11, when the surface of the developer carrying member is projected, the density of the corresponding portion is higher or lower than the other portion.

From the foregoing, when the developing bias comprises a DC voltage only (the upper part of FIG. 11), an image defect is produced by the non-uniform density reflecting the pits and projections of the surface of the elastic layer in the halftone image (uniform latent image).

In order to avoid this, it will suffice if the elastic layer has a smooth and uniform surface, since the toner layer will be uniform. Practically however, manufacturing of such a smooth and uniform surface is very difficult In addition, even if such a smooth and uniform surface is manufactured, the elastic layer is deteriorated or scraped in the long term use, with the result that surface shape changes, and therefore, the smooth and uniform surface which is stabilized is even more difficult.

On the other hand, in any case of the lower part of FIG. 11, a uniform toner layer can be formed on the photosensitive drum 1 if the developing bias comprises a DC voltage component and an AC voltage component.

In this embodiment, as shown in the lower part of FIG. 11, the developing bias is a DC voltage biased more superimposed with an AC voltage, and therefore, after the toner is transferred onto the drum with the configurations of the surface of the elastic layer reflected, the toner is supplementingly transferred onto the photosensitive drum in the portion where the toner layer is non-uniform, by the AC voltage application.

When the number of prints increases, the state of contact between the regulating blade and the developing roller changes in a certain portion or certain portions where the amount of electric charge and/or the thickness of the toner layer is different from those of the other portions, with the result that amounts of the toner transferred onto the photosensitive drum are not uniform, and therefore, that density non-uniformity is produced in the halftone image. There is a large area where the density is high. As a result of observation using an optical microscope, the toner is agglomerated locally at such an area, and therefore, the toner is not uniformly dispersed.

When the developing bias comprising the DC voltage component and the AC voltage component is supplied, the uniformity is accomplished as indicated in the lower part (of a) and (b) of FIG. 11, so that large area density non-uniformity and the local toner non-uniformity can both be eliminated, and a satisfactory halftone image is produced.

Evaluation Method b).

b-1) Image Edge Defect:

The image edge defect means an image defect in which at a boundary between a high density portion and the low density portion the density difference therebetween is small.

For the image evaluation, a solid black image of 25 mm square is printed in the halftone image. In this evaluation, the halftone image is represented by an image comprising 1 dot and subsequent non-printed 4 dots in the main scan direction, and 1 dot and subsequent non-printed 4 dots in the subscan direction. The image thus provided, as a total, represents a half-tone image. At the edge portion between the half-tone portion and the solid black portion, the half-tone side at the edge portion is observed by an optical microscope, and the number of toner particles in 1 dot where the toner is agglomerated, are counted. Also, at a portion sufficiently away from the edge portion, the number of toner particles in 1 dot are counted, similarly. In the accounting of the number of toner particles in 1 dot, 15 dots are extracted at random, and the average of the numbers of the toner particles is represented as the number of toner particles in one dot.

N: the number of the toner particles at the edge is not more than 60% the number of the toner particles at a portion sufficiently away from the edge portion.

G: the number of the toner particles at the edge is more than 60% the number of the toner particles at a portion sufficiently away from the edge portion.

Figure 12:
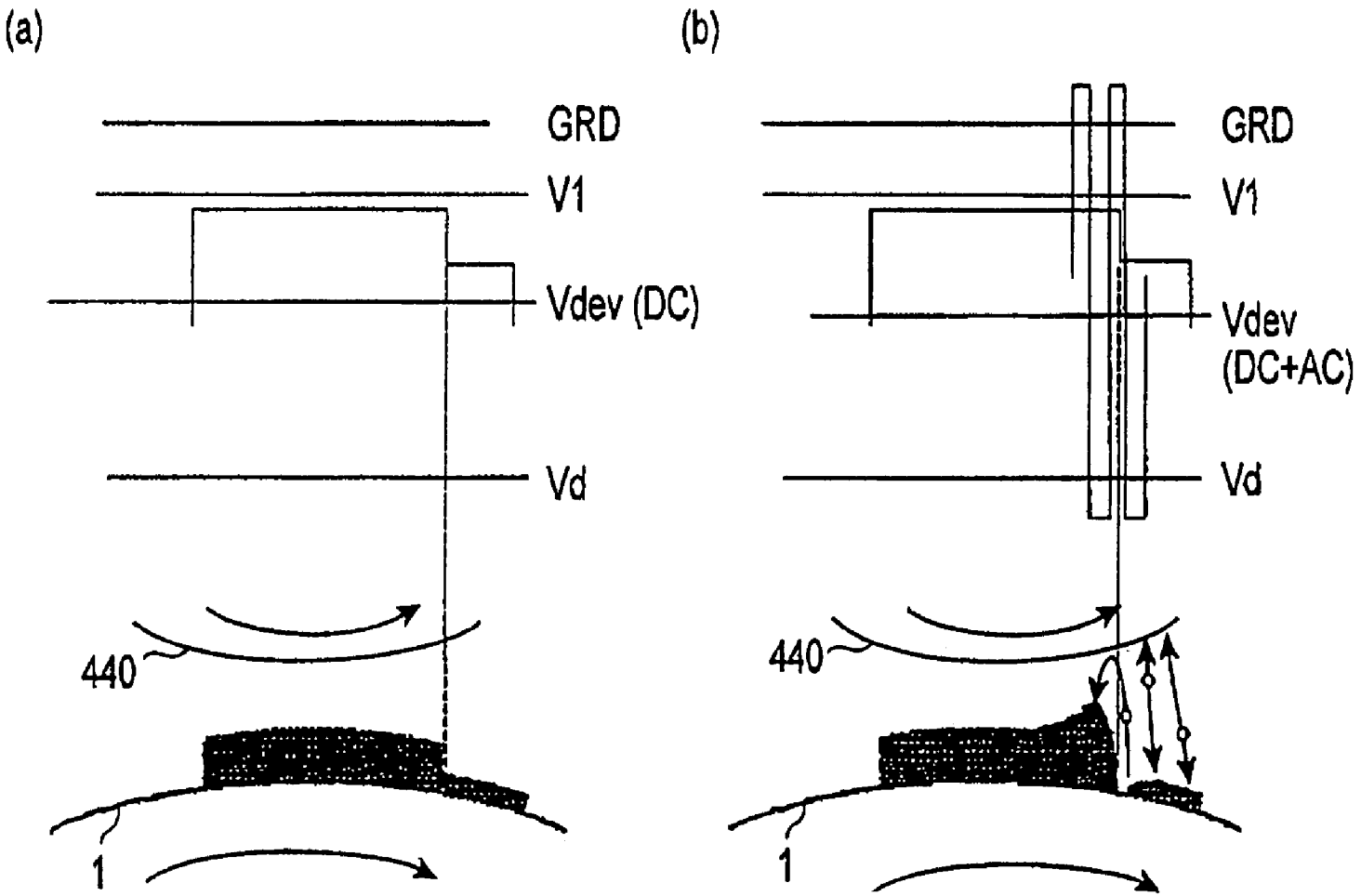
FIG. 12 is a drawing for describing the mechanism of the formation of an image suffering from the edge defects.

The evaluations are carried out for initial 100 sheets.

b-2) Image Edge Defect Factors:

Referring to FIG. 12, the description will be made as to image edge defect factors. When the peak-to-peak voltage of the AC voltage is large, reciprocation of the toner particles occurs in the developing zone. At this time, if there is a printing area at which the density difference is large, as shown in FIG. 12, the toner particles reciprocating in the neighborhood of the boundary, the toner particles are attracted toward the printing area having the high density, and therefore, the density of the low density part lowers more than expected at the boundary portion.

Evaluation Method c).

c-1) Solid Black Image Defect Attribute on the Leakage:

For this image evaluation, a solid black image is printed, and the evaluation is made on the basis of the number of defects in the images. The scanner machine used in the tests is a 600 dpi laser scanner.

If leakage occurs during the developing operation, a white appears in the solid black image. The number of such defective portions are checked as follows:

The evaluation ambient conditions are 32.5° C. and 80% Rh. For the evaluation, three solid black images are printed after 24 hours elapse after 100 sheets print. The image evaluation is represented by the page having the largest number of the defects.

The vibrations are ranked as follows:

N: the number of white spots having a diameter of not less than 0.3 mm in the solid black image exceeds 50.

P: the number of white spots having a diameter of not less than 0.3 mm in the solid black image is 5–50, and the number of white spots having a diameter of not more than 0.3 mm exceeds 50.

F: the number of white spots having a diameter of not less than 0.3 mm in the solid black image is less than 5, and the number of white spots having a diameter of 0.1–0.3 mm is 5–50.

Figure 13:
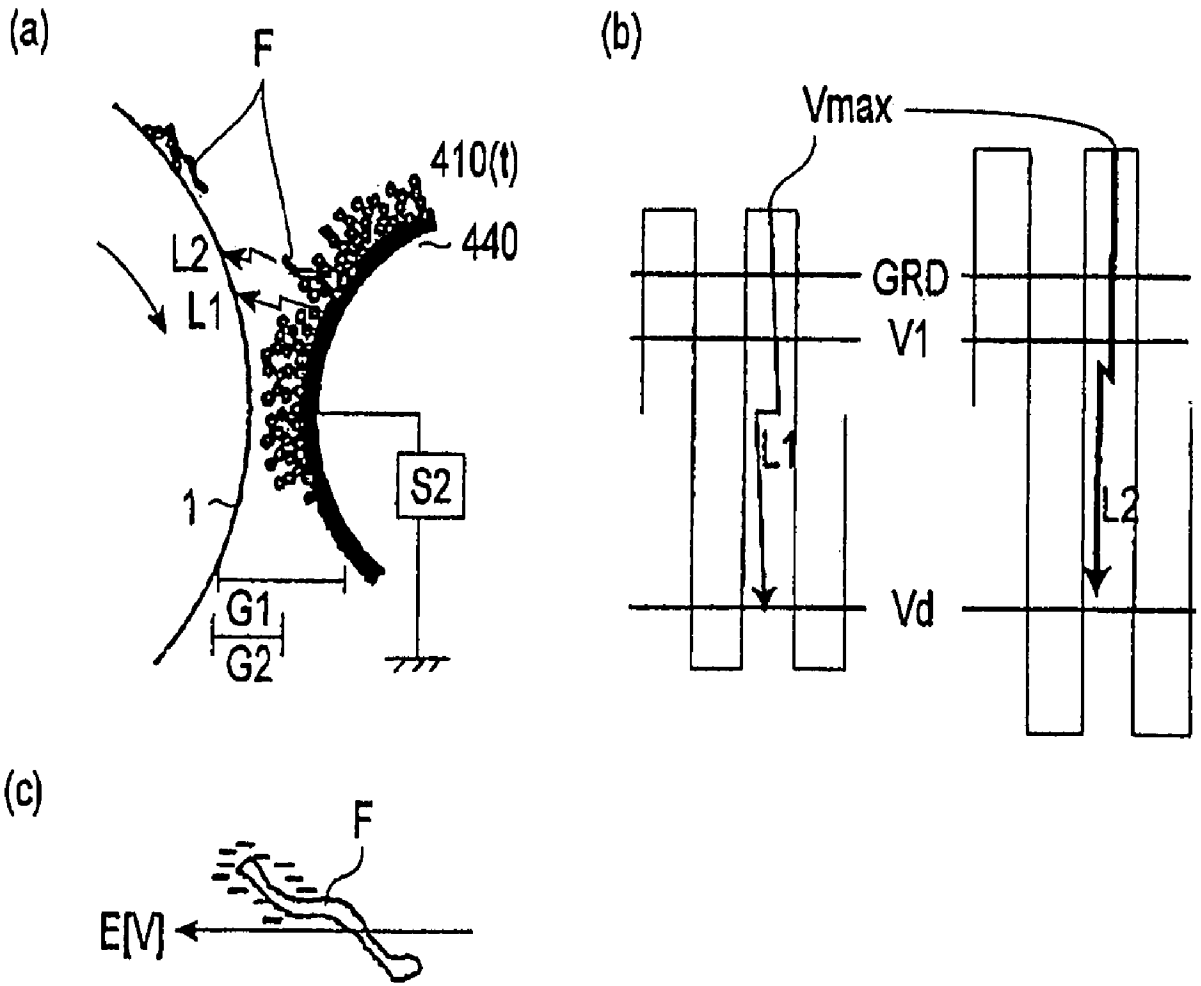
FIG. 13 is a drawing for describing the mechanism 1 of the leak which occurs while a solid white (blank) area of an image is formed, FIG. 13(*a*) showing how paper dust is recovered, FIG. 13(*b*) showing the relationship between the voltage level at which the leak occurs, and bias, and FIG. 13(*c*) showing the deviation of electrical charge, which occurs when an external electrical field is applied to the adjacencies of paper dust.

G: the number of white spots having a diameter of not less than 0.1 mm in the solid black image is less than 5.

c-2) Factors of Leakage Generation:

As shown in (a) of FIG. 13, when the solid black image is developed under the application of the AC voltage in the developing bias, the difference between the surface potential of the image bearing member (light potential V1) and the minimum value (Vmin) of the developing bias voltage value provides the maximum field intensity, and in such a situation, the leakage L1 is liable to occur. The light potential is the surface potential of the low potential portion of the electrostatic latent image which comprises the high potential portion and the low potential portion.

The electrostatic latent image on the image bearing member 1 is disturbed at the portion where the leakage L1 occurs, and as a result, a part of potential (light potential V1) of the solid black portion on the image bearing member 1 approaches to the dark potential (Vd) due to the leakage, and therefore, the toner t is unable to transfer onto the image bearing member (reverse development). Then, a white spot appears at this portion on the image bearing member 1.

When the leakage occurs, a portion charging to Vmin appears on the photosensitive drum irrespective of the field intensity. If the Vmin is very low, the contrast of the developing bias relative to DC value Vdc(|Vmin−Vdc|) is large, the amount of the toner transferred onto the drum remarkably decreases with the result of conspicuous defect.

Evaluation Method d).

d-1) Solid White Image Defect Attributable to Leakage:

For this image evaluation, a solid black image is printed, and the evaluation is made on the basis of the number of defects in the image. The scanner machine used in the tests is a 600 dpi laser scanner.

When the leakage occurs during the developing operation, it appears as a black point in a solid white image. The number of such defective portions are checked as follows:

The evaluation ambient conditions are 32.5° C. and 80% Rh. For the evaluation, 100 sheets are printed, and the apparatus is left for 24 hours, and then three solid white images are printed. The image evaluation is represented by the page having the largest number of the defects.

The vibrations are ranked as follows:

N: the number of black spots having a diameter of not less than 0.3 mm in the solid white image exceeds 50.

P: the number of black spots having a diameter of not less than 0.3 mm in the solid white image is 5–50, and the number of black spots having a diameter of 0.1–0.3 mm in the solid white image exceeds 50.

F: the number of black spots having a diameter of not less than 0.3 mm in the solid white image is less than 5, and the number of black spots having a diameter of 0.1–0.3 mm in the solid white image is 5–50.

Figure 14:
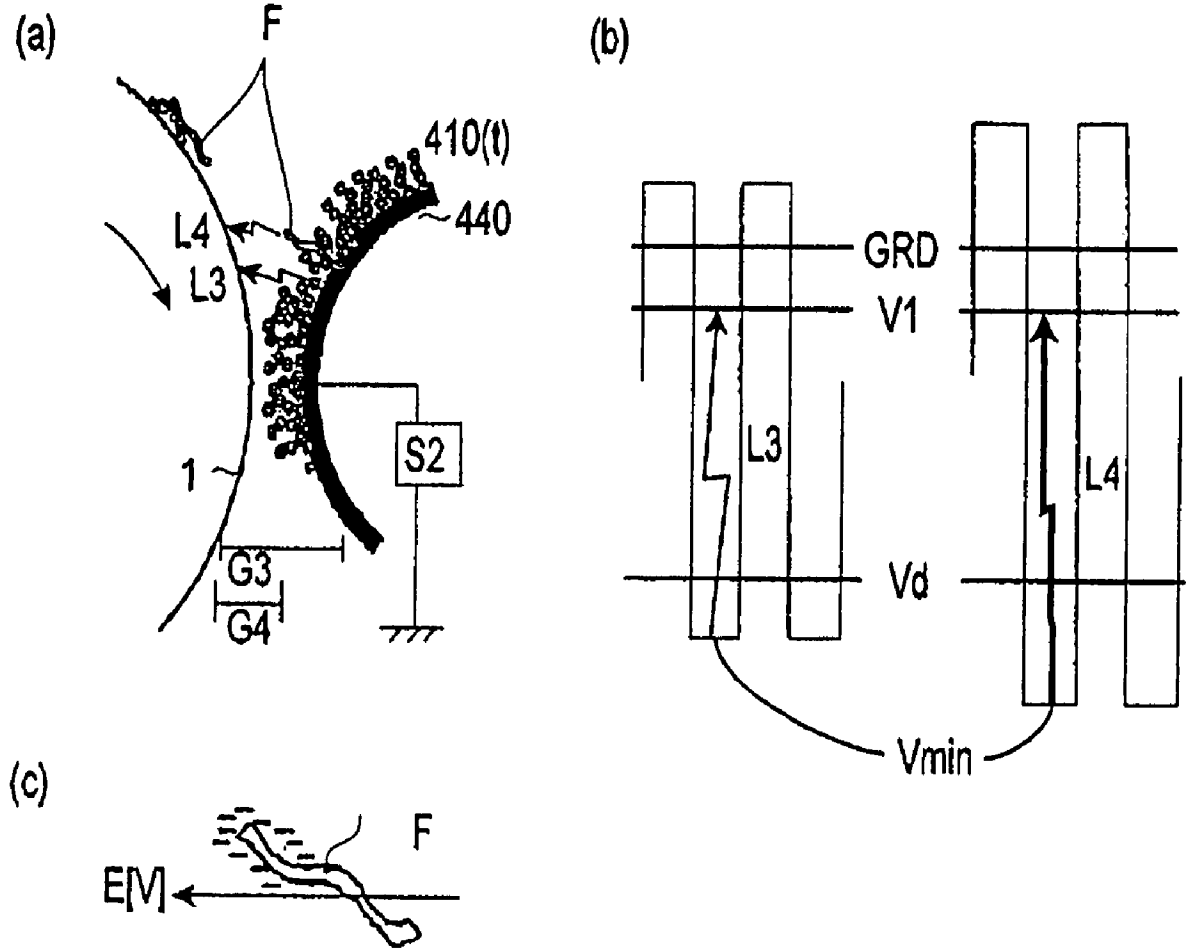
FIG. 14 is a drawing for describing the mechanism 1 of the leak which occurs while a solid black area of an image is formed, FIG. 14(*a*) showing how paper dust is recovered, FIG. 14(*b*) showing the relationship between the voltage level at which the leak occurs, and bias, and FIG. 14(*c*) showing the deviation of electrical charge, which occurs when an external electrical field is applied to the adjacencies of paper dust.

G: the number of black spots having a diameter of not less than 0.1 mm in the solid white image is less than 5.

d-2) Factors of Leakage Generation:

As shown in (b) of FIG. 14, when the solid white image is developed under the application of the AC voltage in the developing bias, the difference between the surface potential of the image bearing member (dark potential vd) and the maximum value (Vmax) of the developing bias voltage value provides the maximum field intensity, and in such a situation, the leakage L3 is liable to occur.

The electrostatic latent image on the image bearing member 1 is disturbed at the portion where the leakage L1 occurs, and as a result, a part of potential (dark potential Vd) of the solid white portion on the image bearing member 1 approaches to the light potential (V1) due to the leakage, and therefore, the toner t is transferred onto the image bearing member 1 (reverse development). Then, a black spot appears at this portion on the image bearing member 1.

When the leakage occurs, a portion charging to Vmax appears on the photosensitive drum irrespective of the field intensity. If Vmax is high, the contrast of the developing bias relative to the DC value Vdc (|Vmax−|Vdc|) is large so that the amount of transfer of the toner increases with the result of very conspicuous defect.

Evaluation Method e).

e-1) Toner Scattering:

For the purpose of this evaluation, after 2000 sheets of test printing operations, the toner deposited on the outer wall of the cartridge or on the inside of the main assembly is collected, and the weight thereof is measured.

The evaluations are carried out for an initial 100 sheets.

e-2) Toner Scattering Factors:

It is not possible to confine the non-magnetic toner by a magnetic force, this is one of the causes of the toner scattering. Particularly in the case of the non-magnetic toner, the charging property of the toner is significantly concerned with the depositing force onto the developer carrying member, and therefore, when the charging is not enough, the toner on the developer carrying member scatters to outside the developing container where there is no magnetic confining force. In addition, by the sliding contact between the supplying roller and the developing roller, the toner deterioration remarkably occurs with the result of liability of decrease of the charging property.

In the case of the non-contact development, the toner jumps to the photosensitive drum, and therefore, when the charging property is not sufficient, the scattering occurs more.

In the case of the magnetic toner, the magnetic force is contributable to the deposition of the toner on the developer carrying member, and therefore, even when the charging to the toner is not sufficient, the toner can be confined on the developer carrying member, and the toner can be accommodated back into the developing container. In this manner, the toner scattering is prevented.

Evaluation Method f).

f-1) Fog Property Evaluation on the Sheet When the Remaining Toner Amount is Short:

By repetition of the printing test operation, the amount of the toner in the developing device decreases so that a produced image becomes thin. The evaluation has been made with respect to the fog property on the sheet when the remaining toner amount decreases.

The fog means an image defect of background contamination caused by a small amount of toner deposited on a white portion (un-exposed portion) where the toner is not supposed to deposit by development.

The amount of fog is measured in this manner. The optical reflectance of the white portion is measured by an optical reflectance measuring machine TC-6DS available from Tokyo Denshoku using a green filter, and the difference of the measurement from the reflectance obtained when a plain paper is measured, is used as the reflectance of the fog. In determination of the amount of the fog, the measurements are carried out for at least 10 different points on the recording paper, and the average of the measurements is employed as the amount of the fog.

N: the amount of fog exceeds 2%.

G: the fog amount is less than 2%.

If an image defect other than the defects which have been described hereinbefore occurs, the defect portion is excluded from the measurement to evaluate the fog only.

When the effects of the lateral line images appear during the printing test, the fog prevention evaluation is carried out, and thereafter, the developing device is removed from the recording device, and then, the developing device is manually shaken to force the toner to move to the developing sleeve and the developing roller. The developing device is then mounted into the apparatus, and the fog prevention evaluation is carried out. The fog prevention evaluation of them are made on the sheet, and the worst result is selected and is used for the fog prevention evaluation.

f-2) Factors of Increase of Fog Amount on the Sheet Attributable to Toner Shortage:

The supply of the non-magnetic toner onto the developing roller is effected by contacting a sponge-like supplying roller to the developing roller so as to provide a counterdirectional peripheral movement. Therefore, by the sliding contact between the developing roller and the supplying roller, the deterioration of the toner is remarkable with the result of reduction of the charging property. For this reason, the fog amount increases with an increase in the number of prints (particularly low duty printing) produced.

Furthermore, with such a toner supply mechanism, the toner replacement hardly occurs around the developing roller with the result of production of the region in which the toner does not circulate On the other hand, the circulating toner deteriorates to a certain degree. When the cartridge is shaken in the case of toner shortage, the less deteriorated toner and such deteriorated toner are mixed together in the developing container, namely, the toner particles having different polarities are mixed with the result of remarkable increase of the fog amount.

This is because when such a mixture occurs, and the charging of the toner is effected, the undeteriorated toner has high charging property, and the deteriorated toner has hardly any charging, or has a polarity opposite to the regular polarity. The thus not charged or opposite polarity toner results in increase of the fog amount.

The toner of the opposite polarity leads to the fog, because the direction of force received by such opposite polarity toner is the opposite from the force received by the regular polarity, and therefore, the opposite polarity toner positively transfers onto the non-printing area.

In the case of the magnetic toner used, the toner is fed by the magnetic force, and therefore, the toner is not remarkably deteriorated. Even when the cartridge is shaken immediately before the toner shortage, there occurs no mixture of the toner particles having opposite polarities, therefore, the increase of the fog amount immediately before the toner shortage can be prevented.

Table 1 shows a result of image evaluation with respect to Embodiment 1, modified example and Comparison Examples 1–7.

TABLE 1

| | *1 | *2 | *3 | *4 | *5 | *6 |
|---|---|---|---|---|---|---|
| Emb. 1<br>Contact/Weak AC<br>Mag. Toner<br>Elastic Sleeve | G | G | G | G | G | G |
| Modified Emb. 1<br>Contact/Weak AC<br>NonMag. Toner<br>Elastic Roller | G | G | G | G | F | N |
| Comp. Ex. 1<br>Contact/AC<br>Mag. Toner<br>Elastic Sleeve | G | N | F | F | G | G |
| Comp. Ex. 2<br>Contact/AC<br>NonMag. Toner<br>Elastic Roller | G | N | F | F | F | N |
| Comp. Ex. 3<br>Contact/DC<br>NonMag. Toner | N | G | G | G | F | N |
| Comp. Ex. 4<br>Jumping Development | G | N | N | N | G | G |
| Comp. Ex. 5<br>Jumping Development<br>Weak AC | X | X | G | G | G | G |
| Comp. Ex. 6<br>NonContact<br>AC<br>NonMag. Toner | G | N | N | N | N | N |
| Comp. Ex. 7<br>Proximity<br>AC<br>Elastic Sleeve | G | N | F | F | G | G |

*1 Evaluation method a
Prevention of Non-uniformity on surface of developer carrying member (pits and projections, resistance uneveness)
*2 Evaluation method b
Prevention of Image edge defect
*3 Evaluation method c
Prevention of Solid black image defect due to leakage
*4 Evaluation method d
Prevention of solid white image defect due to leakage
*5 Evaluation method e
Prevention of Toner scattering
*6 Evaluation method f
Prevention of Fog upon shortage of toner
X: Not evaluatable (7-1) Comparison with an Apparatus of Contact Development with DC Developing Bias Application Using Non-magnetic Toner.

The comparison will be made between an apparatus of contact development with DC developing bias application using non-magnetic toner (comparison example 3, prior art), this Embodiment 1, and modified example, and between non-contact development with AC developing bias application using magnetic toner (comparison example 4) and this Embodiment 1, and modified example.

In Comparison Example 3, the surface shape of the developing roller is significantly influential to the density non-uniformity in a halftone image, but in Embodiment 1, modified example, the developing bias comprises the DC voltage component and AC voltage component, and therefore, no density non-uniformity occurs, and satisfactory image quality is provided. In comparison example 3, the toner scattering is slightly recognized, but in Embodiment 1, the toner scattering is not recognized. This is because the toner is magnetically confined so that toner scattering is prevented.

In Comparison Example 3, when the number of prints increases (particularly, low duty print), the toner deterioration is remarkable because of the pressure by the sliding contact between the developing roller and the supplying roller of sponge for supplying the toner to the developing roller, with the result of increase of the fog amount. However, in Embodiment 1, the toner is fed magnetically, so that toner deterioration does not occur, and the fog amount does not increase. Namely, in Embodiment 1, the increase in the fog amount when the number of the produced prints increases, is suppressed.

In Comparison Example 3, when the number of prints produced increases, a toner coagulated material is produced on the supplying roller of sponge, with the result of spots in the halftone image, but in Embodiment 1, the toner is fed magnetically, so that image defect attributable to the feeding does not occur.

From the foregoing, in Embodiment 1, the image defect attributable to the toner coagulated material is suppressed.

In comparison example 3, the fog amount upon the toner shortage remarkably increased, but in Embodiment 1, no remarkable increase of the fog amount is recognized. This is because the toner is fed magnetically on the sleeve in Embodiment 1, so that toner deterioration does not tend to occur, and when the cartridge is shaken, there is no mixture of the toner particles having different polarities.

As described above, the apparatus according to this embodiment is capable of providing satisfactory uniform images with suppression of halftone image defect attribute of the developing roller surface shape, as contrasted to comparison example 3 (prior art) wherein non-magnetic toner is used with contact type development with DC developing bias application.

(7-2) Comparison with Non-contact Development with AC Developing Bias Application using Magnetic Toner (Comparison Example 4).

In Comparison Example 4, the image edge defect is remarkable, but in Embodiment 1, modified example, the image edge defect is not produced. In Comparison Example 4, the image edge defect is produced because the Vpp of the AC voltage component of the developing bias is high, and therefore, the toner is easily reciprocated, and therefore, the toner gathers at the edge of the image. In addition, since non-contact development is used, the reciprocation of the toner is further enhanced, and therefore, the image edge defect is also enhanced.

In Comparison Example 4, the leakage occurs more easily than in Embodiment 1 and modified example, and because of this, black spots in the solid white image is produced, and the diameter of the white spot in the solid black image is large. In Comparison Example 4, the Vpp of the AC voltage component of the developing bias is high, the leakage easily occurs, and the sizes of the white spots and the black spots are large because the developing sleeve or the developing roller are not contacted with each other.

As described in the foregoing, this embodiment is advantageous over the structure of Comparison Example 4 (prior art) which uses non-contact development with AC developing bias application using magnetic toner, in the suppression of the image edge defect, suppression of the image defect (black spots in solid white image or white spots in solid black image) attributable to the electric leakage.

(7-3) Results of Evaluation by Evaluation Method a:

The Embodiment 1, and modified example will be described in connection with the evaluations.

Evaluation method a) the results of evaluations as to the image defect attributable to the surface non-uniformity of the developer carrying member show that Comparison Example 3 is remarkably bad. The cause will be that Comparison Example 3 uses only the DC voltage in the developing bias, and therefore, the non-uniformity of the surface of the developer carrying member is developed as it is. On the contrary, when the AC voltage is applied, the development uses toner jumping, and therefore, the development is not easily influenced by the surface non-uniformity of the developer carrying member, so that the electrostatic latent image is faithfully developed, and the image quality is improved remarkably.

On the other hand, in comparison example 5, despite the application of AC, the image density is so low that the image evaluation is not possible. The reason would be as follows. Despite the provision of the clearance of 200 μm between the developing sleeve and the photosensitive drum, the Vpp of the AC voltage of the developing bias is as small as 300V, the bias is not sufficient for the toner to jump.

From this, it is understood that image quality is good despite the small vpp as in Embodiment 1 or modified example, the developer carrying member is contacted to the photosensitive drum at a predetermined pressure.

The results of the evaluation by the evaluation method a show that structures of the Embodiment 1 and the modified example are effective to remarkably improve the image quality.

(7-4) Results of Evaluations by Evaluation Method b:

The evaluations as to the image defect attributable to the image edge defect will be described. The image edge defects are remarkable in Comparison Examples 1, 2, 4, 6 and 7 as compared with Embodiment 1, and modified example. The reason for this will be that Vpp of the AC voltage component of the developing bias is so large that toner gathers as a result of reciprocations of the toner in the developing zone. In other words, in Embodiment 1 and modified example, the Vpp of the AC voltage component in the developing bias is small (300V), the image edge defect does not arise, and the faithful and satisfactory image quality can be provided.

In Comparison Example 5, the Vpp of the AC voltage component of the developing bias is small (300V), and therefore, it is supposed that the image edge defect does not arise. Actually, however, the image density is too low to make image evaluation. The reason would be as follows. Despite the provision of the clearance of 200 μm between the developing sleeve and the photosensitive drum, the Vpp of the AC voltage of the developing bias is as small as 300V, the bias is not sufficient for the toner to jump.

The results of evaluation by the evaluation method b show that structure of Embodiment 1 and modified example is effective to produce an image quality faithful to the electrostatic latent image on the photosensitive drum.

Figure 15:
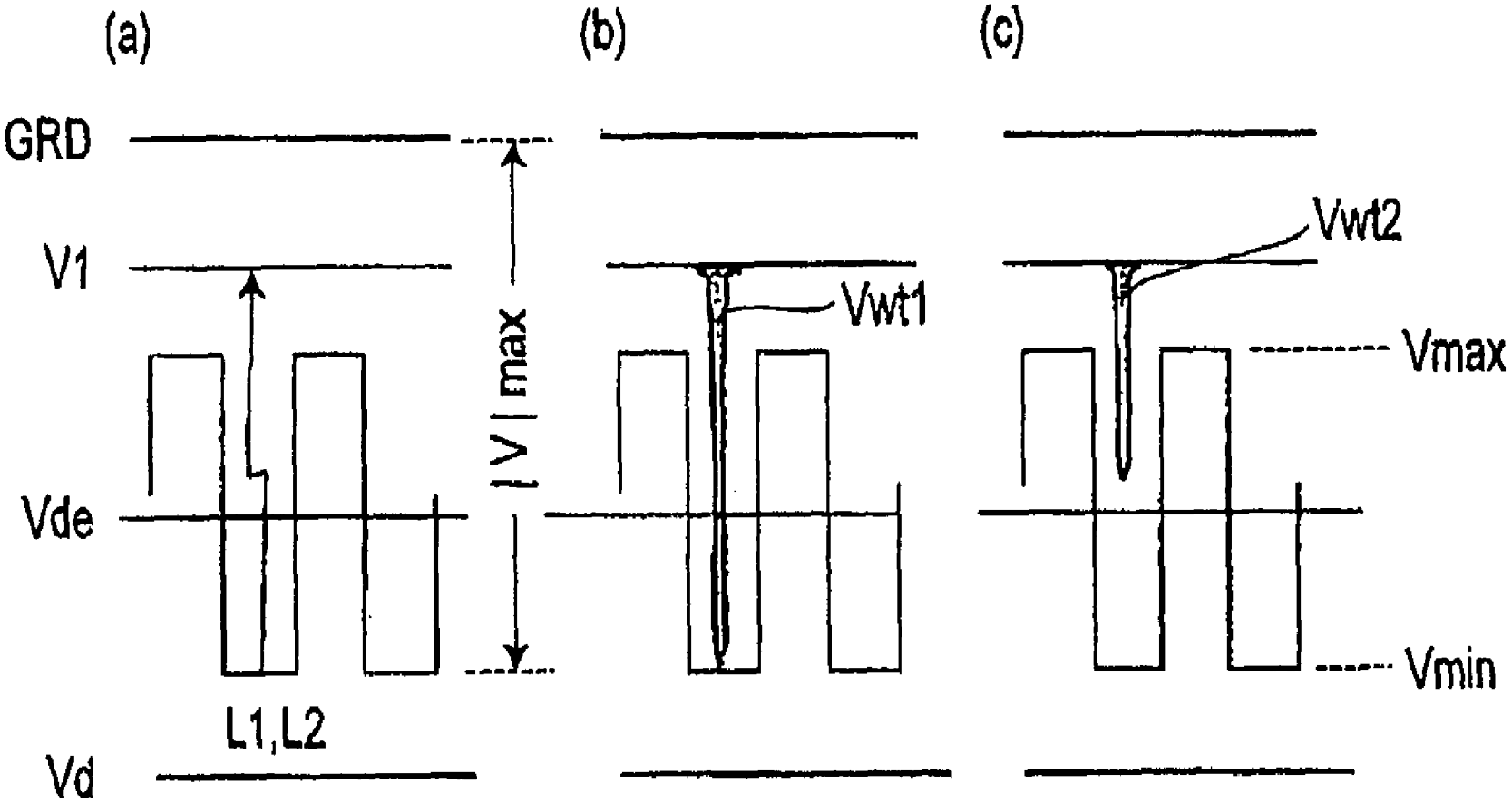
FIG. 15 is a drawing for describing the mechanism 2 of the leak which occurs while a solid black area of an image is formed

(7-3) Results of Evaluation by Evaluation Method c:

The evaluation of prevention of solid black image defect attributable to the electrical leakage. As compared with Embodiment 1 and modified example, the electrical leakage tends to occur in Comparison Examples 1, 2, 7, and therefore, the evaluation level is "F", and white spots are produced in the solid black image. Referring to FIG. 15 this will be described.

In (a) of FIG. 15 a relationship between the drum surface potential and the developing bias is shown when the leakage L1 is produced in the solid black image. The tendency of the leakage L1 increases with increase of |Vmin−V1|. In Comparison Examples 1, 2, and 7, the Vpp of the AC value of the developing bias is high, and therefore, the difference between minimum value Vmin of the developing bias and the light potential V1 is difference with the result of occurrence of the leakage between the developer carrying member and the photosensitive drum. On the other hand, in the Embodiment 1 and modified example, the value of the Vpp of the AC value of the developing bias is small, so that occurrence of the leakage is remarkably suppressed.

In addition, if a local non-uniformity region is produced due to toner agglomeration or foreign matter in the developing zone, the occurrences of the leakage L1 increases as when the Vpp is high. However, in Embodiment 1, and modified example, the toner agglomeration is reduced by superimposing the AC voltage. This is effective to suppress the leakage L1.

If the leakage L1 is produced as shown (in b) of FIG. 15, a part of the surface potential of the solid black image V1 approaches to Vmim, and if the photosensitive drum potential locally changes by Vwt1 to lower than that of DC value Vdc of the developing bias, the white spots are conspicuous, but in Embodiment 1 and modified example, hardly any image defect is recognized. This is because even if the local potential of Vwt1 is generated when the potential therearound is V1, the influence of the potential therearound is effective to provide the potential Vwt2 ((c) of FIG. 15), and therefore, the local potential difference is not conspicuous. Thus, in Embodiment 1, and modified example, |V|max≦|Vd| is satisfied, or more preferably |V|max≦0.9×|Vd| is satisfied, by which even if the electrical leakage L1 is produced, the white spots are not conspicuous in the image.

In Comparison Example 4 and 6, the evaluation is "N", and the diameter of the white spot is larger, and the solid black image defect is worse. The reason for this would be that clearance between the image bearing member and the developer carrying member is 200 μm, the spot if produced is larger.

In consideration of the foregoing evaluations, the apparatus of Embodiment 1 and modified example is advantageous since by the setting of the developing bias to be |V|max≦|Vd|, further preferably |V|max≦0.9×|Vd|, the leakage generation is remarkably suppressed, and even if it occurs, the white spot is not conspicuous, and furthermore, since the developer carrying member is pressed to the photosensitive drum at a predetermined pressure, the diameter of the spot can be reduced even if the leakage occurs.

Figure 16:
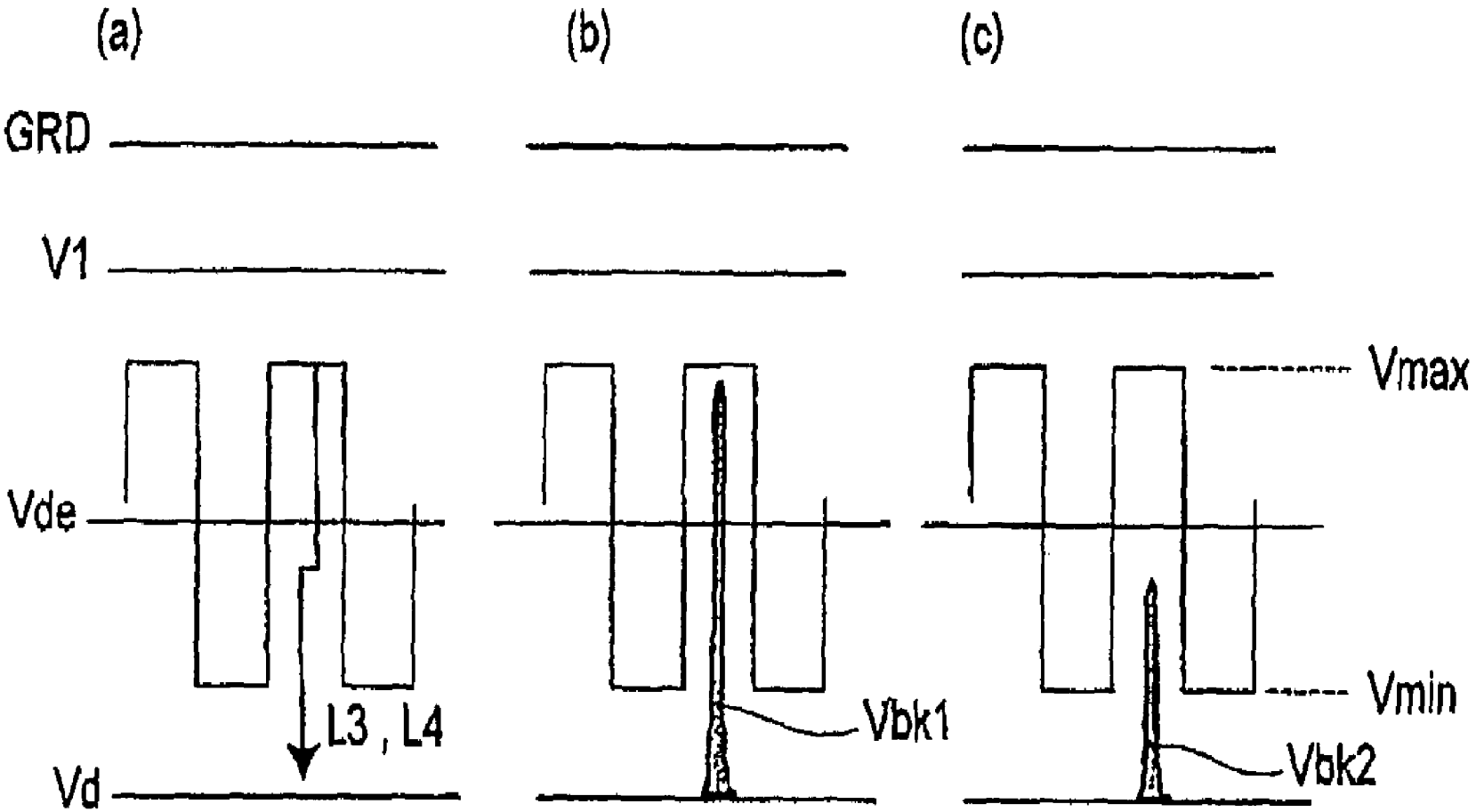
FIG. 16 is a drawing for describing the mechanism 2 of the leak which occurs while a solid white (blank) area of an image is formed.

(7-6) Results of Evaluation Method d:

The variations by evaluation method d (solid white image defect attributable to the leakage) will be described. As compared with Embodiment 1 and modified example, the leakage is significant, and the evaluation thereof is "F", the electrical leakage occurs. Referring to FIG. 16, this will be considered in detail.

In (a) of FIG. 16, therein is shown a relationship between the developing bias and the photosensitive drum surface potential when the leakage L3 is produced in the solid white image. The tendency of the leakage L3 occurrence increases with the increase of |Vmax−Vd|. In Comparison Examples 1, 2 and 7, the Vpp of the AC value of the developing bias is high, the difference between the dark potential Vd and the maximum value Vmax of the developing bias, and therefore, the leakage occurs between the photosensitive drum and the photosensitive drum. On the other hand, in the Embodiment 1 and modified example, the value of the Vpp of the AC value of the developing bias is small, so that occurrence of the leakage is remarkably suppressed.

In addition, if a local non-uniformity region is produced due to toner agglomeration or foreign matter in the developing zone, the occurrences of the leakage L1 increases as when the Vpp is high. However, in Embodiment 1 and modified example, the toner agglomeration is reduced by superimposing the AC voltage. This is effective to suppress the leakage L1.

When the leakage L3 occurs as shown in (b) of FIG. 16, a part of the surface potential of the solid white image Vd approaches Vmax, and therefore, the drum potential locally changes by Vbk1. If it becomes larger than the DC value Vdc of the developing bias, the black spot is conspicuous, but in Embodiment 1 and modified example, the image defect is hardly conspicuous. This would be because even if the local Vbk1 potential is produced when the potential therearound is Vd, the local potential portion is influenced by the potential therearound, so that actually formed potential is Vbk2 ((c) of FIG. 16), and therefore, the portion results are not conspicuous. In other words, in Embodiment 1 and modified example, the developing bias is set to satisfy Vmax≦V1, by which even if the leakage L3 occurs, the black spot is made much less conspicuous.

The evaluations of Comparison Examples 4, 6 are "N", and in addition, the diameter of the black spot is large. The reason for this would be that clearance between the image bearing member and the developer carrying member is 200 μm, the spot if produced is larger.

In view of the results of evaluation by evaluation method d, the developing bias satisfies Vmax≦V1 in Embodiment 1 and modified example, so that leakage occurrence is remarkably suppressed, and even if the leakage occurs, the black spot is made less conspicuous, and in addition, since the developer carrying member is press-contacted to the photosensitive drum at a predetermined pressure, the diameter of the spot can be reduced if the leakage occurs.

(7-7) Results of Evaluation by Evaluation Method e:

The description will be made as to contamination with the toner having fallen in the main assembly or the toner attached on the outer wall of the cartridge due to the toner scattering.

As compared with Embodiment 1, modified example and Comparison Examples 2, 3 are evaluated "F" in the toner scattering prevention. The reason for this is that in Embodiment 1, the toner is magnetically confined on the developer carrying member, and therefore, the confining force for the toner is stronger than when the non-magnetic toner is used, and the toner scattering is prevented. In addition, the evaluation of the Comparison Example 6 is "N", and the situation is worse.

This is because in addition to the smaller confining force to the non-magnetic toner, there are toner unable to jump to the photosensitive drum or to the developing roller and toner not able to return onto the developing container, since the developing roller is out of contact with the photosensitive drum This would result in the contamination by the toner scattering.

According to the evaluations by evaluation method e, when the structure of Embodiment 1 is used, the contamination by the toner scattering can be remarkably prevented, due to the existence of the magnetic confining force and the press-contact structure between the photosensitive drum and the elastic developing sleeve.

With the structure of the modified example, there is no magnetic confining force, and therefore, the toner scattering prevention effect is slightly poorer than Embodiment 1, but the press-contact structure between the photosensitive drum and the elastic roller is effective for toner scattering prevention to such an extent that toner scattering is not a practical problem.

(7-8) Results of Evaluation by Evaluation Method f:

The description will be made as to the fog upon toner shortage or empty: As compared with Embodiment 1, the modified example and Comparison Examples 2, 3, 6 exhibit a larger fog amount upon the toner shortage. The reason is that when the cartridge is shaken, the toner less deteriorated and the deteriorated toner are mixed together, and the deteriorated toner having a deteriorated charging property is further deteriorated due to the difference of the polarity even to the extent that toner is charged to the opposite polarity. This would positively cause the fog amount to increase.

From the foregoing, according to this Embodiment 1, the deterioration of the toner is remarkably suppressed, and the increase of the fog when the cartridge is shaken is suppressed.

(7-9) Evaluations Other than the Foregoing Evaluation Methods:

The description will be made as to evaluations other than those by evaluation methods 1-f. In the modified example and Comparison Examples 2, 3, 6, wherein a sponge-like toner supplying roller is in sliding contact with the developing roller to supply the toner, the toner is deteriorated due to the sliding contact therebetween when the number of prints increases (particularly, low duty printing). If this occurs, the toner supplying roller remarkably increases. In Embodiment 1, on the contrary, the toner is magnetically fed, and therefore, the toner is not deteriorated, and the fog amount does not increase.

From the foregoing, it is understood that according to this Embodiment 1, the toner remarkable deterioration upon increase of the print number, is suppressed, and the increase in the fog amount can be suppressed.

In the modified example and Comparison Examples 2, 3, 6, wherein a sponge-like toner supplying roller is in sliding contact with the developing roller to supply the toner, a toner coagulated material is produced by the sliding contact therebetween, when the number of prints increases, and when the toner coagulated material is fed to the developing roller, non-uniformity in the form of spots appears in a halftone image. However, in Embodiment 1, the toner is fed magnetically, the toner coagulated material is not produced, and therefore, the image defect is not produced.

From the foregoing, it is understood that this Embodiment 1 is effective to suppress production of toner coagulated material and to suppress the image defect due to the toner coagulated material.

In Embodiment 1, when the DC voltage component of the developing bias is set at −400V, a non-uniformity appears in a halftone image. When the non-uniformity is observed by the optical microscope, it has been found that the high density portion has a toner coagulated material, which is the cause of the high density. The cause is that magnetic one component toner has magnetic material therein or at the surface thereof, and therefore, there is a tendency that toner particles are magnetically agglomerated with each other. By the application of the AC voltage, the toner can be more uniformly transferred onto the photosensitive drum.

(7-10) Advantages of this Embodiment:

The advantageous effects of this Embodiment 1 and modified example will be described.

Embodiment 1 is advantageous in that halftone image defect attributable to developing roller surface shape is suppressed, and the satisfactory uniform image can be provided, that image edge defect is suppressed, that image defect attributable to the electrical leakage (black spot in a solid white image and a white spot in a solid black image) is suppressed, that toner scattering is suppressed, and increase of fog amount upon toner shortage is suppressed.

The modified example is advantageous in that halftone image defect attributable to developing roller surface shape is suppressed, and the satisfactory uniform image can be provided, that image edge defect is suppressed, that image defect attributable to the electrical leakage (black spot in a solid white image and a white spot in a solid black image) is suppressed.

Figure 17:
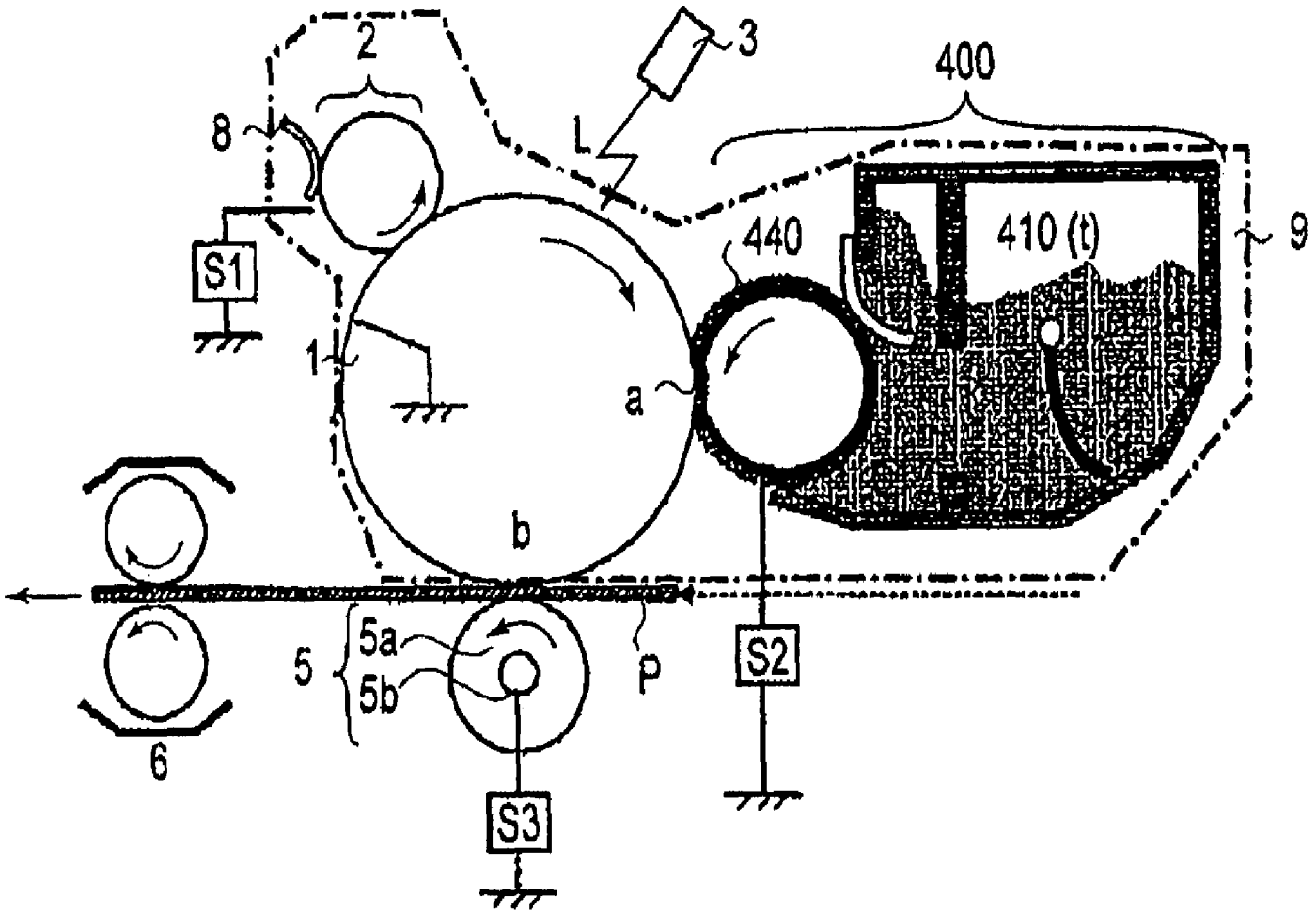
FIG. 17 is a schematic drawing of the cleaner-less image forming apparatus in the second embodiment, showing the general structure thereof.

(8) Scheme 2 of Image Forming Apparatus (Cleaner-less System):

FIG. 17 is a schematic illustration of an image forming apparatus of second scheme (cleaner-less system) according to an embodiment of the present invention. The image forming apparatus of this embodiment is a laser beam printer using an image transfer type electrophotographic process, wherein toner recycling process (cleaner-less system) is employed. With respect to the portions which are the same as with the image forming apparatus (FIG. 1) of scheme 1, the detailed description is omitted.

The apparatus of this embodiment is different from the foregoing EMBODIMENTS in that drum cleaner (7) is not used, and the residual toner is collected by the developing device 400. The developer carrying member 440 is press-contacted to the photosensitive drum 1 at a predetermined pressure and is supplied with a developing bias voltage. Simultaneously with developing operation (visualization) with toner, for the electrostatic latent image formed on the surface of the photosensitive drum, the residual toner remaining on the non-exposed portion (white background portion) is collected by the developing device (simultaneous development and cleaning (collection)).

Figure 18:
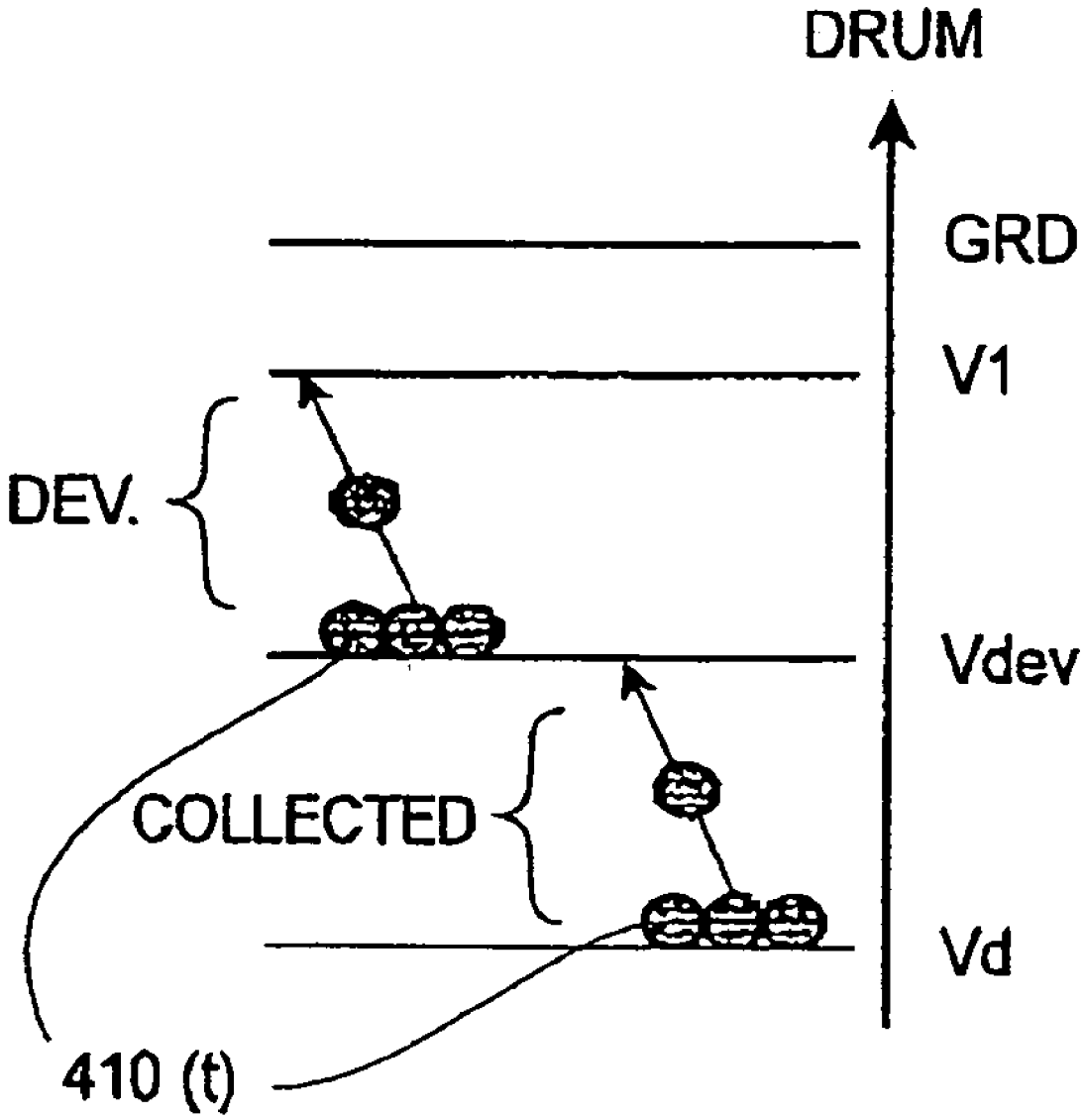
FIG. 18 is a drawing showing the relationship between the development bias and the developer recovery bias in the cleaner-less system.

As shown in FIG. 18, using the potential difference between the developing bias and the printing portion (light portion potential V1 in the case of solid black image), the toner is transferred from the developer carrying member onto the photosensitive drum to effect the reverse development, and using the potential difference between the developing bias and the non-printing portion potential Vd (dark potential), the photosensitive drum is transferred back onto the developer carrying member.

In addition, by the press-contact between the photosensitive drum and the developer carrying member, the distance therebetween is reduced so that field intensity is increased to enhance the performance of the simultaneous development and collection.

In addition, the press-contact structure is effective to assure the development and collecting operation by the electric field, since the effective area of the development nip increases, and it is promoted to make the charge of the returning toner negative, and in addition, the returning toner is loosened, since the effective area of the development nip increases.

The structure of this example is different from the apparatus of scheme 1. As regards the charging structure, the charging roller 2 is similar to that of scheme 1, but in scheme 2, the charging roller 2 is positively driven. The rotational frequency of the charging roller 2 is adjusted so as to provide the same surface speeds (process speed) between the speed of the surface of the charging roller 2 and the photosensitive drum 1. The charging roller 2 is provided with a charging roller contact member 8 to prevent toner contamination of the charging roller 2. The contact member 8 is made of polyimide film having the thickness of 100 μm and is contacted to the charging roller 2 at a line pressure of 5 N/m. The polyimide has a triboelectric charge property of charging the toner to the negative polarity. Therefore, even when the charging roller 2 is contaminated with the toner having the polarity opposite from the charge polarity thereof (positive polarity), the material is effective to charge the toner from the positive polarity to the negative polarity so that such toner is quickly discharged from the charging roller 2, and therefore, it can be collected by the developing device 400.

By positively driving the charging roller 2, the charging roller 2 is assuredly contacted to the photosensitive drum 1 and to the contact member 8 and charges the toner to the negative polarity which is the regular polarity.

These are the differences from scheme 1. In the collection process with such a structure, the residual toner remaining on the photosensitive drum is subjected to the transfer bias with the polarity (positive) opposite from the regular polarity of the toner, by which the amount of electric charge is reduced, or it is charged to the positive polarity. The residual toner is fed to a contact region where the charging roller 2 and the photosensitive drum 1 are contacted to each other.

If the toner enters the nip between the charging roller 2 and the photosensitive drum 1, the toner having the positive polarity is deposited on the charging roller 2 because of the potential relation.

On the other hand, the toner of the negative polarity is urged toward the photosensitive drum because of the potential relation, and therefore, the toner of the negative polarity passes through the nip and is fed to the developing zone, where such a toner is collected by the relation between the developing bias and the dark potential.

The toner deposited on the charging roller 2 is made negative by the charging roller contact member 8, and is discharged onto the photosensitive drum 1. In addition, it is made negative by the electric discharge in the nip region between the charging roller 2 and photosensitive drum 1 and it is discharged onto the photosensitive drum. The collection property of the negative toner in the developing zone is remarkably improved.

The process cartridge 9 contains the photosensitive drum 1, the charging roller 2 and the developing device 400 as a unit.

Embodiment 3:

(Magnetic Toner+Contact Development+Elastic Developing Sleeve+Weak AC+Cleanerless System).

Figure 19:
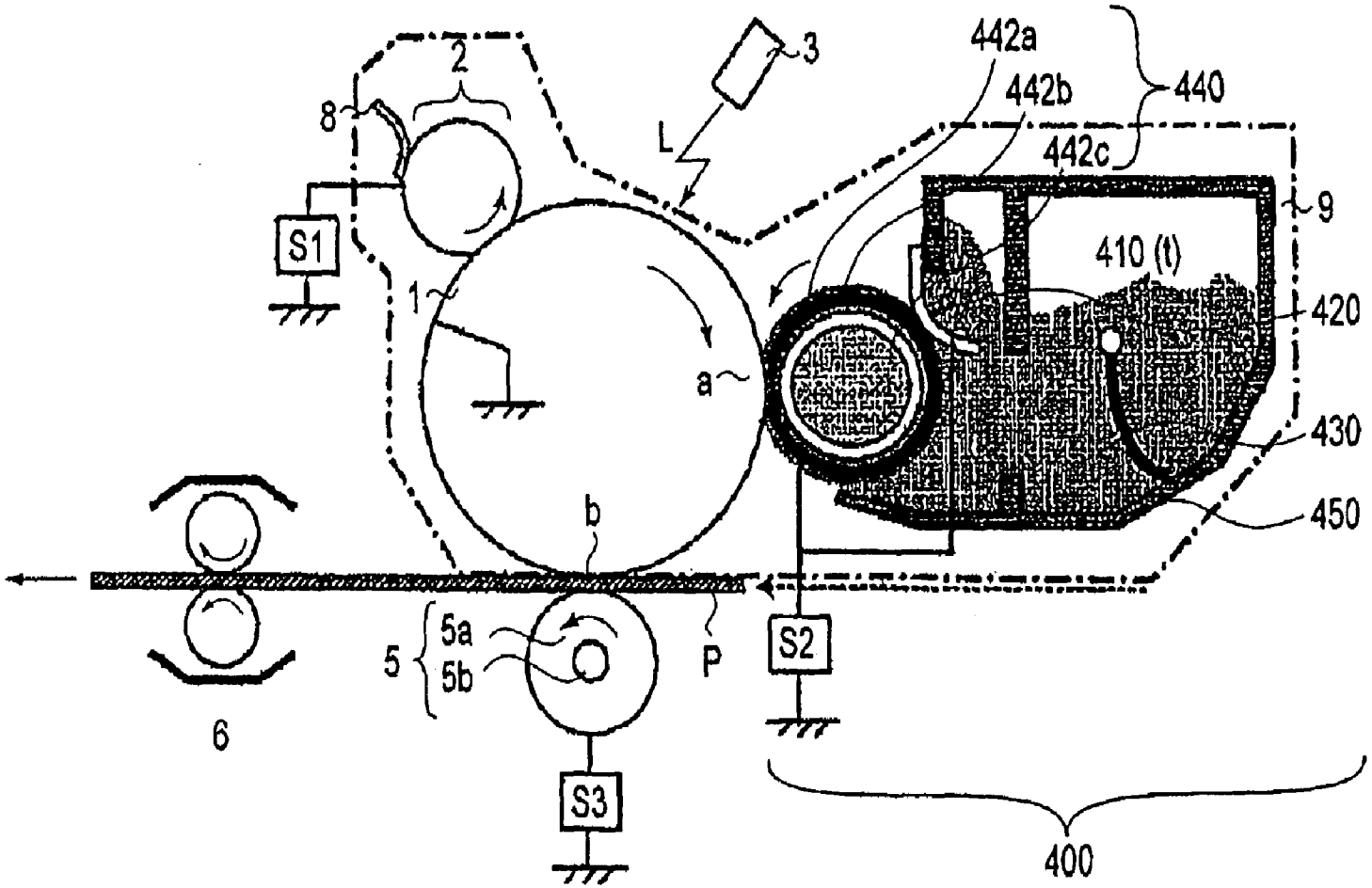
FIG. 19 is a schematic drawing of the third version of the image forming apparatus in the second embodiment, showing the general structure thereof.

Apparatus of this embodiment (FIG. 19) is an image forming apparatus of scheme 2 (cleanerless system). The apparatus of this embodiment is the same as the apparatus of Embodiment 1 except that cleanerless system is incorporated.

a: Relation Between Fog Amount and Developing Bias:

Similarly to Embodiment 1, the relation between the developing bias and the fog amount has been investigated. The fog prevention evaluation is carried out for the initial 100 sheets, and after 2000 sheets printing. In the printing test, an image of lateral lines of image ratio of 5% is repeatedly continuously printed.

The fog amount has been measured in the same manner as with Embodiment 1. Only in the fog measurement (at the time of 100 sheets printed, and at the time of 2000 sheets printed), the developing bias voltage has been changed as follows.

i) the DC value of the developing bias is fixed at −400V, and the peak-to-peak of the AC voltage is changed, and the fog amount is measured.

ii) the DC value of the developing bias is fixed at −400V, and the peak-to-peak of the AC voltage is changed, and the fog amount is measured.

iii) the peak-to-peak voltage of the AC voltage component is fixed at 300V, and the DC value of the developing bias is changed, and the fog amount is measured.

Under the conditions i)–iii), the fog amounts are measured.

After 100 sheets printing, similarly to Embodiment 1 of scheme 1 (using the drum cleaner 7), the fog amount is remarkable when $|V|max>|Vd|$, and the fog amount is remarkably suppressed when $|V|max \leqq |Vd|$.

Figure 20:
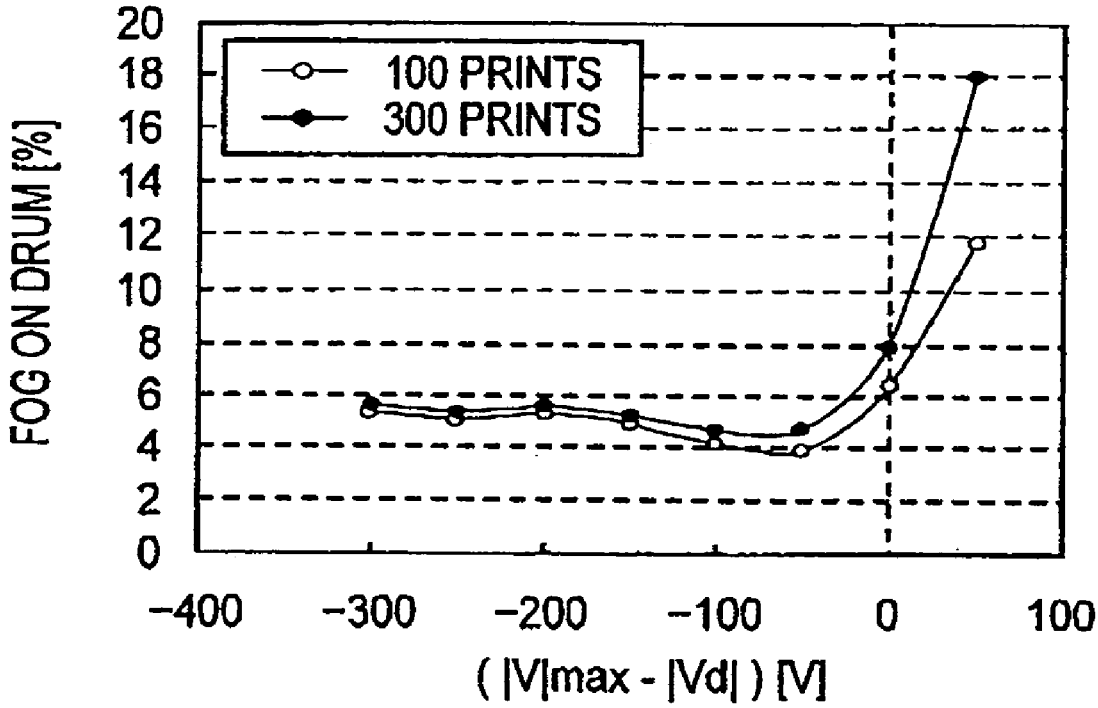
FIG. 20 is a graph showing the relationship between the amount of fog and the development bias, in the third version of the cleaner-less system.
Figure 20:
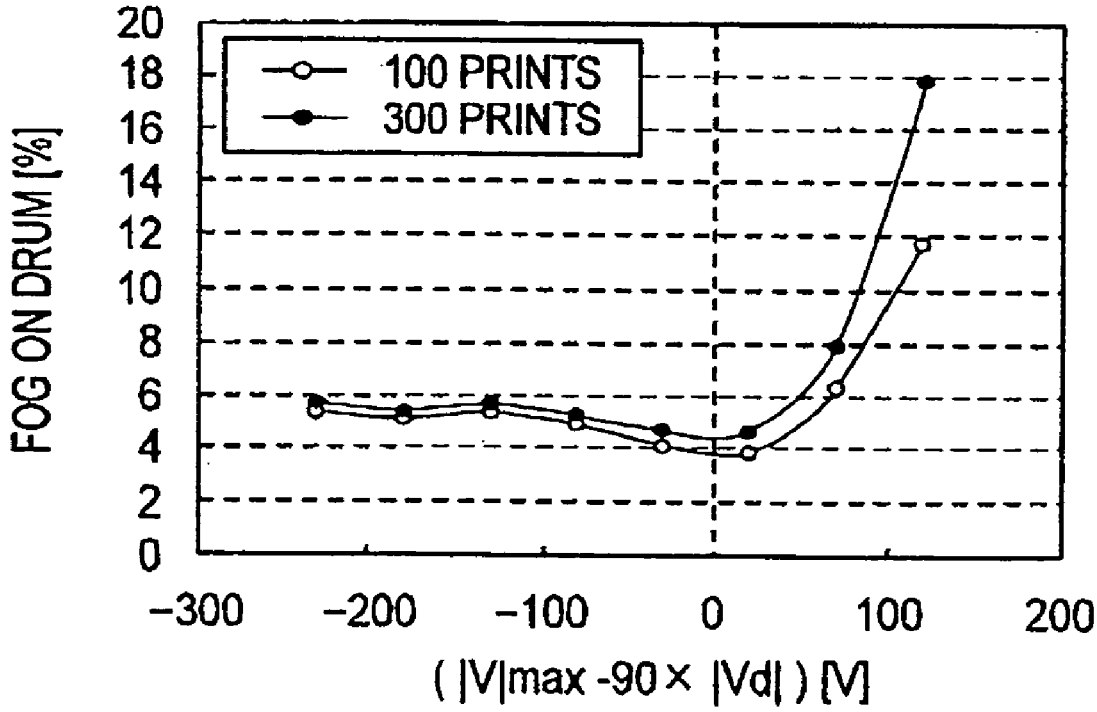

Furthermore, the fog amount after 3000 sheets printing is compared with the fog amount after 100 sheets printing, the results are shown in (a) of FIG. 20. In (a) of FIG. 20, with respect to the cases of 100th and 3000th sheets:

The change of the fog amount is shown when the DC value of the developing bias is fixed at −400V, and the Vpp of the AC voltage component is changed.

The change of the fog amount after 3000 sheets printing, the fog amount remarkably increases as compared with the fog amount after 100 sheets printing, when $|V|max>|Vd|$, but when $|V|max>|Vd|$, the fog amounts are substantially equivalent.

Therefore, it is understood that if $|V|max>|Vd|$ is satisfied, there is something which increases the fog amount when the cleaner-less system is employed which does not when the drum cleaner is used.

This is considered as follows. In the cleaner-less system, the increase of the fog amount by the deterioration of the toner is caused by successive increase of the region where $|V|max>|Vd|$, which results from decrease of $|Vd|$ due to contamination of the charging roller.

When the fog amount increases in the cleaner-less system, the transfer roller contamination results even to such an extent that charging roller contamination with the residual toner (fog toner) totally disables the charging of the photosensitive drum. If this occurs, whole surface black image is produced, and the sheet wraps around the fixing device, resulting in malfunction of the apparatus The suppression of the fog amount is particularly important in the case of cleaner-less system.

From the foregoing, it is understood that the structure of Embodiment 3 is particularly advantageous in that successive increase of the fog amount in the cleaner-less system (caused by the decrease of the charge property attributable to the charging roller contamination or the like with the residual toner) is effectively suppressed.

Since the fog amount can be remarkably reduced, the charging roller contamination due to the increase of the fog amount in the cleaner-less system is suppressed, and therefore, variation of the Vd can be suppressed. The important problem in the cleanerless system is that charging roller contamination with the residual toner can totally disable charging of the photosensitive drum to produce a whole surface black, which may lead to malfunction of the apparatus, can be suppressed.

As will be understood from (b) of FIG. 20, if the bias is set to satisfy $|V|max=0.9 \times |Vd|$, the increase of the fog amount can be remarkably suppressed even when the charging roller contamination results in a decrease of $|Vd|$. Therefore, doing so is very effective in the cleaner-less system.

From the foregoing, the bias voltage satisfying $|V|max \leqq 0.9 \times |Vd|$ is very effective in the cleaner-less system and is able to reduce the fog amount stably.

b: Relation Between Photosensitive Drum 1 and Elastic Developing Sleeve:

In order to investigate contact condition between the photosensitive drum 1 and the elastic developing sleeve 440 to make comparison with the contact condition of this embodiment, the apparatus is set such that only the toner layer is lightly contacted to the photosensitive drum 1, and a comparison is made with this embodiment. More particularly, the elastic developing sleeve 440 is faced to the photosensitive drum 1 with a space of 80 μm therebetween, and the toner on the elastic developing sleeve 440 is regulated by the regulating member 420 to provide a layer thickness of 80 μm.

c: Uniformity of Thin Lateral and Longitudinal Lines:

Similarly to similar, the image evaluation has been made on the basis of continuity of one dot lateral and horizontal lines.

It has been found that when the toner layer is lightly contacted, the uniformity in the thin line and in the lateral line deteriorate as compared with the case in which the toner layer is press-contacted.

This will be considered. When only the toner layer is contacted, chains of the toner erect in the developing zone. The toner is transferred onto the drum under the existence of the erected toner chains, tailing occurs, and therefore, the uniformity of the width of the lateral and longitudinal lines worsens. This would be the cause of the deterioration of the uniformity of the lateral and longitudinal lines.

From the foregoing, this embodiment wherein the elastic developing sleeve 440 is press-contacted to the photosensitive drum 1, is effective to uniformize the widths of the longitudinal and lateral lines.

d: Variation of Contact During Operation for a Large Number of Prints:

Similarly to Embodiment 1, an image of a lateral line with print ratio of 5% is continuously printed on 3000 sheets, and thereafter, an evaluation has been made as to the density difference in a halftone image.

When the developing sleeve is press-contacted to the photosensitive drum, the difference is 0.11, and the halftone image is uniform. When only the toner layer is lightly contacted to the photosensitive drum, the density difference is large, and the image defect of density non-uniformity results. The density non-uniformity worsens under a high temperature and high humidity ambience or under a low temperature and low humidity ambience.

When a spot is produced in the halftone image by mixing of the paper dust included in the returning toner into the developing zone, the diameter of the spot is large and therefore conspicuous in the case of only the toner layer is lightly contacted to the photosensitive member. This is because in the case of only the toner layer is lightly contacted to the photosensitive member, the state of the surface layer of the toner layer is largely influential, and therefore, if the paper dust is mixed, even a small disturbance appears remarkably on the resultant image.

From the foregoing, in this embodiment, the press-contact of the elastic developing sleeve to the photosensitive drum is effective to stabilize the contact condition therebetween against the gap variation during a large number of printing or the gap variation due to the ambience variation, and therefore, the image quality is maintained satisfactory even when the toner layer changes. In addition, the superimposing of the AC voltage improves the image quality, and the image defect does not easily result even when the paper dust is mixed into the developer.

e: Collection Property of Toner:

The toner collection property in the cleanerless system has been investigated as to when the photosensitive drum and the are press-contacted to each other and when only the toner layer is lightly contacted to the photosensitive drum.

For this evaluation, a solid black image of 30–50 mm is printed at the leading end of the printed image area, and thereafter the image recording device is operated to print an evaluation pattern having a solid white image and is stopped during the printing operation. The timing of the stop is the instance when the center position of the solid black image at the leading end comes to the developing zone. The reflectance of the toner deposited on the surface of the photosensitive drum is measured at each of the points before and after development The toner collection efficiency can be evaluated on the basis of a ratio between the reflectances. Actually, the toner on the drum is transferred on a transparent tape, which in turn is stuck on a plain paper, and the net reflectance of the toner is measured using optical reflectance measurement machine TC-6DS, available from Tokyo Denshoku Kabushiki Kaisha, Japan.

The collection rate when the photosensitive drum and the developing sleeve are press-contacted to each other is 65%, and that when the toner layer is lightly contacted to the photosensitive drum is 33%, and therefore, the improvement in the collection rate by the press-contact has been confirmed.

The reason is considered as follows, by the press-contact between the photosensitive drum and the developing sleeve, the distance between the photosensitive drum and the elastic sleeve easily used, and therefore, the field intensity for returning the toner onto the elastic sleeve is increased, and therefore, the collection property is improved.

In addition, when the toner layer is lightly contacted to the photosensitive drum, the toner particles are erected in the form of chains which are contacted to the photosensitive drum, the number of contacts of the toner particles to the photosensitive drum is smaller than when the toner layer is press-contacted to the drum. By the contact between the photosensitive drum and the returning toner on the photosensitive drum, a van der Waals force applies. However, when the toner on the elastic developing sleeve contacts the returning toner on the photosensitive drum, the similar force applies among the toner particles, and therefore, the toner particles are easily removed from the surface of the photosensitive drum. Without such contact, the toner particles are not easily removed since the depositing force to the photosensitive drum is relatively strong. The collection rate is smaller due to the decrease of the number of contacts in the light-contact case.

The press-contact between the photosensitive drum and developing sleeve is effective to physically loosen the toner and is effective to enhance negative charging of the toner, so that the collection rate is improved. However, in the light-contact case, these effectivenesses are not expected, and therefore, the collection rate is low.

The investigation will be made as to when the peripheral speed ratio between the surface of the elastic developing sleeve and a surface of the drum is 1.0 to 1.2. In the case of the press-contact, the collection rate significantly improves from 58% to 65%, whereas in the case of the light-contact, the collection rate hardly improves (32% to 33%). From this analysis, it is considered that physical loosening effect and the negative charging effect is not large in the light-contact case.

The collection rate after 3000 sheets printing is measured. In the case of the press-contact, the collection rate remains the same, whereas in the case of the light-contact of, the collection rate decreases by 5%. In the light-contact case, the collection rate reduces into the gap variation and/or change of the toner layer thickness during the operation, whereas in the press-contact case, the variation in the developing zone is small, or the change in the state of the developing zone does not result in an image defect.

From the foregoing, this embodiment in which the elastic developing sleeve is press-contacted to the photosensitive drum, and elastic developing sleeve is rotated at a higher peripheral speed than that of the photosensitive drum, is particularly effective to improve the toner collection property, and the collection performance is stabilized.

Embodiment 4:

(Non-magnetic Toner+Contact Development+Elastic Developing Roller+Weak AC+Cleanerless System).

Figure 21:
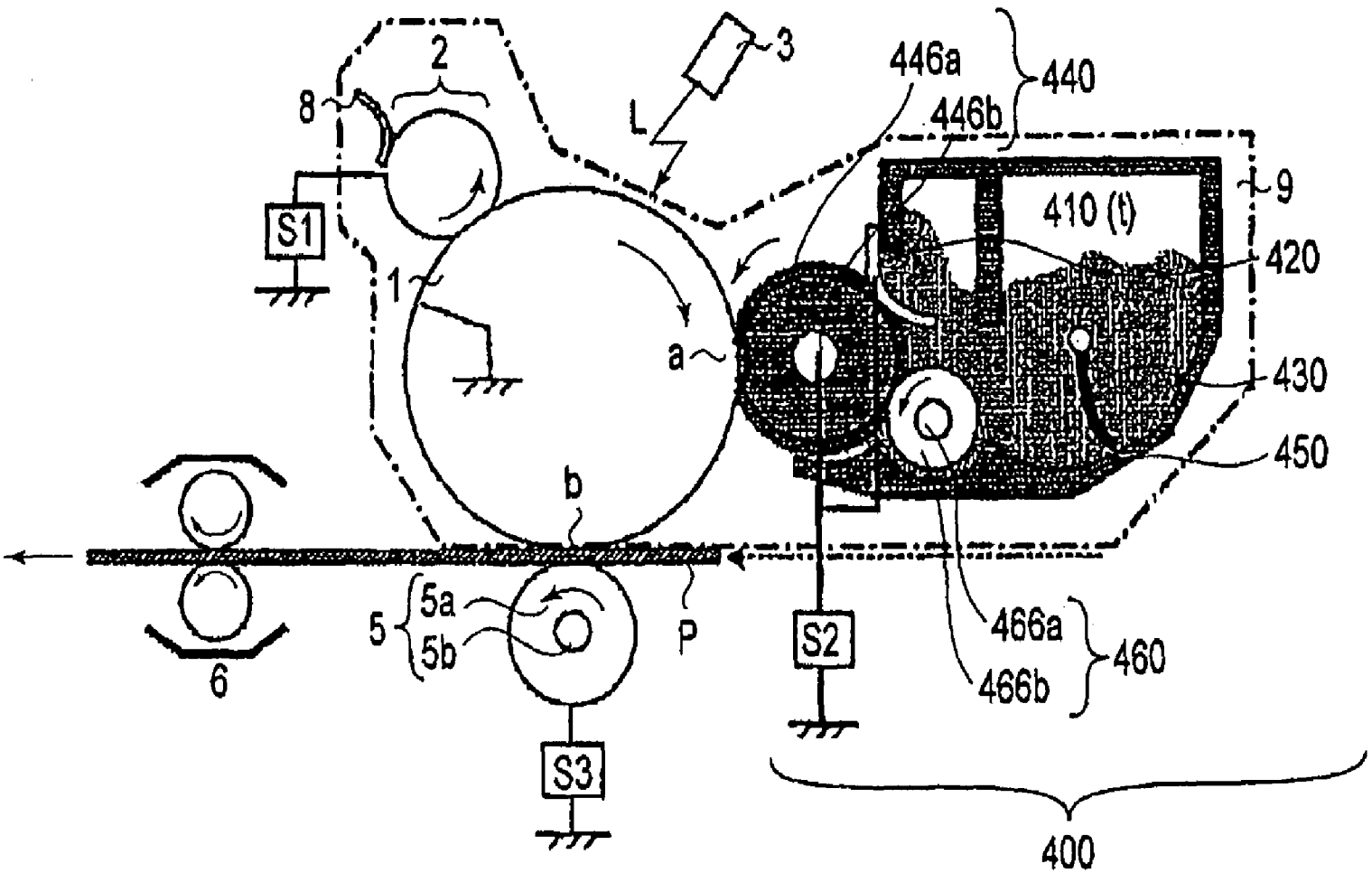
FIG. 21 is a schematic drawing of the fourth version of the image forming apparatus in the comparative embodiment 2, showing the general structure thereof.

Apparatus of this embodiment (FIG. 21) is an image forming apparatus of scheme 2 (cleanerless system). This embodiment is the same as the modified example except that it uses scheme 2 (modified example plus cleanerless system).

a: Relation Between Fog Amount and Developing Bias Voltage:

Similarly to Embodiment 1, the relation between the maximum value of the absolute value of the developing bias and the fog amount has been investigated. Similarly to Embodiment 1, if the maximum value of the absolute value of the developing bias exceeds dark potential, the fog amount on the photosensitive drum remarkably increases. It is therefore understood that setting the maximum value of the absolute value of the developing bias smaller than the absolute value of the dark potential, is effective to remarkably suppress the fog amount.

From the foregoing, the structure of this Embodiment 4 is effective to stably suppress the fog amount despite a decrease and/or variation of the charging property due to the charging roller contamination or the like with the residual toner, the wearing of the charging roller or photosensitive drum or the like, or variation in the ambience. Therefore, the structure is effective for the cleaner-less system.

b: Relation of Contact Condition Between Photosensitive Drum and the Developing Roller:

In order to investigate the difference in the contact condition between the photosensitive drum and developing roller, only the toner layer is lightly contacted to the photosensitive drum. More particularly, the developing roller 440 is faced to the photosensitive drum 1 with a space of 80 μm therebetween, and the toner on the developing roller is regulated by the regulating member 420 to provide a layer thickness of 80 μm.

c: Variation of Contact During Operation for a Large Number of Prints:

Similarly to Embodiment 1, an image of a lateral line with print ratio of 5% is continuously printed on 3000 sheets, and thereafter, an evaluation has been made as to the density difference in a halftone image.

Similarly to Embodiment 3, in the case of the press-contact, the produced halftone image is uniform, whereas in the case of the light-contact, the image involves density non-uniformity (image defect).

The inclusion of the AC voltage component in the developing bias is effective to improve the image quality. However, in the light-contact case, the distance between the developing roller and the photosensitive drum is large, and therefore, the effect of the improvement in the image by the AC voltage is not very effective so that density non-uniformity is large.

In addition, when a spot defect is produced in the halftone image by the paper dust contained in the toner mixing into the developing zone, in the light-contact case, the diameter of the spot is large and conspicuous.

As described in the foregoing, the press-contact between the photosensitive drum and the developing roller is effective to stabilized the positional relation therebetween despite variation of the gap during the increasing number of prints and/or the variation in the gap due to the ambience variation, and therefore, the image quality of the produced image is kept satisfactory. The improvement in the image quality by the superimposing of the AC voltage is provided, and even if the paper dust is mixed into the toner, the image defect is hardly produced.

d: Collection Property of Toner:

The collection property before the returning toner in the case of the cleanerless type is investigated as to when the developing sleeve is press-contacted to the photosensitive drum and when only the toner layer is lightly contacted to the photosensitive drum.

Similarly to Embodiment 3, the collection rate in the press-contact case, is better than the collection rate in the light-contact case.

As contrasted to Embodiment 3, the toner used is non-magnetic toner, and therefore, no toner particle chains are produced, and therefore, the reduction in the number of contacts is not as large as in Embodiment 3, however, since only the toner layer is lightly contacted to the surface of the drum, the number still decreases.

The investigation will be made as to when the peripheral speed ratio between the surface of the elastic developing sleeve and a surface of the drum is 1.0 to 1.2. In the case of the press-contact, the collection rate significantly improves, whereas in the case of the light-contact, the collection rate hardly improves. From this analysis, it is considered that physical loosening effect and the negative charging effect is not large in the light-contact case.

The collection rate after a large number of printings is measured. In the case of the press-contact, the collection rate remains the same, whereas in the case of the light-contact of, the collection rate decreases.

From the foregoing, it is understood that according to this embodiment, in which the elastic sleeve is press-contacted to the surface of the photosensitive drum, and the surface of the elastic sleeve is rotated at a speed higher than the peripheral speed of the drum, the toner collection property is remarkably improved, and the collection property is stabilized.

COMPARISON EXAMPLE 8

(AC application, large peak-to-peak voltage).

This comparison example is a type of scheme 2 (cleanerless system). The apparatus of this comparison example is the same as the apparatus of Comparison Example 1 except for incorporation of scheme 2. Thus, this comparison example corresponds to Comparison Example 1 plus cleanerless system.

COMPARISON EXAMPLE 9

(AC application, large peak-to-peak voltage, (non-magnetic toner)).

The image forming apparatus of this comparison example (FIG. 21) is of scheme 2 (cleanerless system) type. The apparatus of this comparison example is the same as the apparatus of Comparison Example 1. Thus, this comparison example corresponds to Comparison Example 1 plus cleanerless system.

COMPARISON EXAMPLE 10

Non-magnetic Toner+Contact Development+DC Voltage Application+Cleanerless.

The image forming apparatus of this comparison example (FIG. 21) is of scheme 2 (cleanerless system) type. The apparatus of this comparison example is the same as the apparatus of Comparison Example 3 except for incorporation of scheme 2. Thus, this comparison example corresponds to Comparison Example 3 plus cleanerless system.

(9) COMPARISON SCHEME 2.

Figure 22:
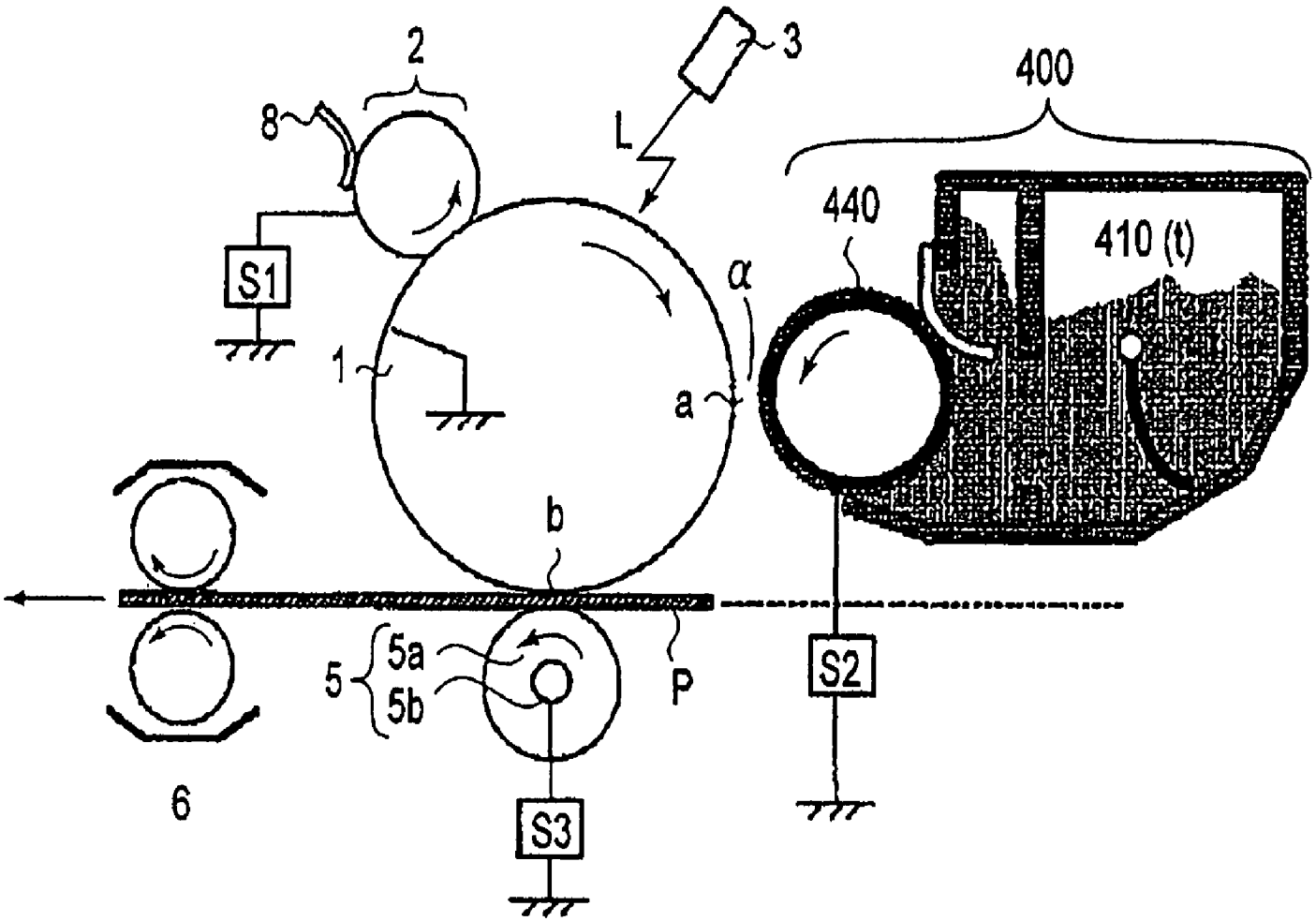
FIG. 22 is a schematic drawing of the cleaner-less image forming apparatus in the second embodiment, showing the general structure thereof.

FIG. 22 is a schematic illustration of an image recording device over a cleaner-less system type used in Comparison Examples 11–13. The image recording device used here is a laser beam printer using an image transfer type electrophotographic process.

The portions which are the same as with the image recording device of scheme 2 (FIG. 17) are not described for simplicity. The comparison scheme 2 is different in that developer carrying member 440 is spaced from the photosensitive drum 1 with a predetermined clearance therebetween (non-contact development system). The comparison scheme 2 is exactly the same except for this point.

COMPARISON EXAMPLE 11

(Jumping Development+Cleanerless).

Figure 23:
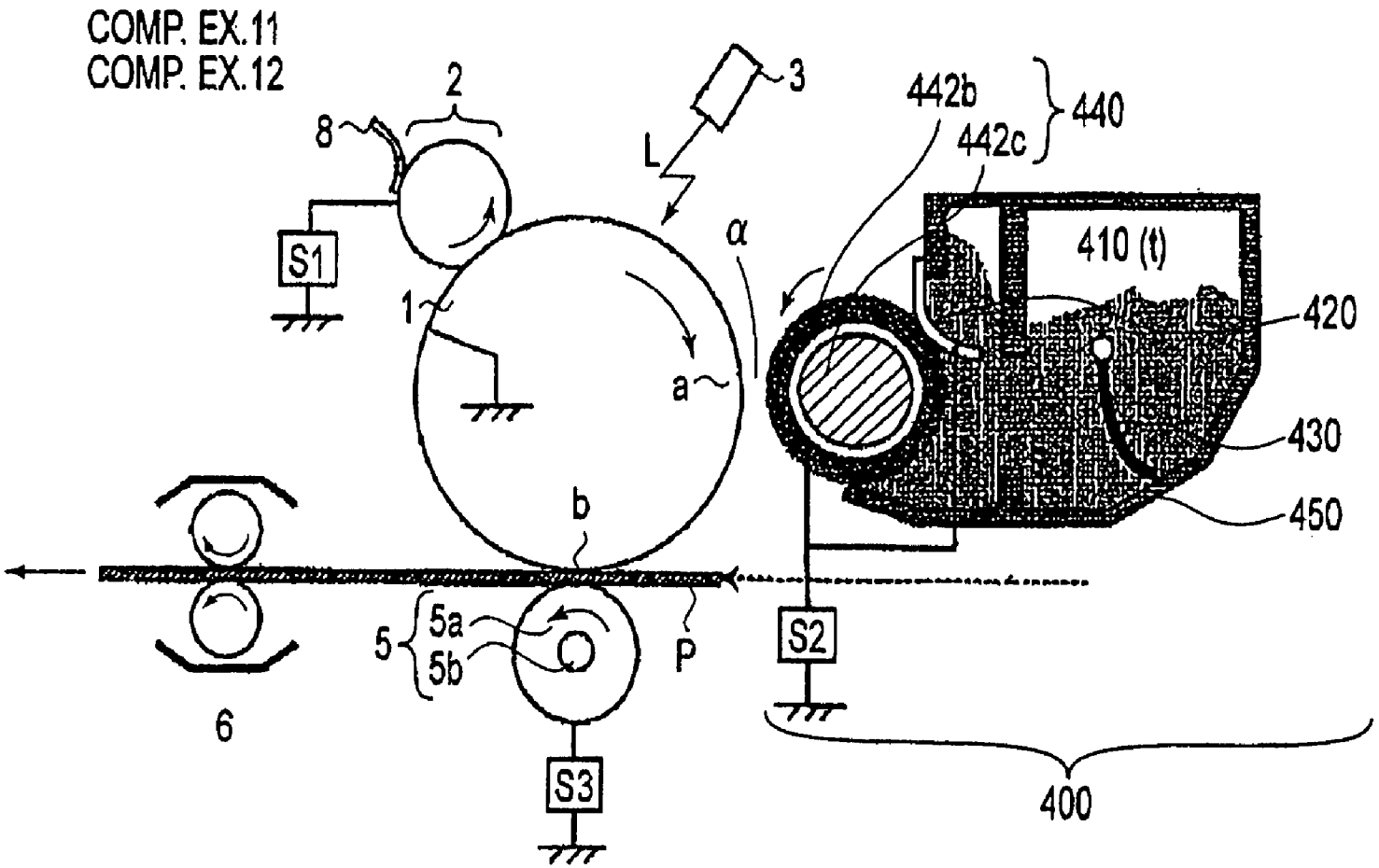
FIG. 23 is a schematic drawing of the eleventh version of the cleaner-less image forming apparatus in the second comparative embodiment, showing the general structure thereof.

The apparatus of this comparison example (FIG. 23) is of comparison scheme 2 (cleanerless system) type. The apparatus of this comparison example is the same as that of Comparison Example 4 except for comparison scheme 2 is used Comparison Example 4 cleanerless).

COMPARISON EXAMPLE 12

Jumping Development+Weak AC+Cleanerless.

The apparatus of this comparison example (FIG. 23) is of comparison scheme 2 (cleanerless system) type. The apparatus of this comparison example is the same as that of Comparison Example 5 except for comparison scheme 2 is used Comparison Example 5+cleanerless).

COMPARISON EXAMPLE 13

Elastic Developing Sleeve+Proximity Non-Contact+AC Application+Cleanerless.

Figure 24:
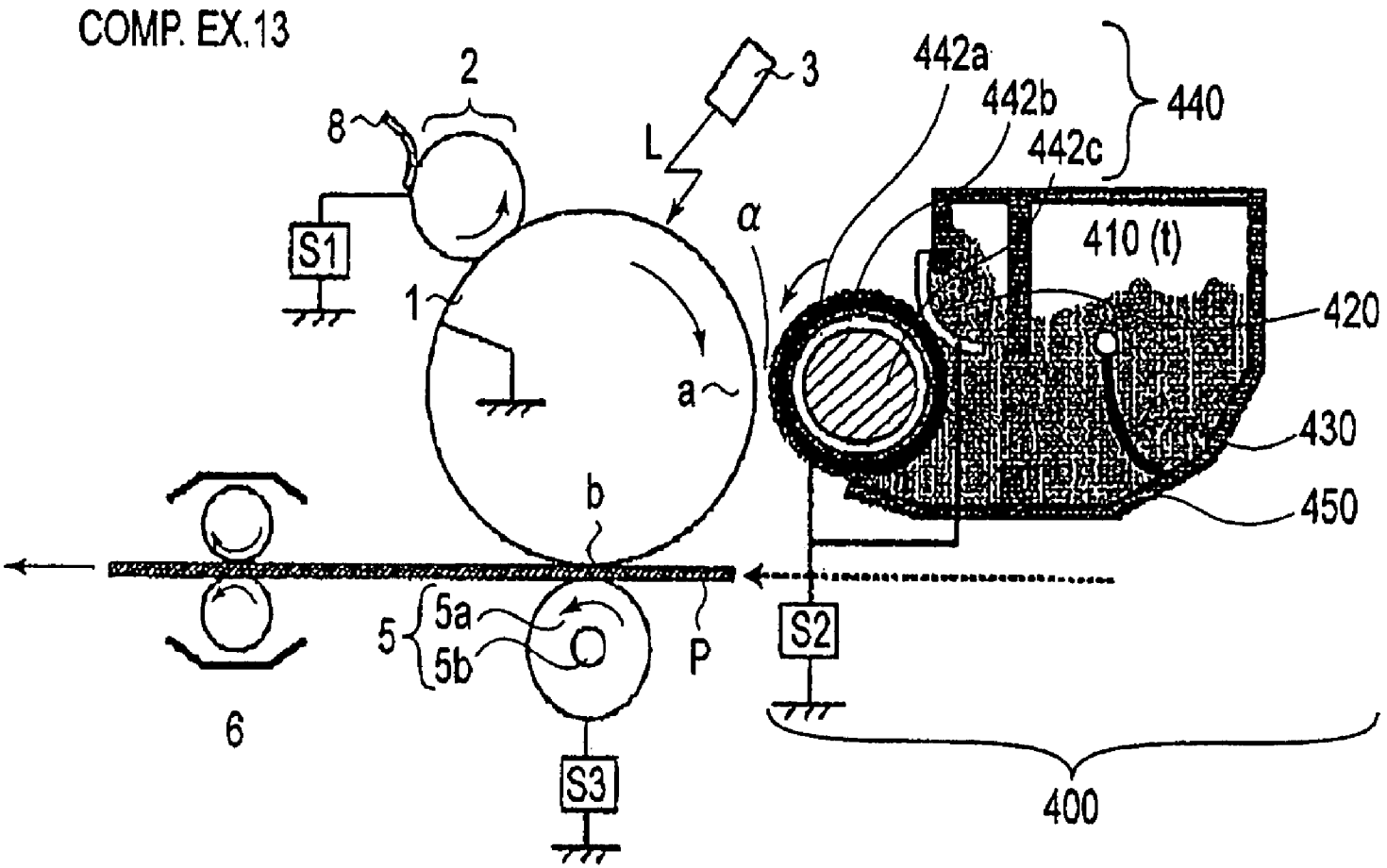
FIG. 24 is a schematic drawing of the thirteenth version of the cleaner-less image forming apparatus in the second comparative embodiment, showing the general structure thereof.

The apparatus of this comparison example (FIG. 24) is of comparison scheme 2 (cleanerless system) type. The apparatus of this comparison example is the same as that of Comparison Example 7 except for comparison scheme 2 is used Comparison Example 7+cleanerless).

(10) Evaluations of the Embodiments and Comparison Examples:

The image evaluation of Embodiments 3 and 4 and Comparison Examples 8–13 are carried out through the following evaluation methods.

Evaluation Method A):

A-1) Image Defect Evaluation Attributable to Configuration of Surface of Elastic Layer of the Developer Carrying Member.

For the image evaluation, halftone images are produced, and the evaluation is made on the basis of the number of defects. The scanner machine used in the tests is a 600 dpi laser scanner.

In the tests, the halftone image is represented by an image comprising 1 line extending in the main scan direction and subsequent non-printed 2 lines. The image thus provided, as a total, represents a half-tone image.

The density of the half-tone is measured at 50 points using a reflection density meter (Macbeth SERIERS 1200 Color Checker), and a difference of the maximum density and the minimum density is obtained. The number of spots of the density non-uniformity having a diameter of not less than 0.5 mm is counted, and the counts are ranked as follows:

N: the density difference is not less than 0.4, or the number of spots of the density non-uniformity having the diameter of not less than 0.5 mm is not less than 30.

G: the density difference is less than 0.4, or the number of spots of the density non-uniformity having the diameter of not less than 0.5 mm is less than 30.

The factors of the image defect attributable to the shape of the developer carrying member elastic layer surface will be described. The upper part of FIG. 11 is a schematic view in the case of the developing bias voltage being a DC voltage application, and the lower part is a schematic view in the case of the developing bias voltage being a DC voltage biased with an AC voltage. In FIG. 11, (a) is a schematic view of toner transfer onto the surface of the photosensitive drum 1 in the case that the surface of the developer carrying member 440 is pitted, (b) and (c) are schematic views of toner transfer onto the photosensitive drum in the case that surface of the developer carrying member is projected. As will be understood from the upper part of (a) of FIG. 11, when the surface of the developer carrying member is pitted, the density of the corresponding portion is higher than the other portion. As will be understood from the upper parts of (b) and (c) of FIG. 11, when the surface of the developer carrying member is projected, the density of the corresponding portion is higher or lower than the other portion.

From the foregoing, when the developing bias comprises a DC voltage only (the upper part of FIG. 11), an image defect is produced by the non-uniform density reflecting the pits and projections of the surface of the elastic layer in the halftone image (uniform latent image).

In order to avoid this, it will suffice if the elastic layer has a smooth and uniform surface, since the toner layer will be uniform. Practically however, manufacturing of such a smooth and uniform surface is very difficult. In addition, even if such a smooth and uniform surface is manufactured, the elastic layer is deteriorated or scraped in the long term use, with the result that surface shape changes, and therefore, the smooth and uniform surface which is stabilized is even more difficult.

On the other hand, in any case of the lower part of FIG. 11, a uniform toner layer can be formed on the photosensitive drum 1 if the developing bias comprises a DC voltage component and an AC voltage component.

In this embodiment, as shown in the lower part of FIG. 11, the developing bias is a DC voltage biased more superimposed with an AC voltage, and therefore, after the toner is transferred onto the drum with the configurations of the surface of the elastic layer reflected, the toner is supplementingly transferred onto the photosensitive drum in the portion where the toner layer is non-uniform, by the AC voltage application.

When the number of prints increases, the state of contact between the regulating blade and the developing roller changes in a certain portion or certain portions where the amount of electric charge and/or the thickness of the toner layer is different from those of the other portions, with the result that amounts of the toner transferred onto the photosensitive drum are not uniform, and therefore, that density non-uniformity is produced in the halftone image. There is a large area where the density is-high. As a result of observation using an optical microscope, the toner is agglomerated locally at such an area, and therefore, the toner is not uniformly dispersed.

When the developing bias comprising the DC voltage component and the AC voltage component is supplied, the uniformity is accomplished as indicated in the lower part of (a) and (b) of FIG. 11, so that large area density non-uniformity and the local toner non-uniformity can both be eliminated, and a satisfactory halftone image is produced.

Evaluation Method B):

B-1) Image Edge Defect:

The image edge defect means an image defect in which at a boundary between a high density portion and the low density portion the density difference therebetween is small.

For the image evaluation, a solid black image of 25 mm square is printed in the halftone image. In this evaluation, the halftone image is represented by an image comprising 1 dot and subsequent non-printed 4 dots in the main scan direction, and 1 dot and subsequent non-printed 4 dots in the subscan direction. The image thus provided, as a total, represents a half-tone image. 1 in the accounting of the number of toner particles in 1 dot, 15 dots are extracted at random, and the average of the numbers of the toner particles is represented as the number of toner particles in one dot.

N: the number of the toner particles at the edge is not more than 60% of the number of the toner particles at a portion sufficiently away from the edge portion.

G: the number of the toner particles at the edge is more than 60% of the number of the toner particles at a portion sufficiently away from the edge portion.

The evaluations are carried out for initial 100 sheets.

B-2) Image Edge Defect Factors:

Referring to FIG. 12, the description will be made as to image edge defect factors. When the peak-to-peak voltage of the AC voltage is large, reciprocation of the toner particles occurs in the developing zone. At this time, if there is a printing area at which the density difference is large, as shown in FIG. 12, the toner particles reciprocating in the neighborhood of the boundary, the toner articles are attracted toward the printing area having the high density, and therefore, the density of the low density part lowers than expected at the boundary portion.

Evaluation Method C)

C-1) For this image evaluation, a solid black image defect prevention (including electrical leakage due to paper dust) is printed, and the evaluation is made on the basis of the number of defects in the images. The scanner machine used in the tests is a 600 dpi laser scanner.

If leakage occurs during the developing operation, a white appears in the solid black image. The number of such defective portions are checked as follows:

The evaluation ambient conditions are 32.5° C. and 80% Rh. For the evaluation, three solid black image are printed after 24 hours elapse after 100 sheets print. The image evaluation is represented by the page having the largest number of defects.

The vibrations are ranked as follows:

N: the number of white spots having a diameter of not less than 0.3 mm in the solid black image exceeds 50.

P: the number of white spots having a diameter of not less than 0.3 mm in the solid black image is 5–50, and the number of white spots having a diameter of not more than 0.3 mm exceeds 50.

F: the number of white spots having a diameter of not less than 0.3 mm in the solid black image is less than 5, and the number of white spots having a diameter of 0.1–0.3 mm is 5–50.

G: the number of white spots having a diameter of not less than 0.1 mm in the solid black image is less than 5.

C-2) Factors of Leakage and Paper Dust Leakage:

As shown in FIG. 13, when the solid black image is developed under the application of the AC voltage in the developing bias, the difference between the surface potential of the image bearing member (light potential V1) and the minimum value (Vmin) of the developing bias voltage value provides the maximum field intensity, and in such a situation, the leakage L1 is liable to occur.

The electrostatic latent image on the image bearing member 1 is disturbed at the portion where the leakage L1 occurs, and as a result, a part of potential (light potential V1) of the solid black portion on the image bearing member 1 approaches to the dark potential (Vd) due to the leakage, and therefore, the toner t is unable to transfer onto the image bearing member (reverse development). Then, a white spot appears at this portion on the image bearing member 1.

When the leakage occurs, a portion charging to Vmin appears on the photosensitive drum irrespective of the field intensity. If the Vmin is very low, the contrast of the developing bias relative to DC value Vdc(|Vmin−Vdc|) is large, the amount of the toner transferred onto the drum remarkably decreases with the result of conspicuous defect.

In addition, if the paper dust included in the returning toner reaches the developing zone together with the toner ((a) of FIG. 13), the electrical leakage occurs through the paper dust. As shown (in (a) of FIG. 13), when the paper dust F reaches the developing zone, the gap relative to the drum decreases from G1 to G2. If this occurs, the local field intensity applied to the paper dust increases (right side of (b) of FIG. 13), so that leakage tends to occur. Under a high temperature and high humidity ambience, the paper dust absorbs a relatively large amount of water, and therefore, the resistance is low. When an external electric field E is supplied at this time as shown in (c) of FIG. 13, the charge is offset, so that amount of electric charge increases at the free end portion of the paper dust to increase the tendency of leakage. For this reason, the liability of electrical leakage is larger in the cleaner-less system done in the system using the cleaner.

Evaluation Method D:

For the image evaluation from the standpoint of solid white image defect due to the leakage (including paper dust leakage), solid white images are outputted, and the evaluation is made on the basis of the number of the defects. The scanner machine used in the tests is a 600 dpi laser scanner.

When the leakage occurs during the developing operation, it appears as a black point in a solid white image. The number of such defective portions are checked as follows:

The evaluation ambient conditions are 32.5° C. and 80% Rh. For the evaluation, 100 sheets are printed, and the apparatus is left for 24 hour, and then three solid white images are printed. The image evaluation is represented by the page having the largest number of the defects.

The vibrations are ranked as follows:

N: the number of black spots having a diameter of not less than 0.3 mm in the solid white image exceeds 50.

P: the number of black spots having a diameter of not less than 0.3 mm in the solid white image is 5–50, and the number of black spots having a diameter of 0.1–0.3 mm in the solid white image exceeds 50.

F: the number of black spots having a diameter of not less than 0.3 mm in the solid white image is less than 5, and the number of black spots having a diameter of 0.1–0.3 mm in the solid white image is 5–50.

G: the number of black spots having a diameter of not less than 0.1 mm in the solid white image is less than 5.

D-2) Factors of Leakage and Paper Dust Leakage:

As shown in (b) of FIG. 14, when the solid white image is developed under the application of the AC voltage in the developing bias, the difference between the surface potential of the image bearing member (dark potential Vd) and the maximum value (Vmax) of the developing bias voltage value provides the maximum field intensity, and in such a situation, the leakage L3 is liable to occur.

The electrostatic latent image on the image bearing member 1 is disturbed at the portion where the leakage L1 occurs, and as a result, a part of potential (dark potential Vd) of the solid white portion on the image bearing member 1 approaches to the light potential (V1) due to the leakage, and therefore, the toner t is transferred onto the image bearing member 1 (reverse development). Then, a black spot appears at this portion on the image bearing member 1.

When the leakage occurs, a portion charging to Vmin appears on the photosensitive drum irrespective of the field intensity. If Vmax is high, the contrast of the developing bias relative to the DC value Vdc (|Vmax−Vdc|) is large so that amount of transfer of the toner increases with the result of very conspicuous defect.

In addition, if the paper dust included in the returning toner reaches the developing zone together with the toner ((a) of FIG. 13), the electrical leakage occurs through the paper dust. As shown in (a) of FIG. 13, when the paper dust F reaches the developing zone, the gap relative to the drum decreases from G1 to G2. If this occurs, the local field intensity applied to the paper dust increases (right side of(b) of FIG. 13), so that leakage tends to occur. Under a high temperature and high humidity ambience, the paper dust absorbs a relatively large amount of water, and therefore, the resistance is low. When an external electric field E is supplied at this time as shown in (c) of FIG. 13, the charge is offset, so that amount of electric charge increases at the free end portion of the paper dust to increase the tendency of leakage. For this reason, the liability of electrical leakage is larger in the cleaner-less system done in the system using the cleaner.

Evaluation Method E)

E-1) Toner Contamination by Toner Scattering:

For the purpose of this evaluation, after 2000 sheets test printing operations, the toner deposited on the outer wall of the cartridge or on the inside of the main assembly is collected, and the weight thereof is measured.

N: the amount of the scattered toner exceeds 0.5 g;

F: the amount of the scattered toner is 0.1–0.5 g;

G: the amount of the scattered toner is not more than 0.1 g;

The evaluations are carried out for initial 100 sheets.

E-2) Toner Scattering Factors:

In the case of the non-magnetic toner, it is not possible to confine the non-magnetic toner by a magnetic force, and only the electrical confining force is available. This is one of the causes of the toner scattering. Particularly in the case of the non-magnetic toner, the charging property of the toner is significantly concerned with the depositing force onto the developer carrying member, and therefore, when the charging is not enough, the toner on the developer carrying member scatters to outside the developing container where there is no magnetic confining force.

In the case of the non-contact development, the toner jumps to the photosensitive drum, and therefore, when the charging property is not sufficient, the scattering occurs is greater.

In the case of the magnetic toner, the magnetic force is contributable to the deposition of the toner on the developer carrying member, and therefore, even when the charging to the toner is not sufficient, the toner can be confined on the developer carrying member, and the toner can be accommodated back into the developing container. In this manner, the toner scattering is prevented.

Evaluation Method F)

F-1) Fog Property Evaluation on Sheet when the Remaining Toner Amount is Short:

By repetition of the printing test operation, the amount of the toner in the developing device decreases so that produced image becomes thin. The evaluation has been made with respect to the fog property on the sheet when the remaining toner amount decreases.

The fog means an image defect of background contamination caused by a small amount of toner deposited on a white portion (un-exposed portion) where the toner is not supposed to deposit by development.

The amount of fog is measured in this manner. The optical reflectance of the white portion is measured by an optical reflectance measuring machine TC-6DS available from Tokyo Denshoku using a green filter, and the difference of the measurement from the reflectance obtained when a plane paper is measured, is used as the reflectance of the fog. In determination of the amount of the fog, the measurements are carried out at least 10 different points on the recording paper, and the average of the measurements is employed as the amount of the fog.

N: the amount of fog exceeds 2%.

G: the fog amount is less than 2%.

If an image defect other than the defects which has been described hereinbefore occurs, the defect portion is excluded from the measurement to evaluate the fog only.

When the effects of the lateral line images appear during the printing test, the fog prevention evaluation is carried out, and thereafter, the developing device is removed from the recording device, and then, the developing device is manually shaken to force the toner to move to the developing sleeve and the developing roller. The developing device is then mounted into the apparatus, and the fog prevention evaluation is carried out. The fog prevention evaluation of them are made on the sheet, and the worst result is selected and is used for the fog prevention evaluation.

F-2) Factors of Increase of Fog Amount on Sheet upon Toner Shortage:

The supply of the non-magnetic toner onto the developing roller is effected by contacting a sponge-like supplying roller to the developing roller so as to provide a counterdirectional peripheral movements. Therefore, by the sliding contact between the developing roller and the supplying roller, the deterioration of the toner is remarkable with the result of reduction of the charging property. For this reason, the fog amount increases with increase of the number of prints produced.

In the cleaner-less system (toner recycling system), the toner is collected back into the developing device, and the deteriorated toner tends to increase. For this reason, the number of prints until the image defect due to the increase of the fog amount results is smaller than in the case of using the cleaner.

On the other hand, when the fog amount increases in the cleaner-less system, the transfer roller contamination results even to such an extent that charging roller contamination with the residual toner (fog toner) totally disables the charging of the photosensitive drum. If this occurs, whole surface black image is produced, and the sheet wraps around the fixing device, resulting in malfunction of the apparatus.

The suppression of the fog amount is particularly important in the case of cleaner-less system.

Furthermore, with such a toner supply mechanism, the toner replacement hardly occurs around the developing roller with the result of production of the region in which the toner does not circulate. On the other hand, the circulating toner deteriorates to a certain degree. When the cartridge is shaken in the case of toner shortage, the less deteriorated toner and such deteriorated toner are mixed together in the developing container, namely, the toner particles having different polarities are mixed with the result of remarkable increase of the fog amount.

This is because when such a mixture occurs, and the charging of the toner is effected, the undeteriorated toner has high charging property, and the deteriorated toner has hardly any charging, or has a polarity opposite to the regular polarity. The thus not charged or opposite polarity toner results in increase of the fog amount, and as compared with the case of using the drum cleaner, the difference in the polarity of the toner further increases, and this further increases the fog amount.

The toner of the opposite polarity leads to the fog, because the direction of force received by such opposite polarity toner is the opposite from the force received by the regular polarity, and therefore, the opposite polarity toner positively transfers onto the non-printing area.

In the case of the magnetic toner used, the toner is fed by the magnetic force, and therefore, the toner is not remarkably deteriorated. Even when the cartridge is shaken immediately before the toner shortage, there occurs no mixture of the toner particles having opposite polarities, therefore, the increase of the fog amount immediately before the toner shortage can be prevented.

Evaluation Method G).

G-1) Toner Collection Property (Cleanerless System).

For this evaluation, a solid black image of 30–50 mm is printed at the leading end of the printed image area, and thereafter the image recording device is operated to print an evaluation pattern having a solid white image and is stopped during the printing operation. The timing of the stop is the instance when the center position of the solid black image at the leading end comes to the developing zone. The reflectance of the toner deposited on the surface of the photosensitive drum is measured at each of the points before and after development The toner collection efficiency can be evaluated on the basis of a ratio between the reflectance. Actually, the toner on the drum is transferred on a transparent tape, which in turn is stuck on a plain paper, and the net reflectance of the toner is measured using optical reflectance measurement machine TC-6DS, available from Tokyo Denshoku Kabushiki Kaisha, Japan.

N: the collection rate is less than 30%:

F: the collection rate is less than 50%:

G; the collection rate is not less than 50%:

The evaluations are carried out for initial 100 sheets.

G-2) Factors of Decrease of Collection Rate:

When the developer carrying member is opposed to the photosensitive drum without contact thereto, the magnetic collection force and the electrical collection force are not strong because of the relatively larger distance therebetween. This deteriorates the collection rate.

On the other hand, in this embodiment, the developer carrying member is press-contacted to the photosensitive drum, and therefore, the distance therebetween is small, and the magnetic collection force and the electrical collection force are strong.

In the case that photosensitive drum and the developer carrying member are press-contacted to each other, the pulling force produced by the contact of objects, van der Waals force is quite the same between the drum and the toner, between the toner and the developer carrying member, and between the toner and the toner. However, in the case that developer carrying member is not contacted to the drum, such a force applies only between the drum and the returning toner. In the contact case, the force which objects to remove the toner from the drum does not apply when the developer carrying member is contacted to the photosensitive drum. This is the reason of the improvement of the collection rate.

In addition, the press-contact structure is effective to assure the development and collecting operation by the electric field, since the effective area of the development nip increases, and it is promoted to make the charge of the returning toner negative, and in addition, the returning toner is loosened, since the effective area of the development nip increases.

In addition, the developing bias includes the AC voltage component in addition to the DC voltage component, so that electrical loosening effect further improves the collection rate.

Evaluation Method H).

H-1) Image Defect Due to Improper Supply (Removal):

For the image evaluation, halftone images are produced, and the evaluation is made on the basis of the number of defects. The scanner machine used in the tests is a 600 dpi laser scanner.

In the tests, the halftone image is represented by an image comprising 1 line extending in the main scan direction and subsequent non-printed 2 lines. The image thus provided, as a total, represents a half-tone image.

In the cleaner-less system, with increase of the number of prints, a white longitudinal stripe appears in a halftone image due to improper supply (removal) by the paper dust. For investigation, an image having an image surface stacking rate of 7% is printed on A4 size. When 100 sheets are printed, and when 3000 sheets are printed, a halftone image is printed, and the longitudinal stripe in the halftone image is checked in the following three ranks:

N: not less than 10 white longitudinal stripes are produced on the halftone image:

F: 3–10 white longitudinal stripes are produced on the halftone image:

Less than 3 white longitudinal stripes are produced on the halftone image:

H-2) Factors of White Stripe Production:

If the paper dust included in the returning toner is mixed into the developing device, the paper dust is deposited on the sponge-like supplying roller for supplying the toner onto the developing roller, the toner supply property deteriorates. When the paper dust is present between the developing roller and the supplying roller, the toner layer on the developing roller is disturbed, so that sufficient supply is obstructed with the result of white stripe on the produced image.

Table shows the results of image evaluation in Embodiments 3, 4 and Comparison Examples 8–13.

TABLE 2

| | *1 | *2 | *3 | *4 | *5 | *6 | *7 | *8 |
|---|---|---|---|---|---|---|---|---|
| Emb. 3 Cleanerless Contact/Weak AC Mag. Toner Elastic Sleeve | G | G | G-G | G-G | G | G | G | G-G |
| Emb. 4 Cleanerless Contact/Weak AC NonMag. Toner Elastic Roller | G | G | G-G | G-G | F | P | G | G-F |
| Comp. Ex. 8 Cleanerless Contact/AC Mag. Toner Elastic Sleeve | G | P | F-P | F-P | G | G | G | G-G |
| Comp. Ex. 9 Cleanerless Contact/AC NonMag. Toner Elastic Roller | G | P | F-P | F-P | F | P | G | G-F |
| Comp. Ex. 10 Cleanerless Contact/DC NonMag. Toner | P | G | G-G | G-G | F | P | G | G-P |
| Comp. Ex. 11 Cleanerless Jumping Development | G | P | P-N | P-N | G | G | P | G-G |
| Comp. Ex. 12 Cleanerless Jumping Development Weak AC | X | X | G-G | G-G | G | G | P | G-G |
| Comp. Ex. 13 Cleanerless Proximity/AC Elastic Sleeve | G | P | F-P | F-P | G | G | P | G-G |

*1 Evaluation method A
Prevention of Non-uniformity on surface of developer carrying member (pits and projections, resistance uneveness)
*2 Evaluation method B
Prevention of Image edge defect
*3 Evaluation method C TABLE 2-continued

| | *1 | *2 | *3 | *4 | *5 | *6 | *7 | *8 |
|---|---|---|---|---|---|---|---|---|

Prevention of Solid black image defect due to leakage (cleaner type to cleanerless type)
*4 Evaluation method D
Prevention of Solid white image defect due to leakage (cleaner type to cleanerless type)
*5 Evaluation method E
Prevention of Toner scattering
*6 Evaluation method F
Prevention of Fog upon shortage of toner
*7 Evaluation method G
Toner correction performance
*8 Evaluation method H
Removal/Supply performance (100 sheets to 3000 sheets)
X: Not evaluatable (10-1) Comparison with Contact Development DC Developing Bias Application with Cleanerless System Using Non-magnetic Toner Comparison Example 10):

The description will first be made as to a comparison of this Embodiments 3, 4 with conventional cleanerless systems, namely, a contact development DC developing bias application with cleanerless system, using non-magnetic toner Comparison Example 10), and contact development AC developing bias application cleanerless system, using non-magnetic toner Comparison Example 11).

In Comparison Example 10, the unsmoothness (pits and projections) of the surface shape of the developing roller appears as density non-uniformity on the produced halftone image, but in Embodiments 3, 4, the density non-uniformity does not result, and a satisfactory image quality is provided, because the developing bias comprises the AC voltage component in addition to the DC voltage component. In addition, in Comparison Example 10, the toner scattering is slightly recognized, but in Embodiment 3, the toner scattering is not recognized. This is because the toner is magnetically confined, therefore, this embodiment is advantageous in terms of suppression of the toner scattering.

In Comparison Example 10, with the increase of the prints (particularly, low duty prints), the toner deterioration is remarkable because the toner deteriorates by the pressure of sliding contact between the developing roller and the sponge-like supplying roller for supplying the toner to the surface of the developing roller and because the toner deteriorates due to the recycling of the toner in the toner recycling system. Because of the toner deterioration, the fog amount increases. In Embodiment 3, on the contrary, such toner deterioration and increase of the fog amount are not recognized, because the toner is magnetically fed. Additionally, in Comparison Example 10, with the increase of the prints, the increase of the fog amount is remarkable resulting in an image defect because of the charging roller contamination with the residual toner. But, the toner is magnetically fed, and therefore, the toner does not deteriorate, and therefore, the fog amount does not increase, so that charging roller contamination is suppressed, and the successive increase of the fog is not recognized. Namely, in Embodiment 3, the increase in the fog amount due to the deterioration of the toner, the increase of the deteriorated toner due to the collection of the toner and the successive increase of amount of the fog due to the charging roller contamination, when the number of the produces produced prints increases, are suppressed.

In Comparison Example 10, when the number of prints produced increases, a toner coagulated material is produced on the supplying roller of sponge, with the result of spots in the halftone image, but in Embodiment 1, the toner is fed magnetically, so that image defect attributable to the feeding does not occur.

From the foregoing, in Embodiment 1, the image defect attributable to the toner coagulated material is suppressed.

In Comparison Example 10, the fog amount upon the toner shortage remarkably increased, but in Embodiment 1, no remarkable increase of the fog amount is recognized. This is because the toner is fed magnetically on the sleeve in Embodiment 3, so that toner deterioration does not tend to occur, and when the cartridge is shaken, there is no mixture of the toner particles having different polarities.

Additionally, in Comparison Example 10, an improper toner supply to the developing roller attributable to accumulation of the paper dust included in the returning toner, with the reflection of a white stripe produced in the printed image. On the other hand, in Embodiment 3 of the present invention, no such white stripe is produced, since the toner is fed magnetically and therefore no paper dust is accumulated.

In Embodiment 4, the accumulation of the paper dust occurs with the result of protection of the white stripe, but it was not as in Comparison Example 10. The reason is that developing bias comprises the AC voltage component in addition to the DC voltage component, and even if the white stripe is produced, the toner jumps in the jumping reaction to suppress the image defect.

As describing the foregoing, as compared with the prior-art Comparison Example 10 close parentheses in which the contact development is effected with DC developing bias application and using non-magnetic toner with the cleaner-less system employment, according to this embodiment, the halftone image defect attributable to the developing roller surface shape is suppressed, and satisfactory and uniform images are produced; even when the number of prints increases, the increase of the increase due to the deterioration of the toner attributable to the pressure between the supplying roller and the developing roller, is suppressed, and the increase of the fog amount due to the increase of the deteriorated toner attributable to the collection of the returning toner is suppressed, and the increase of the fog amount due to the charging roller contamination is suppressed, and the increase of the fog amount upon the toner shortage is suppressed, and the production of the white stripe attributable to the improper toner supply is suppressed.

(10-2) Comparison with an Apparatus Using Contact Development AC Developing Bias Application with Cleanerless System Using Magnetic Toner (Comparison Example 11).

In Comparison Example 11, the image edge defect is remarkable, but in Embodiments 3 and 4, the image edge defect does not result. In Comparison Example 11, the Vpp of the AC voltage component of the developing bias is large with the result of promoted reciprocation of the toner in the developing zone, and therefore, the toner gathers at the edge of image. In addition, since non-contact development is used, the reciprocation of the toner is further enhanced, and therefore, the image edge defect is also enhanced.

On the other hand, in this embodiment, the Vpp of the AC voltage component applied as the developing bias is low, the reciprocation of the toner is less, and the development is the contact development, and therefore, the toner jumping region is narrow, so that toner gathering at the edge of image is effectively suppressed.

In Comparison Example 11, the leakage occurs more easily than in Embodiment 1 and modified example, and because of this, black spots in the solid white image is produced, and the diameter of the white spot in the solid black image is large. In Comparison Example 4, the Vpp of the AC voltage component of the developing bias is high, the leakage easily occurs, and the sizes of the black spots and the black spots are large because the developing sleeve or the developing roller are not contacted with each other. Additionally, in Comparison Example 11, the occurrence percentage of the leakage in the cleanerless system is larger than in the cleaner using system, with the result that numbers of black spots and white spots increase.

Furthermore, in Comparison Example 11, the collection property is remarkably low. The reason for this is that force for the collection from the photosensitive drum is small because the non-contact development is used.

On the other hand, in this Embodiments 3, 4 wherein the contact development is employed, the electrical force and the magnetic force are sufficiently strong so that collection property is high. Furthermore, since the developer carrying member is press-contacted to the photosensitive drum, the physical loosening effect is provided and further improves the collection property.

As described in the foregoing, the present invention is advantageous over the prior-art in that image edge defect is suppressed, and the image defect attributable to the electrical leakage (black spot in a solid white image, a white spot in a solid black image) can be suppressed, and the toner collection property is good.

(10-3) Results of Evaluation Methods A, B, E and F.

The results of evaluation will be described in detail. The results of evaluations by the evaluation methods A, B, E and F are quite the same as the results of evaluation methods a, b, e and f. Therefore, the present invention is advantageous irrespective of the presence or absence of the cleaner.

From the foregoing, the use of the structure of Embodiment 1 and modified example is advantageous both when the cleaner-less system is used or not.

(10-4) Results of Evaluations by Evaluation Method C.

The results of evaluations by evaluation method C (leakage including leakage through paper dust) will be described. In Comparison Examples 8, 9, 11 and 13, the leakage occurs and when the cleaner-less system is the leakage is worse than when the drum cleaner is used.

This is because the paper dust included in the returning toner is present adjacent the developing zone, and therefore, the tendency of leakage increases, with the result that image defect due to the leakage is worse when the cleaner-less system is used. Similarly in the case of using a cleaner, when an AC voltage having a high Vpp is applied, the leakage is remarkably easy, and the clearance $\alpha$ existing between the developer carrying member 440 and the photosensitive drum 1 increases the diameter of the white spot which is the image defect attributable to the leakage. In addition, in the cleaner-less system, the leakage occurrence remarkably increases due to the presence of the paper dust in the toner.

On the other hand, in Embodiments 3 and 4, although the leakage L1 and the leakage L2 in the cleaner-less system tends to occur more frequently, the image defect attributable to the leakage L2 is suppressed. Referring to FIG. 15, this will be considered.

(a) of FIG. 15 shows a relation between the developing bias and the drum surface potential when the leakage L1 or the leakage L2 (paper dust) is produced in the solid black image. The leakages L1 and L2 is enhanced by increase of $|Vmin-V1|$. In Embodiments 3 and 4, the leakage is reduced by selecting a small Vpp of the AC value of the developing bias.

When a local non-uniformity region is produced by foreign matter including paper dust or toner agglomeration in the developing zone, the occurrence of leakage L1 or L2 similarly to the increase of the Vpp, but in Embodiments 3 and 4, the superimposed AC voltage is effective to reduce the toner agglomeration, so that leakages L1 and L2 are suppressed.

As shown in (b) of FIG. 15, when the leakages L1 and L2 occur, a part of the surface potential of the solid black image V1 approaches to Vmin, so that drum potential locally changes by Vwt1 with the result of reduction of the developing bias beyond DC value Vdc, the white spot is conspicuous. In Embodiments 3 and 4, such image defects are not conspicuous. The reason is that would be because even if the local V wt1 potential is produced when the potential therearound is V1, the local potential portion is influenced by the potential therearound, so that actually formed potential is V wt22 ((c) of FIG. 15), and therefore, the portion results in not being conspicuous.

In other words, in Embodiments 3 and 4, the developing bias is set to satisfy $|V|max \leqq |Vd|$ further preferably $|V|max \leqq 0.9 \times |Vd|$, by which even if the leakage L1 or L2 occurs, the black spot is made much less conspicuous.

Particularly, in the cleaner-less system, the leakage L2 due to the paper dust is suppressed, and even if it occurs, the resultant image defects are less conspicuous, and therefore, the present invention is particularly effective with the use of a cleaner-less system.

Even if the leakage occurs, the diameter of the white spot is small, because the developing sleeve or roller is press-contacted to the photosensitive drum.

From the foregoing evaluations by evaluation method C, the structure of the Embodiments 3, 4 is effective to remarkably suppress the leakage, particularly the leakage due to the paper dust, which may cause the important problem in the cleaner-less system, by setting the developing bias so as to satisfy $|V|max \leqq |Vd|$, preferably $|V|max \leqq 0.9 \times |Vd|$.

Additionally, the structure is effective to make the white spot less conspicuous even if it is produced. Furthermore, the structure is effective to reduce the diameter of the spot produced by the leakage, by press-contacting the developer carrying member to the surface of the photosensitive drum at a predetermined pressure. Therefore, the structure of the present invention is very effective for the cleaner-less system.

(10-5) Evaluations by Evaluation Method D:

The evaluations by evaluation method D will be described. In Comparison Examples 8, 9, 11, and 13 wherein the cleaner-less system is used, the leakage will cause in some cases, and it is worse than when the drum cleaner is used.

This is because the tendency of the leakage is enhanced by the existence of the paper dust adjacent the developing zone, and therefore, the image defect attributable to the leakage is enhanced. The level thereof is such that by the application of high Vpp of the AC voltage, the leakage is remarkably enhanced, similarly to the case of the drum cleaner (7) being used, and the diameter of the black spot (image defect) attributable to the leakage is enhanced by the existence of clearance $\alpha$ between the developer carrying member 440 and the photosensitive drum 1. Additionally, in the cleaner-less system, the occurrence of the leakage is enhanced due to the paper dust existing in the returned toner.

On the other hand, in Embodiments 3 and 4, the image defect attributable to the leakage L4 due to the presence of the paper dust is suppressed, despite the fact that leakage L4 attributable to the paper dust is enhanced in the cleaner-less system. Referring to FIG. 16, this will be considered.

(a) of FIG. 16 shows a relation between the drum surface potential and the developing bias when the leakage L3 or leakage L4 due to the paper dust is produced in the solid white image. The tendency of the leakages L3 and L4 is larger if $|Vmax-Vd|$ is larger. In Embodiments 3 and 4, the value of the Vpp of the AC value in the developing bias is reduced, by which the accordance of the leakage is remarkably suppressed.

In addition, when a local non-uniformity region is produced by foreign matter including paper dust or toner agglomeration in the developing zone, the occurrence of leakage L3 or L4 similarly to the increase of the Vpp, but in Embodiments 3, 4, the superimposed AC voltage is effective to reduce the toner agglomeration, so that leakages L3 and L4s are suppressed.

As shown in (b) of FIG. 16, when the leakage L3 and L4s occur, a part of the surface potential of the solid black image V1 approaches to Vmax, so that drum potential locally changes by V bk1 with the result of increase of the developing bias beyond DC value Vdc, the black spot is conspicuous. In Embodiments 3 and 4, such image defects are not conspicuous.

The reason is that would be because even if the local V bk1 potential is produced when the potential therearound is Vd the local potential portion is influenced by the potential therearound, so that actually formed potential is V bk2 ((c) of FIG. 16), and therefore, the portion results in not conspicuous. In other words, in Embodiments 3 and 4, the developing bias is set to satisfy Vmax=V1, by which even if the leakage L1 or L2 occurs, the black spot is made much less conspicuous.

Particularly, in the cleaner-less system, the leakage L4 due to the paper dust is suppressed, and even if it occurs, the resultant image defects are less conspicuous, and therefore, the present invention is particularly effective with the use of a cleaner-less system.

Even if the leakage occurs, the diameter of the black spot is small, because the developing sleeve or roller is press-contacted to the photosensitive drum, similarly to Embodiment 1 and modified example.

From the foregoing evaluations by evaluation method C, the structure of the Embodiments 3 and 4 is effective to remarkably suppress the leakage, particularly the leakage due to the paper dust, which may cause the important problem in the cleaner-less system, by setting the developing bias so as to satisfy Vmax≦V1. Additionally, the structure is effective to make the white black less conspicuous even if it is produced. Furthermore, the structure is effective to reduce the diameter of the spot produced by the leakage, by press-contacting the developer carrying member to the surface of the photosensitive drum at a predetermined pressure. Therefore, the structure of the present invention is very effective for the cleaner-less system.

(10-6) Results of Evaluations by Evaluation Method F:

The results of evaluations of the collection property in the cleanerless system by evaluation method F will be described. In Comparison Examples 11, 12 and 13, as compared with Embodiment 3 and 4, the collection property its not good, and the rank thereof is "N". The reason would be as follows: the developer carrying member is not contacted to the photosensitive drum, and therefore, the toner collection property is remarkably bad.

The results by evaluation method F show that structure of Embodiments 3 and 4 is effective to remarkably improve the collection property of the returning toner, by the feature of the press-contact between the developer carrying member and the photosensitive drum. In addition, as described in the description of the respective embodiments, the AC voltage component in the developing bias is effective to enhance the loosening of the toner which is effective to improve the toner collection property. From the foregoing, the structure of the embodiment is particularly effective for the cleanerless system.

(10-7) Results of Evaluations by Evaluation Method G:

The results of evaluations by evaluation method F in terms of supply property will be described. In Embodiment 4 and Comparison Examples 9 and 10, the evaluation of prevention of the image defect due to the improper supply after 3000 sheets printing is "F". The reason would be as follows: in Embodiment 4 and Comparison Examples 9 and 10, the sponge-like supplying roller is contacted to the developing roller in the counter directional peripheral movement relation to feed the toner to the developing roller, the paper dust contained in the returning toner may be deposited on the supplying roller with the result of obstruction to the toner supply to the developing roller (of production to removal). This results in a longitudinal stripe (image defect) in a halftone image. The evaluation is "F" in Embodiment 4 and Comparison Example 9, and is "N" in Comparison Example 10. The reason would be as follows: in Embodiment 4 and Comparison Example 9, the developing bias comprises an AC voltage opponent, which is effective to suppress the image defect.

On the other hand, the image defect is not produced irrespective of the number of prints, because the total is magnetically fed on the elastic developing sleeve, and therefore, the paper dust is not accumulated on the developing sleeve. In addition, since the toner is magnetically fed, the toner which receives the magnetic force rather than the paper dust which is immune to the magnetic force, is selectively supplied, when the toner and paper dust are mixed together.

As a result of the evaluations by this method, the structure of Embodiment 3 provides an effect of positively supplying the toner rather than the paper dust, the effect of maintaining the image quality by the AC voltage application of the developing bias even if the coating layer of the toner is disturbed since the paper dust is not accumulated on the developing sleeve. Therefore, the structure is effective to provide satisfactory images stably irrespective of the number of prints.

From the foregoing, this embodiment is capable of remarkably suppressing the image defect (longitudinal stripe) attributable to the paper dust contained in the toner.

With the structure of Embodiment 4, the image defect attributable to the accumulation of the paper dust is liable to occur as compared with the apparatus of Embodiment 3, but the application of the AC voltage is effective to suppress the image defect to such an extent that image defect is practically no problem.

(10-8) Other Evaluations by Methods Other than those Describing the Foregoing:

The description will be made as to the evaluations other than those by evaluation methods A–G. In Embodiment 4 and Comparison Examples 9 and 10, wherein the sponge-like toner supplying roller is in sliding contact with the developing roller to supply the toner, the toner is deteriorated due to the pressure of the sliding contact between the developing roller and the supplying roller when the number of prints increases (particularly, low duty print), with the result of remarkable increase of fog amount. But, in Embodiment 3 this does not occur since the toner is magnetically fed.

In addition, the increase of the fog amount is remarkable in Embodiment 4 and Comparison Examples 9 and 10, since the amount of the deteriorated toner increases due to the toner recycling system, but this does not occur, either in Embodiment 3.

Furthermore, in Embodiment 4, and Comparison Examples 9 and 10, with the increase of the number of prints, there arises a successive increase of the fog amount due to the charging roller contamination with the residual toner, but in Embodiment 3 the fog amount does not increase.

From the foregoing, the structure of this Embodiment 3 is advantageous in that increase of the fog amount due to the toner deterioration attributable to the pressure between the developing roller and the supplying roller with the increase of the number of prints can be suppressed; the increase of the fog amount due to the increase of the deteriorated toner attributable to collection of the toner can be suppressed; the image defect due to the increase of the fog amount produced by the charging roller contamination can be suppressed.

In addition, with Embodiment 4 and Comparison Examples 9 and 10 which use a mechanism in which the sponge-like toner supplying roller is in sliding contact with the developing roller to supply the toner, the toner coagulated material is produced by the sliding contact between the sponge-like toner supplying roller and the developing roller with the increase of the number of prints, and if this occurs and the toner coagulated material reaches the developing roller, a spot-like non-uniformity appears in the halftone image. However, such image defect does not appear in Embodiment 3 since the toner is magnetically fed, and therefore, the toner coagulated material is not produced.

As described in the foregoing, according to Embodiment 3, the production of the toner coagulated material when the number of prints increases, is suppressed, and therefore, the image defect due to the toner coagulated material is suppression.

In Embodiment 4, when DC voltage of the developing bias is −400V, a non-uniformity appears in a halftone image. The non-uniformity is observed by an optical microscope, and it has been found that high density portion has coagulated toner. The cause of this is that magnetic one component toner particles have magnetic materials in or at the surface of the particles, and therefore, the toner particles are easily agglomerated magnetically. By application of the AC voltage, the transfer of the toner can be made uniform when the toner is transferred onto the photosensitive drum.

(10-9) Advantages of the Embodiment:

The advantages of this Embodiments 3 and 4 will be described.

This Embodiment 3 is advantageous in that halftone image defect due to the developing roller surface shape is suppressed, and the satisfactory uniform image is produced; that toner scattering is suppressed; that increase of the fog amount due to the deterioration of the toner with the increase of the number of prints; that successive increase of the fog amount due to the charging roller contamination is suppressed; that increase of the fog amount due to the toner shortage is suppressed; and that toner collection property for the cleanerless system is improved; and that toner supply defect is suppressed.

This Embodiment 4 is advantageous in that halftone image defect due to the developing roller surface shape is suppressed, and the satisfactory uniform image is produced; that image edge defect is suppressed; the image defect due to the leakage (a black spot in a solid white image or a white spot in the solid black image); and that toner collection property for the cleanerless system is improved.

As described in the foregoing, by using the developing device which is suitable for the cleaner-less system, the toner deterioration is suppressed; the deterioration of the image quality is suppressed; the leakage due to the paper dust is suppressed; and the improper supply due to the paper dust is suppressed, so that satisfactory images can be produced.

(11) Other Embodiments:

1) The image recording device has been described as a laser beam printer as an example, but this is not limiting, and the present invention is applicable to other image forming apparatuses such as an electrophotographic copying machine, a facsimile machine, a word processor and the like.

2) The image bearing member (a member to be developed) is a dielectric member for electrostatic recording, in the case of an electrostatic recording apparatus. In such a case, the surface of the dielectric member is uniformly charged (primary charging) to a predetermined potential, and the charge is selectively removed by a discharging needle head, an electron gun or the like to form an electrostatic latent image.

3) The image bearing member is not limited to a drum type, but may be an endless belt or a non-endless belt, or sheet.

4) The contact charging member is not limited to the roller type, but may be an endless belt or non-endless belt.

5) The recording material may be an intermediary transfer member such as an intermediary transfer drum or intermediary transfer belt or the like.

6) In the embodiment, an image forming apparatus of a transfer type is given as an example, but the image forming apparatus of the present invention is applicable to an electrofacsimile machine paper (image bearing member), an electrostatic recording paper or another direct type image forming apparatus. The image bearing member may be a rotatable belt type or the like electrophotographic photosensitive member on which an electrostatic latent image is formed, and the electrostatic latent image is developed as a toner image, and the toner image forming portion is positioned at a display or the like.

The advantageous effects of the embodiments are as summarized in the following.

1) By satisfying $|V|max \leqq |Vd|$ in a contact type developing system using a magnetic one component developer, the following advantageous effects are provided:

Effect (1): By setting the developing bias V to satisfy $|V|max \leqq |Vd|$, the fog amount is remarkably suppressed, by which the image defect (background contamination) can be suppressed.

Effect (2): The developer carrying member is press-contacted to the image bearing member, and the developing bias comprises a DC voltage component and an AC voltage component wherein $|V|max \leqq |Vd|$ is satisfied, by which the leakage is suppressed, and the white spot in the solid black image due to the leakage can be suppressed.

Effect (3): The developer carrying member is press-contacted to the image bearing member, and the developing bias comprises a DC voltage component and an AC voltage component, wherein $|V|max \leqq |Vd|$ is satisfied, by which even if the leakage occurs, a white spot in the solid black image due to the leakage can be made less conspicuous.

Effect (4): The developer carrying member is press-contacted to the image bearing member, and the developing bias comprises a DC voltage component and an AC voltage component, wherein $|V|max \leqq |Vd|$ is satisfied, the image edge defect (the edge of an image is developed to a high density, partly at the downstream of the image formation, and the edge of the half-tone portion adjacent to the high density portion is thin) can be suppressed.

Effect (5): An image defect of density non-uniformity in a halftone image reflecting the non-uniformity of the surface of the developer carrying member may be provided without the present invention. By the use of a developing bias comprising a DC voltage component and an AC voltage component, wherein $|V|max \leqq |Vd|$ is satisfied, satisfactory images can be produced.

Effect (6): The developer carrying member is press-contacted to the image bearing member, and the developing bias comprises a DC voltage component and an AC voltage component, the half-tone density non-uniformity after printing on a large number of sheets, can be suppressed.

Effect (7): The developing bias comprises a DC voltage component and an AC voltage component, wherein $|V|max=0.9\times|Vd|$ is satisfied, and the fog amount increase can be remarkably suppressed.

Effect (8): The developing bias comprises a DC voltage component and an AC voltage component wherein $|V|max \leqq 0.9\times|Vd|$ is satisfied, by which the fog amount can be reduced stably, thus suppressing image defect, even when ambient condition (temperature, humidity or the like) varies, the charging roller deteriorates, the image bearing member deteriorates, the charging property varies or deteriorates, with the result of variation of Vd or reduction of $|Vd|$.

Effect (9): The developer carrying member is press-contacted to the image bearing member, and the developing bias comprises a DC voltage component and an AC voltage component, wherein when $|V|max \leqq |Vd|$ and $V1 \leqq 0$, $Vmax \leqq V1$, and when $V1>0$, $Vmin>V1$, by which the leakage is suppressed, and the black spot in a solid white image due to the leakage can be suppressed.

Effect (10): The developer carrying member is press-contacted to the image bearing member, and the developing bias comprises a DC voltage component and an AC voltage component, wherein when $|V|max \leqq |Vd|$ and $V1 \leqq 0$, $Vmax \leqq V1$, and when $V1>0$, $Vmin>V1$, by which even if the leakage occurs, the diameter of black spot in a solid white image can be made less conspicuous.

Effect (11): In a cleaner-less system, the developing bias comprises a DC voltage component and an AC voltage component, wherein $|V|max<|Vd|$ is satisfied, by which the image defect by the fog can be remarkably suppressed even when the charging performance is deteriorated due to the charging roller contamination, which leads to decrease of $|Vd|$, and the fog tends to increase.

If the increase of the fog amount is large, the charging may be totally impossible due to the contamination of the transfer roller or the contamination of the charging roller with the result of whole surface black image is produced. If it occurs, the transfer material may wrap around the fixing device with the result of malfunction of the apparatus. But, this feature of the present invention is effective to suppress this.

Effect (12): In a cleaner-less system, the developing bias comprises a DC voltage component and an AC voltage component, wherein $|V|max \leqq 0.9\times|Vd|$ is satisfied, the fog amount can be suppressed more than effect (10).

Effect (13): In a cleaner-less system, the developing bias comprises a DC voltage component and an AC voltage component, wherein $|V|max \leqq |Vd|$, the leakage due to the paper dust in the returning developer is suppressed, and the image defect of the white spot in the solid black image can be suppression.

Effect (14): In a cleaner-less system, the developing bias comprises a DC voltage component and an AC voltage component, wherein $|V|max \leqq |Vd|$, even if the leakage due to the paper dust in the returning developer occurs, the diameter of the white spot in the solid black image due to the leakage can be reduced.

Effect (15): In a cleaner-less system, the developing bias comprises a DC voltage component and an AC voltage component, wherein when $|V|max \leqq |Vd|$, $V1 \leqq 0$, $Vmax \leqq V1$, and when $V1 \geqq 0$, $Vmin \geqq V1$, by which the leakage due to the paper dust in the returning developer is suppressed, and the image defect of the black spot in the solid white image can be suppression.

Effect (16), In the cleaner-less system, the developer carrying member is press-contacted to the image bearing member, and the developing bias comprises a DC voltage component and an AC voltage component, wherein when $|V|max \leqq |Vd|$ and $V1 \leqq 0$, $Vmax \leqq V1$, and when $V1 > 0$, $Vmin > V1$, by which even if the leakage occurs due to the leakage attributable to the paper dust, the diameter of black spot in a solid is white image can be made less conspicuous.

Effect (17): In the cleaner-less system, the developer carrying member is press-contacted to the image bearing member, by which the distance between the image bearing member and the developer carrying member can be reduced, so that size and intensity of the effective electric field and magnetic field range, the collection property of the residual developer deposited on the un-exposed portion on the image bearing member can be improved.

Effect (18): In the cleaner-less system, the developer carrying member is press-contacted to the image bearing member, by which the residual developer deposited on the un-exposed portion on the image bearing member is physically loosened, so that developer can be improved.

Effect (19): In a cleaner-less system, the developing bias comprises a DC voltage component and an AC voltage component, wherein $|V|max \leqq |Vd|$, by which the residual developer deposited on the un-exposed portion on the image bearing member is electrically loosened, so that developer collection property can be improved.

Effect (20): The developer carrying member is press-contacted to the image bearing member, by which the positional relation between the image bearing member and the developer carrying member is stabilized, so that effects (17)–(19) are kept during large number printing.

Effect (21): The developer is a magnetic one component developer, and the developer carrying member comprises a base member enclosing a stationary magnetic field generating means and an electroconductive elastic layer on the base, by which the developer is fed magnetically on the developer carrying member, so that developer is prevented from scattering to the outside of the developing container even if the charging property of the developer deteriorates, since the developer is magnetically confined.

Effect (22): The developer is a magnetic one component developer, and the developer carrying member comprises a base member enclosing a stationary magnetic field generating means and an electroconductive elastic layer on the base, by which the developer is fed magnetically on the developer carrying member, so that developer supplying roller is not necessary to supply the developer onto the developer carrying member. Therefore, even if the number of prints increases (particularly, low duty printing), the deterioration of the developer can be remarkably suppressed, and the increase of the fog amount due to the deterioration of the developer.

Effect (23): In the cleaner-less system, the developer is a magnetic one component developer, and the developer carrying member comprises a base member enclosing a stationary magnetic field generating means and an electroconductive elastic layer on the base, by which the developer is fed magnetically on the developer carrying member, so that developer supplying roller is not necessary to supply the developer onto the developer carrying member. Therefore, even if the number of prints increases (particularly, low duty printing), the deterioration of the developer due to the toner recycling can be remarkably suppressed, and the increase of the fog amount due to the deterioration of the developer.

Effect (24): The developer is a magnetic one component developer, and the developer carrying member comprises a base member enclosing a stationary magnetic field generating means and an electroconductive elastic layer on the base, by which the developer is fed magnetically on the developer carrying member, so that developer supplying roller is not necessary to supply the developer onto the developer carrying member. Therefore, the deterioration of the developer can be remarkably suppressed, and the increase of the fog amount can be attributable to the mixture of the less deteriorated developer and the developer deteriorated by shaking the cartridge upon the toner shortage, can be suppressed.

Effect (25): The developer is a magnetic one component developer, and the developer carrying member comprises a base member enclosing a stationary magnetic field generating means and an electroconductive elastic layer on the base, by which the developer is fed magnetically on the developer carrying member, so that developer supplying roller is not necessary to supply the developer onto the developer carrying member. Therefore, the image defect in the halftone image produced by accumulation of agglomerated material of the developer on the surface of the supplying roller and arrival of the developer agglomerated material at the developer carrying member.

Effect (26): In the cleaner-less system, the developer is a magnetic one component developer, and the developer carrying member comprises a base member enclosing a stationary magnetic field generating means and an electroconductive elastic layer on the base, by which the developer is fed magnetically on the developer carrying member, so that even if the paper dust is collected into the developing container to do with the returning developer, the paper dust is immune to the magnetic force, and does not obstruct the feeding of the developer. In addition, there is no need of using a developer supplying roller for supplying the developer onto the developer carrying member, and therefore, the image defect attributable to the accumulation of the paper dust on the supplying roller can be suppressed.

Effect (27): The developer is a magnetic one component developer, and the developer carrying member comprises a base member enclosing a stationary magnetic field generating means and an electroconductive elastic layer on the base, by which the developer is fed magnetically on the developer carrying member, and the developer carrying member is press contacted to the image bearing member, and the developing bias comprises a DC voltage component and an AC voltage, wherein $|V|max \leqq |Vd|$ its satisfying, the agglomeration of the developer can be loosened when the developer is transferred onto the image bearing member.

While the invention has been described with reference to the structures disclosed herein, it is not confined to the details set forth and this application is intended to cover such modifications or changes as may come within the purpose of the improvements or the scope of the following claims.

This application claims Convention Priority from Japanese Patent Application No. 416767/2003 filed Dec. 15, 2003, which is hereby incorporated by reference.

What is claimed is:

1. An image forming apparatus comprising:

an image bearing member;

charging means for electrically charging said image bearing member;

a rotatable developer carrying member for carrying a developer to develop an electrostatic image formed on said image bearing member with the developer, said developer carrying member being supplied with a developing bias voltage comprising an AC voltage;

non-rotatable magnetic field generating means, disposed inside said developer carrying member, for magnetically attracting the developer on said developer carrying member, wherein said developer carrying member has a surface elastic layer, and said developer carrying member is press-contacted to said image bearing member, and the developer is a one component magnetic toner, and a maximum value of an absolute value of the developing bias voltage |V|max and a surface potential of the image bearing member charged by said charging means is Vd), satisfy, $$|V|\max \leqq |Vd|.$$

2. An apparatus according to claim 1, wherein $|V|\max \leqq 0.9 \times |Vd|$ is satisfied.

3. An apparatus according to claim 1, further comprising electrostatic image forming means for forming the electrostatic image on said image bearing member charged by said charging means, wherein a potential of a low potential portion of the electrostatic image V1, and a maximum value of the developing bias voltage Vmax, and a minimum value of the developing bias voltage Vmin satisfy, when $V1 \leqq 0$, $Vmax \leqq V1$; and when $V1 > 0$, $Vmin > V1$.

4. An apparatus according to claim 1, further comprising transferring means for transferring the image of the developer formed on the image bearing member onto a transfer material.

5. An apparatus according to claim 1, wherein said developer carrying member develops the electrostatic image by a reverse development.

6. An apparatus according to claim 1, wherein said elastic layer has a microhardness of 40–98°.

7. An apparatus according to claim 1, further comprising supplying means for supplying the developer onto said developer carrying member, and a developer amount regulating member for regulating an amount of the developer carried on said developer carrying member.

8. An apparatus according to claim 1, wherein said elastic layer has a hardness which is lower than that of a surface of said image bearing member.

9. An apparatus according to claim 1, wherein said developing bias voltage comprises an AC voltage component and a DC voltage component.

10. An apparatus according to claim 1, wherein said image bearing member, said developer carrying member and said magnetic field generating means are contained in a process cartridge detachably mountable to a main assembly of said image forming apparatus.

11. An apparatus according to any one of the preceding claims, wherein said developer carrying member effects a developing operation and simultaneously effects a developer collecting operation for collecting the developer remaining on said image bearing member.

* * * * *

UNITED STATES PATENT AND TRADEMARK OFFICE

CERTIFICATE OF CORRECTION

PATENT NO. : 7,239,831 B2
APPLICATION NO. : 11/011145
DATED : July 3, 2007
INVENTOR(S) : Kazunari Hagiwara et al.

It is certified that error appears in the above-identified patent and that said Letters Patent is hereby corrected as shown below:

ON THE TITLE PAGE:
Item (54), Title, “WHEN” should read --WHEREIN--; “VD” should read --Vd--; and “|V| MAX ≤ |VD|” should read --|V| MAX ≤ |Vd|--.

COLUMN 1:
Line 1, “WHEN” should read --WHEREIN--;
Line 3, “VD” should read --Vd--;
Line 5, “|V| MAX ≤ |VD|” should read --|V| MAX ≤ |Vd|--;
Line 11, “employes” should read --employs--; and
Line 34, “magnet” should read --magnet.--.

COLUMN 4:
Line 6, “of remaining held” should read --holding--.

COLUMN 6:
Line 14, “formed” should read --formed.--.

COLUMN 7:
Line 43, “such” should read --such as--.

COLUMN 10:
Line 20, “Member:” should read --Member--.
Line 21, “Member” should read --Member:--.

COLUMN 13:
Line 37, “adjustment” should read --adjustment.--.

COLUMN 14:
Line 46, “carrying-member” should read --carrying member--.

COLUMN 15:
Line 9, “The elastic layer” should read --The elastic layer has--;
Line 23, “defects” should read --defects.--;
Line 37, “decrease” should read --decreases--; and
Line 67, “rotational” should read --rotationally--.

UNITED STATES PATENT AND TRADEMARK OFFICE

CERTIFICATE OF CORRECTION

PATENT NO. : 7,239,831 B2
APPLICATION NO. : 11/011145
DATED : July 3, 2007
INVENTOR(S) : Kazunari Hagiwara et al.

It is certified that error appears in the above-identified patent and that said Letters Patent is hereby corrected as shown below:

COLUMN 16:
Line 48, “a predetermined,” should read --predetermined timing--.

COLUMN 17:
Line 41, “2.0X1050.” should read --$2.0X10^5$ Ω.--; and
Line 50, “the” should read --t--.

COLUMN 19:
Line 44, “(|V| max = |Vd|)” should read --(|V| max = |Vd|).--.

COLUMN 20:
Line 20, “effect to” should read --effective for--;
Line 27, “(abscissa)” should read --(abscissa).--; and
Line 67, “out:” should read --out.--.

COLUMN 22:
Line 16, “N/rn” should read --N/m--;
Line 20, “C.” should read --C--;
Line 35, “sponge” should read --a sponge--; and “fed,” should read --fed, and--; and
Line 65, “toner t” should read --toner t.--.

COLUMN 23:
Line 27, “example” should read --example.--.

COLUMN 24:
Line 5, “as the.” should read --as the--.

COLUMN 25:
Line 45, “tin” should read --t in--; and
Line 51, “sponge” should read --a sponge--; and “fed,” should read --fed, and--.

COLUMN 26:
Line 13, “(FIG. 6),” should read --(FIG. 6); and
¶COMPARISON EXAMPLE 7: ¶(Elastic Developing Sleeve + Proximity Non-Contact + AC Application).--.

UNITED STATES PATENT AND TRADEMARK OFFICE

CERTIFICATE OF CORRECTION

PATENT NO. : 7,239,831 B2
APPLICATION NO. : 11/011145
DATED : July 3, 2007
INVENTOR(S) : Kazunari Hagiwara et al.

It is certified that error appears in the above-identified patent and that said Letters Patent is hereby corrected as shown below:

COLUMN 27:
Line 60, “difficult” should read --difficult.--.

COLUMN 28:
Line 8, “mentingly” should read --mentally--;
Line 25, “(of” should read --of--; and
Line 26, “a)” should read --(a)--.

COLUMN 29:
Line 9, “white” should read --white spot--.

COLUMN 30:
Line 20, “vd)” should read --Vd)--.

COLUMN 31:
Line 55, “circulate” should read --circulate.--.

COLUMN 33:
Line 63, “is” should read --are--.

COLUMN 34:
Line 35, “vpp” should read --Vpp--.

COLUMN 35:
Line 29, “(in b)” should read --in (b)--; and
Line 31, “Vmim,” should read --Vmin,--.

COLUMN 37:
Line 2, “drum” should read --drum.--.

COLUMN 40:
Line 55, “apparatus” should read --apparatus.--.

UNITED STATES PATENT AND TRADEMARK OFFICE

CERTIFICATE OF CORRECTION

PATENT NO. : 7,239,831 B2
APPLICATION NO. : 11/011145
DATED : July 3, 2007
INVENTOR(S) : Kazunari Hagiwara et al.

It is certified that error appears in the above-identified patent and that said Letters Patent is hereby corrected as shown below:

COLUMN 42:
Line 16, “and the” should read --and the developing sleeve--;
Line 27, “development” should read --development.--;
Line 43, “elastic” should read --developing--; and
Line 45, “elastic” should read --developing--.

COLUMN 44:
Line 25, “stabilized” should read --stabilize--.

COLUMN 45:
Line 57, “4 cleanernless).” should read --4+cleanerless).--.

COLUMN 46:
Line 29, “SERIERS” should read --SERIES--.

COLUMN 47:
Line 26, “is-high” should read --is high--; and
Line 67, “articles” should read --particles--.

COLUMN 48:
Line 2, “lowers” should read --is lower--;
Line 10, “white” should read --white spot--; and
Line 14, “image” should read --images--.

COLUMN 49:
Line 15, “hour” should read --hours,--.

COLUMN 50:
Line 28, “occurs” should read --occurrence--;
Line 54, “plane” should read --plain--; and
Line 62, “has” should read --have--.

COLUMN 51:
Line 13, “a” should be deleted.

UNITED STATES PATENT AND TRADEMARK OFFICE

CERTIFICATE OF CORRECTION

PATENT NO. : 7,239,831 B2
APPLICATION NO. : 11/011145
DATED : July 3, 2007
INVENTOR(S) : Kazunari Hagiwara et al.

It is certified that error appears in the above-identified patent and that said Letters Patent is hereby corrected as shown below:

COLUMN 52:
Line 12, “development” should read --development.--; and
Line 13, “reflectance.” should read --reflectances.--.

COLUMN 53:
Line 25, “Table” should read --Table 2--.

COLUMN 54:
Line 21, “this” should read --the--; and
Line 63, “produces” should be deleted.

COLUMN 55:
Line 29, “Comparison Example 10 close parentheses” should read --Comparison Example 10--; and
Line 67, “is” should read --are--.

COLUMN 56:
Line 15, “this” should read --the--; and
Line 42, “is” should read --is used,--.

COLUMN 57:
Line 15, “V wt1” should read --Vwt1--;
Line 18, “V wt22” should read --Vwt22--; and
Line 50, “cause” should read --occur--.

COLUMN 58:
Line 17, “L4s” should read --L4--;
Line 18, “L4s” should read --L4--;
Line 21, “V bk1” should read --Vbk1--;
Line 25, “V” should read --Vbk1--;
Line 26, “bk1” should be deleted;
Line 28, “V bk2” should read --Vbk2--;
Line 29, “in” should read --are--;
Line 49, “white black” should read --black spot--; and
Line 62, “its” should read --is--.

UNITED STATES PATENT AND TRADEMARK OFFICE

CERTIFICATE OF CORRECTION

PATENT NO. : 7,239,831 B2
APPLICATION NO. : 11/011145
DATED : July 3, 2007
INVENTOR(S) : Kazunari Hagiwara et al.

It is certified that error appears in the above-identified patent and that said Letters Patent is hereby corrected as shown below:

COLUMN 59:
Line 11, "F" should read --G--.

COLUMN 63:
Line 25, "is" should be deleted.

Signed and Sealed this

Eighth Day of July, 2008

JON W. DUDAS
*Director of the United States Patent and Trademark Office*